US008784116B2

(12) United States Patent
Buck et al.

(10) Patent No.: US 8,784,116 B2
(45) Date of Patent: Jul. 22, 2014

(54) ELECTRICAL CONNECTOR

(75) Inventors: Jonathan E. Buck, Hershey, PA (US); Madhumitha Rengarajan, Camp Hill, PA (US)

(73) Assignee: FCI Americas Technology LLC, Carson City, NV (US)

( * ) Notice: Subject to any disclaimer, the term of this patent is extended or adjusted under 35 U.S.C. 154(b) by 90 days.

(21) Appl. No.: 13/432,683

(22) Filed: Mar. 28, 2012

(65) Prior Publication Data

US 2012/0252232 A1 Oct. 4, 2012

Related U.S. Application Data

(60) Provisional application No. 61/471,477, filed on Apr. 4, 2011, provisional application No. 61/583,536, filed on Jan. 5, 2012.

(51) Int. Cl.
*H01R 12/00* (2006.01)

(52) U.S. Cl.
USPC ..... 439/55

(58) Field of Classification Search
USPC ..... 439/55, 607.35, 607.36
See application file for complete search history.

(56) References Cited

U.S. PATENT DOCUMENTS

| | | | | | |
|---|---|---|---|---|---|
| 3,871,728 | A | * | 3/1975 | Goodman | 439/62 |
| 5,026,292 | A | * | 6/1991 | Pickles et al. | 439/108 |
| 5,051,099 | A | * | 9/1991 | Pickles et al. | 439/108 |
| 5,062,292 | A | | 11/1991 | Kanba et al. | |
| 5,096,435 | A | * | 3/1992 | Noschese et al. | 439/260 |
| 5,156,554 | A | * | 10/1992 | Rudoy et al. | 439/108 |
| 5,259,768 | A | * | 11/1993 | Brunker et al. | 439/60 |
| 5,522,737 | A | * | 6/1996 | Brunker et al. | 439/637 |
| 5,580,257 | A | * | 12/1996 | Harwath | 439/108 |
| 5,919,049 | A | | 7/1999 | Petersen et al. | |
| 5,921,784 | A | | 7/1999 | Petersen et al. | |
| 5,961,355 | A | | 10/1999 | Morlion et al. | |
| 6,338,635 | B1 | | 1/2002 | Lee | |
| 6,554,647 | B1 | | 4/2003 | Cohen et al. | |
| RE38,736 | E | | 5/2005 | Walse et al. | |
| 6,981,883 | B2 | | 1/2006 | Raistrick et al. | |
| 7,503,798 | B2 | | 3/2009 | Hashim | |
| 7,517,250 | B2 | | 4/2009 | Hull et al. | |
| 8,057,267 | B2 | | 11/2011 | Johnescu | |
| 2012/0252232 | A1 | * | 10/2012 | Buck et al. | 439/55 |

FOREIGN PATENT DOCUMENTS

| | | |
|---|---|---|
| EP | 0975054 | 1/2000 |

OTHER PUBLICATIONS

Micro TCA, "Micro Telecommunications Computing Architecture Base Specification", PICMG® MicroTCA Draft Specification Release Candidate RC1.0, May 26, 2006, 536 pages.

* cited by examiner

*Primary Examiner* — Amy Cohen Johnson
*Assistant Examiner* — Vladimir Imas
(74) *Attorney, Agent, or Firm* — Baker & Hostetler LLP

(57) ABSTRACT

Electrical connectors that are mating compatible with the MicroTCA® standard and configured to be mounted to an underlying substrate are provided. Certain of the electrical connectors can be configured to be mounted to a substrate configured in accordance with the MicroTCA® press fit footprint. Additionally, electrical connectors that are mating compatible with the MicroTCA® standard and configured to be mounted to respective alternative footprints, and substrates configured in accordance with the respective alternative footprints are provided. The disclosed electrical connectors and corresponding substrate footprints can operate to transmit data at speed up to and in excess of 25 Gigabits per second.

55 Claims, 30 Drawing Sheets

ELECTRICAL CONNECTOR

CROSS-REFERENCE TO RELATED APPLICATIONS

This application claims the benefit of U.S. provisional patent application No. 61/471,477, filed Apr. 4, 2011 and U.S. provisional patent application No. 61/583,536, filed Jan. 5, 2012, the disclosures of which are incorporated herein by reference in their entireties.

BACKGROUND

Referring to FIGS. 1-2B, electrical connectors can be constructed to be mounted to a substrate, for instance a printed circuit board (PCB), that is configured with an industry standard MicroTCA® Press Fit (MicroTCA® PF) footprint (as illustrated in FIGS. 2A and 2B). For example, the electrical connector 100 and the PCB can be constructed in accordance with industry standard document MicroTCA.0, Rev. 1.0, 6 Jul. 2006, the disclosure of which is incorporated herein by reference in its entirety. The electrical connector 100 can be constructed as a card edge connector configured to receive Advanced Mezzanine Cards (AdvancedMCs), for instance as an AdvancedMC Backplane Connector in accordance with the MicroTCA® standard (see FIGS. 12A-12B). Further in accordance with the MicroTCA® standard, a MicroTCA® Carrier Hub (MCH) can comprise at least two, for instance four, electrical connectors 100 supported by a respective substrate (see FIGS. 13A-13B). However when the industry standard MicroTCA® PF footprint is utilized with existing electrical connectors that are constructed to mount to the industry standard MicroTCA® PF footprint, peak bandwidth or data transmission rates are typically restricted to about 8 Gigabits/sec or less.

SUMMARY

In accordance with one embodiment, a card edge electrical connector includes a connector housing. The card edge electrical connector further includes a plurality of electrical signal contacts supported by the connector housing. Each electrical signal contact includes a contact body that defines a mating end and a mounting end, wherein respective pairs of the plurality of electrical signal contacts define differential signal pairs. The card edge electrical connector further includes a plurality of ground plates supported by the connector housing. Each of the plurality of ground plates includes a first ground mating end that defines a first ground flow return path and a second ground mating end that defines a second ground flow return path. At least one ground plate of the plurality of ground plates defining respective first and second ground flow return paths that are substantially symmetrical with respect to one another. The mating ends of the plurality of electrical signal contacts and the first and second ground mating ends of the plurality of ground plates collectively define one hundred seventy mating ends that are spaced along two rows that extend along a row direction. The one hundred seventy mating ends defining a 0.75 mm column pitch, and the connector housing supports each of the plurality of electrical signal contacts and the plurality of ground plates such that respective pairs of differential signal pairs are disposed between successive ground plates.

In accordance with another embodiment, an electrical connector includes a connector housing. The electrical connector further includes a first vertical electrical signal contact configured to be supported by the connector housing. The first vertical electrical signal contact includes a first contact body that defines a first mounting end and a first mating end that is opposite the first mounting end. The first mounting end carries a first mounting element configured to be placed in electrical connection with a printed circuit board, and the first vertical electrical signal contact defines first and second broadsides and first and second edges that extend between the first and second broadsides. The electrical connector further includes a second vertical electrical signal contact configured to be supported by the connector housing. The second vertical electrical signal contact includes a second contact body that defines a second mounting end and a second mating end that is opposite the second mounting end. The second mounting end carries a second mounting element configured to be placed in electrical connection with the printed circuit board, and the second vertical electrical signal contact defining first and second broadsides and first and second edges that extend between the first and second broadsides, wherein the first mating end and the second mating end are spaced from each other along a first direction that is substantially perpendicular to the first and second broadsides of the first and second vertical electrical signal contacts. Each of the first and second contact bodies is twisted such that the broadsides at the first mounting end is angularly offset with respect to the broadsides at the first mating end, the broadsides at the second mounting end is angularly offset with respect to the broadsides at the second mating end, and the first mounting element is aligned with the second mounting element along a second direction that is substantially perpendicular to the first direction.

In accordance with another embodiment, a printed circuit board includes a substrate body that defines opposed upper and lower surfaces. The substrate body supports a plurality of vias that define a footprint configured to receive mounting tails of only a single connector. The footprint includes a first pair of signal vias that extend into the upper surface of the substrate body. Each of the first pair of signal vias are arranged inline with respect to each other along a first column that extends substantially along a column direction. The footprint further includes a second pair of signal vias that extend into the upper surface of the substrate body. Each of the second pair of signal vias are arranged inline with respect to each other along a second column that extends substantially along the column direction. The footprint further includes at least a first ground via that extends into the upper surface of the substrate body. The first ground via is disposed in a third column that extends substantially along the column direction, wherein the third column includes no more than a pair of first ground vias. The footprint further includes at least a second ground via that extends into the upper surface of the substrate body. The second ground via is disposed in a fourth column that extends substantially along the column direction, wherein the fourth column includes no more than a pair of second ground vias. The first and second columns are disposed between the third and fourth columns.

In accordance with another embodiment, a method of fabricating an electrical connector includes the step of supporting a plurality electrical signal contacts in a connector housing. The signal contacts define signal mounting tails and mating ends, wherein respective pairs of the plurality of electrical signal contacts define differential signal pairs. The method further includes the step of supporting first and second ground plates in the connector housing. Each of the plurality of first and second ground plates includes ground mounting tails and ground mating ends. The two supporting steps include defining one hundred seventy matting ends that are spaced along two columns that each extend along a row direction collectively from the mating ends of the plurality of electrical signal contacts ground mating ends. The one hundred seventy mating ends define a 0.75 mm column pitch. The method further includes the step of positioning the plurality of electrical signal contacts and the ground plates in the connector housing such that the signal and ground mounting tails define a footprint that differs from a footprint defined by vias of a printed circuit board that are arranged in accordance with MicroTCA specification Rev. 1.0, such that the electrical signal contacts are configured to transfer data between the mounting tails and the mating ends at a minimum of approximately 12.5 Gigabits/second at an acceptable level of near-end crosstalk.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION

Figure 1:
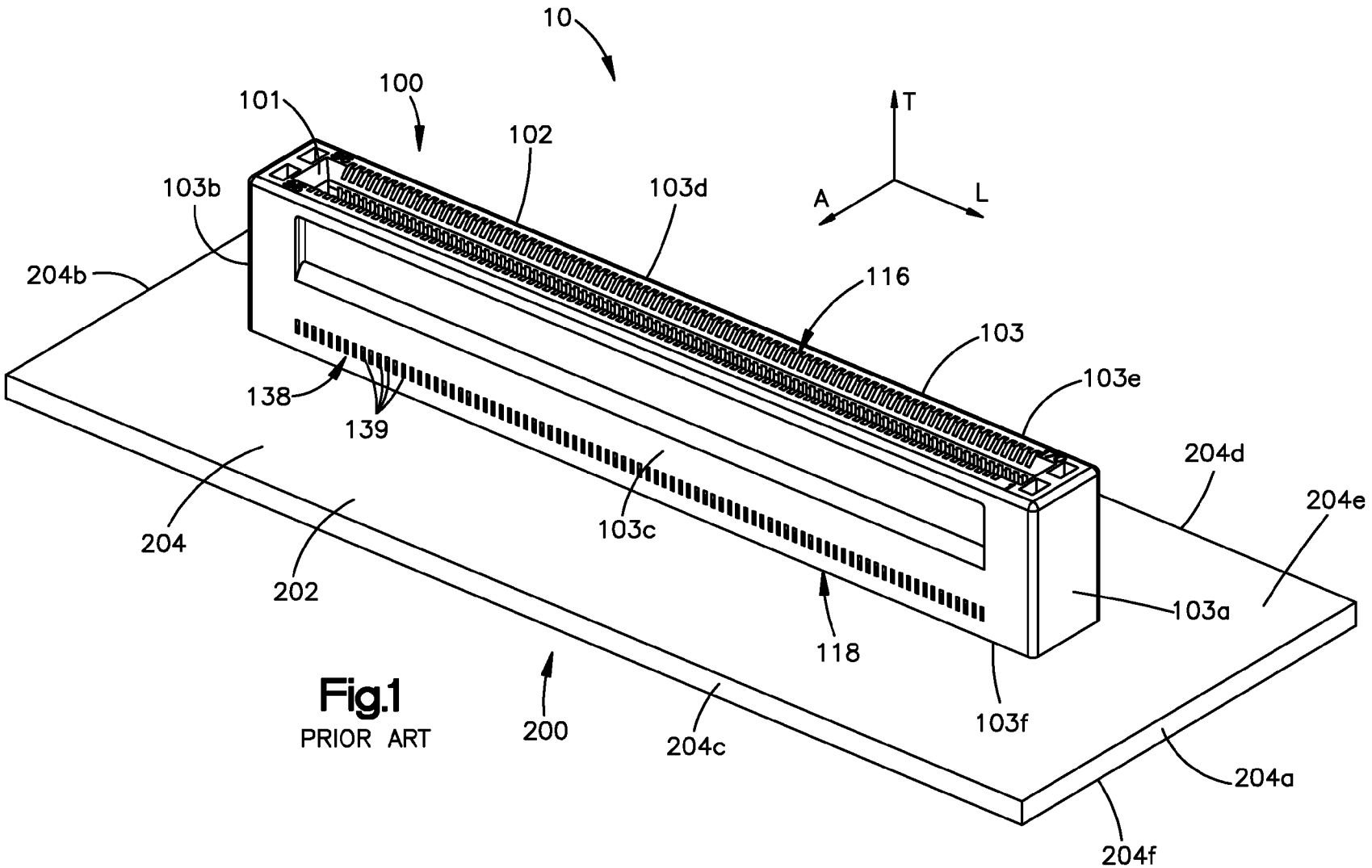
Fig.1 PRIOR ART
FIG. 1 is a perspective view of an electrical assembly including a printed circuit board and an electrical connector mounted to the printed circuit board so as to place respective pluralities of electrical signal contacts and ground plates supported by the electrical connector in electrical communication with the printed circuit board.

The present disclosure describes electrical connectors, such as card edge connectors and card edge connector footprints, including MicroTCA® (μTCA®) compatible connectors and footprints that can be utilized in accordance with industry standards specifications such as the Peripheral Component Interconnect (PCI) Industrial Computer Manufacturers Group (PICMG®) Open Modular Computing Specifications, for example MicroTCA.0, Rev. 1.0, 6 Jul. 2006, which is incorporated herein by reference in its entirety.

Referring initially to FIGS. 1 to 4D, an example electrical assembly 10 constructed in accordance with existing MicroTCA® standards includes an electrical connector 100 and a substrate 200, such as a printed circuit board 202, that is configured to be placed in electrical communication with the electrical connector 100. The electrical connector 100 can include dielectric or electrically insulative connector housing 102 and a plurality of electrical contacts 105 that are supported by the connector housing 102. The connector housing 102 includes a housing body 103 that defines opposed first and second sides 103*c* and 103*d* that are spaced from each other along a first or lateral direction A, a first end 103*a* that can define a front end, a second end 103*b* that can define a rear end and that is spaced from the first end 103*a* along a second or longitudinal direction L that extends substantially perpendicular to the lateral direction A, and opposed upper and lower ends 103*e* and 103*f* that are spaced from each other along a third or transverse direction T that extends substantially perpendicular to both the lateral direction A and the longitudinal direction L.

The connector housing 102 can define a centerline CR3 that extends along the longitudinal direction L and separates the housing body 103 into first and second portions that are spaced along the lateral direction A. For instance, the centerline CR3 can bifurcate the housing body 103, such that the first and second portions are substantially symmetric about the centerline CR3. The connector housing 102 can be constructed of any suitable dielectric or insulative material as desired, for instance plastic. It should be appreciated for the purposes of illustration that the electrical connector 100 is oriented such that the longitudinal direction L and the lateral direction A are oriented horizontally, and the transverse direction T is oriented vertically, though it should be appreciated that the orientation of the electrical connector 100 can vary during use.

The connector housing 102 can define a mating interface 116 proximate to, such as substantially at, the upper end 103*e* that is configured to mate with a complementary electrical component, such as an edge card. In accordance with the illustrated embodiment, the housing body 103 defines a slot 101 that is elongate along the longitudinal direction L and that extends into the upper end 103*e* along the transverse direction T, the slot 101 configured to at least partially receive a complementary electrical component, such as an edge card, that is mated to the electrical connector 100. Thus, the connector housing 102 can be constructed as an edge card connector housing and thus the electrical connector 100 as a card edge electrical connector. The mating interface 116 can be defined in the slot 101. The connector housing 102 can further define a mounting interface 118 proximate to, such as substantially at, the lower end 103*f* that is configured to mount onto a complementary electrical component, such as the printed circuit board 202, thereby placing the printed circuit board 202 and the complementary electrical component in electrical communication during operation. In accordance with the illustrated embodiment, the mating interface 116 is oriented substantially parallel to the mounting interface 118. Thus, the electrical connector 100 can be configured as a vertical electrical connector. However it should be appreciated that the electrical connector 100 can alternatively be configured as a right-angle electrical connector, whereby the mating interface 116 is oriented substantially perpendicular to the mounting interface 118.

The connector housing 102 can have at least one such as a plurality of retention members 138 defined by the housing body 103 and configured to retain the plurality of electrical contacts 105 in inserted positions in the connector housing 102. For example, in accordance with the illustrated embodiment, the housing body 103 defines respective pluralities of retention slots 139 that are spaced along the longitudinal direction and extend into such as through the first and second sides 103*c* and 103*d* of the housing body 103, respectively. The housing body 103 can further define a void 141 configured to receive the plurality of electrical contacts 105. In accordance with the illustrated embodiment, the first and second ends 103*a* and 103*b*, and the first and second sides 103*c* and 103*d*, define an outer circumference of the void 141, such that the void 141 extends upward into the lower end 103*f* of the housing body 103 along the transverse direction T.

The connector housing 102 can further include at least one guidance member 144 such as a pair of guidance members 144. Each guidance member 144 can be configured to interface with a complementary guidance member supported by the substrate 200, for instance the printed circuit board 202, so as to ensure proper alignment of the plurality of electrical contacts 105 with respect to the printed circuit board 202 during mounting of the electrical connector 100 to the printed circuit board 202. At least one such as both of the guidance members 144 can further be configured as retention members that act to retain the electrical connector 100 in a mounted position relative to the printed circuit board 202. In accordance with the illustrated embodiment, the housing body 103 includes a pair of substantially cylindrically shaped posts 146 that extend downward with respect to the connector housing 102 along the transverse direction T. The posts 146 are disposed on opposite ends of the housing body 103, proximate the first and second ends 103*a* and 103*b*, respectively. In accordance with the illustrated embodiment the posts 146 can be integral, such as monolithic, with the housing body 103, and thus extend out from the housing body 103. Alternatively, the posts 146 can be separate and can be attached to the housing body 103. It should be appreciated that the electrical connector 100 is not limited to the illustrated guidance members 144, and that the connector housing 102 can be alternatively constructed with any other suitable guidance members as desired.

Figure 2A:
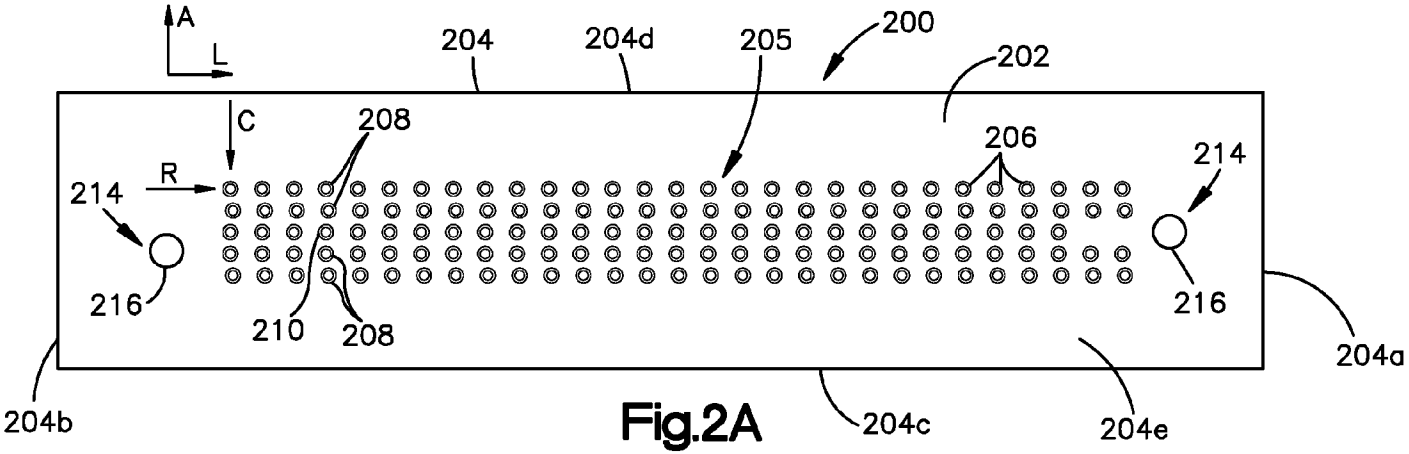
Fig.2A PRIOR ART
FIG. 2A is a top elevation view of the printed circuit board illustrated in FIG. 1, the printed circuit board including a plurality of vias that extend into the printed circuit board.
Figure 2B:
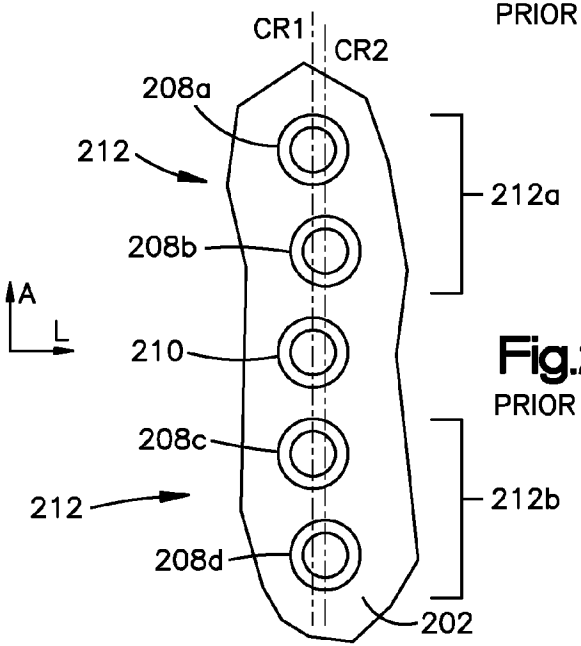
Fig.2B PRIOR ART
FIG. 2B is a top elevation view of a portion of the plurality of vias illustrated in FIG. 2A, the portion of the plurality of vias arranged in accordance with an industry standard MicroTCA® press fit footprint.

Referring now to FIGS. 1 and 2A-2B, the substrate 200, such as the printed circuit board 202, can include a substrate body 204 that defines a first end 204*a* that can define a front end, a second end 204*b* that can define a rear end that is spaced from the first end 204*a* along the longitudinal direction L. The substrate body 204 can further define a first side 204*c* and a second side 204*d* that is spaced from the first side 204*c* along the lateral direction A. The substrate body 204 can further define an upper surface 204*e* and a lower surface 204*f* that is spaced from the upper surface 204*e* along the transverse direction T. The printed circuit board 202 can further include at least one such as a plurality of electrically conductive elements 205 that can be supported by the printed circuit board 202, for instance by the substrate body 204. The electrically conductive elements 205 can be electrically connected to electrically conductive traces that are routed through the substrate body 204 or along one or more surfaces of the substrate body 204, such as along one or both of the upper and lower surfaces 204*e* and 204*f* thereof, in any combination as desired.

In accordance with illustrated embodiment, the printed circuit board 202 includes a plurality of electrically conductive elements 205 in the form of a plurality of vias 206 that can be configured as plated through holes that extend into such as through the substrate body 204 along the transverse direction T, for instance into the upper surface 204*e*. Each of the plurality of vias 206 can be configured to receive a complementary portion of a respective one of the plurality of electrical contacts 105, thereby placing the plurality of electrical contacts 105 in electrical communication with the printed circuit board 202. The plurality of vias 206 can include at least one or both of electrical (for instance electrically conductive) signal vias 208 or electrical (for instance electrically conductive) ground vias 210, in any combination as desired.

The plurality of vias 206 can be disposed along the substrate body 204 in accordance with any suitable arrangement, such that the plurality of vias 206 define a footprint configured to receive a corresponding arrangement of the plurality of electrical contacts 105 of the electrical connector 100. For example, in accordance with the illustrated embodiment, the plurality of vias 206 can include respective pluralities of electrical signal vias 208 and electrical ground vias 210 arranged in accordance with the industry standard MicroTCA® press fit footprint.

In accordance with the industry standard MicroTCA® press fit footprint, the vias 206 are arranged along the substrate body 204 in rows of vias 206 that extend along a row direction R that can be, for instance, the longitudinal direction L and in columns of vias 206 that extend along a column direction C that can be, for instance, the lateral direction A. Thus, it should be appreciated that each of the columns are spaced from each other along the row direction R at the mating and mounting interfaces 216 and 218. It should be further appreciated that the electrical connector 100 can define a column pitch measured as a distance between adjacent columns along the row direction R, for instance from the center of the respective mating or mounting ends of the electrical contacts 105 of a first column to a center of the respective mating or mounting ends of the electrical contacts 105 of a second column that is adjacent the first column along the row direction R. Each column can include a single electrical ground via 210 and four electrical signal vias 208. The electrical ground via 210 and each of the electrical signal vias 208 can be substantially equally spaced from each other along the column direction. The electrical signal vias 208 in each column can be grouped into pairs 212 of electrical signal vias 208, including a first pair 212*a* and a second pair 212*b*. The first pair 212*a* of electrical signal vias 208 can include an upper or first electrical signal via 208*a* and a lower or second electrical signal via 208*b*. Similarly, the second pair 212*b* of electrical signal vias 208 can include an upper or first electrical signal via 208*c* and a lower or second electrical signal via 208*d*. The electrical ground via 210 can be disposed between the first and second pairs 212*a* and 212*b* of electrical signal vias 208, that is between the second electrical signal via 208*b* of the first pair 212*a* and the first electrical signal via 208*c* of the second pair 212*b*.

The first electrical signal via 208*a* of the first pair 212*a*, the electrical ground via 210, and the first electrical signal via 208*c* of the second pair 212*b* are disposed along a first centerline CR1 that extends substantially parallel to the lateral direction A. The second electrical signal via 208*b* of the first pair 212*a* and the second electrical signal via 208*d* of the second pair 212*b* are disposed along a second centerline CR2 that extends substantially parallel to the first centerline CR1 and is offset from the first centerline CR1 along the lateral direction A. This column arrangement can be repeated along the substrate body 204, with the columns C spaced apart from one another along the row direction. For example, in accordance with the illustrated embodiment, the substrate body 204 can have twenty seven columns C of vias 206 arranged in accordance with the industry standard MicroTCA® press fit footprint. It should be appreciated that the printed circuit board 202 is not limited to the illustrated electrically conductive elements 205, and that the printed circuit board 202 can be alternatively constructed with any other suitable electrically conductive elements as desired. For instance, in accordance with an alternative embodiment of the printed circuit board 202, at least one such as a plurality of electrical contact pads can be substituted for respective ones such as each of the vias 206.

The printed circuit board 202 can further include at least one guidance member 214 such as a pair of guidance members 214. Each guidance member 214 can be configured to interface with a complementary guidance member 144 supported by the connector housing 102, so as to ensure proper alignment of the plurality of electrical contacts 105 and corresponding ones of plurality of vias 206 during mounting of the electrical connector 100 to the printed circuit board 202. At least one such as both of the guidance members 214 can further be configured as retention members that act to retain the electrical connector 100 in a mounted position relative to the printed circuit board 202. In accordance with the illustrated embodiment, the printed circuit board 202 includes a pair of guidance members 214 in the form of a pair of apertures 216 that extend into, such as through, the substrate body 204 along the transverse direction T, the apertures configured to receive respective ones of the posts 146 supported by the connector housing 102. The apertures 216 can be configured to receive the posts 146 in press-fit engagement, such that the posts 146 and apertures 216 act as retention members to retain the electrical connector in a mounted position with respect to the printed circuit board 202. The apertures 216 can be offset along the lateral direction A relative to each other, so as to ensure that the electrical connector 100 must be properly oriented relative to the printed circuit board 202 before the electrical connector can be mounted to the printed circuit board 202.

Referring now to FIGS. 3A-3D, the plurality of electrical contacts 105 can include at least one or both of at least one electrical signal contact 104 or at least one electrical ground contact that can be defined by an electrically conductive ground plate 106. In accordance with the illustrated embodiment, the electrical connector 100 includes respective pluralities of electrical signal contacts 104 and ground plates 106, the respective pluralities of electrical signal contacts 104 and ground plates 106 configured to be supported by the connector housing 102. The connector housing 102 can be configured to support the respective pluralities of electrical signal contacts 104 and ground plates 106. The electrical signal contacts 104 and the ground plates 106 of the respective pluralities can be constructed of any suitable electrically conductive material as desired, for instance metal. Each electrical signal contact 104 includes a contact body 107 that defines a mounting end 108 that can define a first region of the contact body 107, a mating end 112 that can define a second region of the contact body 107, the mating end 112 opposite the mounting end 108 and spaced from the mounting end 108 along transverse direction T, and an intermediate region 109 that extends between the mounting end 108 and mating end 112, for instance along the transverse direction T, such that the mating end 108 and the mounting end 112 are spaced from each other along the third direction. The mating end 112 of each electrical signal contact 104 can be substantially aligned with the respective mounting end 108 along the third direction, such that the electrical signal contact is a vertical electrical signal contact. Each of the plurality of electrical signal contacts 104 can be supported by the connector housing 102, such that the mounting end 108 is disposed proximate the mounting interface 118 and the mating end 112 is disposed proximate the mating interface 116.

The contact body 107 of each electrical signal contact 104 can define respective first and second ones of opposed broadsides 126 that are spaced apart from one another along the longitudinal direction and respective first and second ones of opposed edges 128 that are spaced apart from one another along the lateral direction A. In accordance with the illustrated embodiment, each of the first and second ones of the broadsides 126 has a first length along the lateral direction A from the first one of the edges 128 to the second one of the edges 128, and each of the first and second ones of the edges 128 has a second length that extends along the longitudinal direction L from a first one of the broadsides 126 to a second one of the broadsides 126, wherein the first length is greater than the second length.

The plurality of electrical signal contacts 104 can include at least one pair 113 such as a plurality of pairs 113 of electrical signal contacts 104. For example, the connector housing 102 can be configured to support at least one pair 113 such as a first pair 113*a* and a second pair 113*b* of electrical signal contacts 104. At least one or both of the first and second pairs 113*a* and 113*b* of electrical signal contacts 104 can include a first electrical signal contact 104 and a second electrical signal contact 104 that are disposed on opposed sides of the centerline CR3 of the connector housing 102. In accordance with the illustrated embodiment, the connector housing 102 can support a first row R1 of electrical signal contacts 104 that are disposed on a first side of the centerline CR3, and a second row R2 of electrical signal contacts 104 that disposed on an opposed second side of the centerline CR3, such that the first and second rows R1 and R2 of electrical signal contacts 104 are spaced from each other along the column direction C. The first row R1 of electrical signal contacts 104 is supported by the connector housing 102 such that the first row R1 is disposed closer to the second side 103*d* than the first side 103*c* of the housing body 103, and the second row R2 of electrical signal contacts 104 is supported by the connector housing 102 such that the second row R2 is disposed closer to the first side 103*c* than the second side 103*d* of the housing body 103.

At least a portion of the first electrical signal contacts of the first and second pairs 113*a* and 113*b*, for instance mating ends 112 of the first electrical signal contacts of the first and second pairs 113*a* and 113*b*, can be spaced from each other along the longitudinal direction L, and thus spaced from each other along a direction that is substantially perpendicular to the first and second broadsides 126 of each of the first electrical signal contacts of the first and second pairs 113*a* and 113*b*. Similarly, at least a portion of the second electrical signal contacts of the first and second pairs, for instance the mating ends 112 of the second electrical signal contacts of the first and second pairs 113*a* and 113*b*, can be spaced from each other along the longitudinal direction L, and thus spaced from each other along a direction that is substantially perpendicular to the first and second broadsides 126 of each of the second electrical signal contacts of the first and second pairs 113*a* and 113*b*. Furthermore, at least a portion up to all of the first and second electrical signal contacts of each of the first and second pairs 113*a* and 113*b*, including the mounting ends 108 and the mating ends 112, can be spaced from each other along the lateral direction A.

For instance, the first pair 113*a* of electrical signal contacts 104 includes a first electrical signal contact 104*a* and a second electrical signal contact 104*b*. Similarly, the second pair 113*b* of electrical signal contacts 104 includes a first electrical signal contact 104*c* (which can define a third electrical signal contact) and a second electrical signal contact 104*d* (which can define a fourth electrical signal contact). In accordance with the illustrated embodiment, the first electrical signal contacts 104*a* and 104*c* are disposed on a first side of the centerline CR3 of the connector housing 102, and the second electrical signal contacts 104*b* and 104*d* are disposed on a second side of the centerline CR3 that is opposite the first side. Further in accordance with the illustrated embodiment, the mating ends 112 of the first and second electrical signal contacts 104*a* and 104*c* are spaced from each other along the longitudinal direction L in accordance with the illustrated embodiment. Furthermore, both the mounting end 108 and the mating end 112 of the first electrical signal contact 104*a* of the first pair 113*a* are spaced from the corresponding mounting end 108 and mating end 112 of the second electrical signal contacts 104*b* of the first pair 113*a* along the lateral direction A. Similarly, both the mounting end 108 and the mating end 112 of the first electrical signal contact 104*c* of the second pair 113*b* are spaced from the corresponding mounting end 108 and mating end 112 of the second electrical signal contact 104*d* of the second pair 113*b* along the lateral direction A.

Each pair 113 of electrical signal contacts 104 can include a first electrical signal contact 104 that is disposed in the first row R1 of electrical signal contacts 104 and a second electrical signal contact 104 that is disposed in the second row R2 of electrical signal contacts 104. For example, in accordance with the illustrated embodiment, the first electrical signal contacts 104*a* and 104*c* of the first and second pairs 113*a* and 113*b*, respectively, are disposed in the second row R2 of electrical signal contacts 104, and the second electrical signal contacts 104*b* and 104*d* of the first and second pairs 113*a* and 113*b*, respectively, are disposed in the first row R1 of electrical signal contacts 104.

In accordance with illustrated embodiment, the ground plates 106 can define first and second ground plates 106*a* and 106*b* that are successive along the longitudinal direction L, such that no other ground plate 106 is disposed between the first and second ground plates 106*a* and 106*b* along the longitudinal direction L. The plurality of electrical contacts 105 are supported by connector housing 102 such that the first and second pairs 113*a* and 113*b* of electrical signal contacts 104 are disposed between the first and second ground plates 106*a* and 106*b*, respectively, along the longitudinal direction L. For example, at least a portion up to all of the electrical signal contacts 104 of the first and second pairs 113*a* and 113*b* of electrical signal contacts 104 can be disposed between the first and second ground plates 106*a* and 106*b*, respectively, when the first and second pairs 113*a* and 113*b* and the first and second successive ground plates 106*a* and 106*b* are supported by the connector housing 102. In this regard, the first pair 113*a* of electrical signal contacts 104 is disposed adjacent the first ground plate 106*a* (and thus closer to the first ground plate 106*a* than the second ground plate 106*b*, for instance along the longitudinal direction L) and the second pair 113*b* of electrical signal contacts 104 is disposed adjacent the second ground plate 106*b* (and thus closer to the second ground plate 106*b* than the first ground plate 106*a*, for instance along the longitudinal direction L). It should be appreciated that the first and second pairs 113*a* and 113*b* and the first and second ground plates 106*a* and 106*b* can define a pattern of a ground (for instance defined by one of the first and second ground plates 106*a* and 106*b*), a first pair 113*a*, and a second pair 113*b* along the longitudinal direction L, such that the pattern can be repeated along the longitudinal direction in the connector housing 102. Accordingly, the connector housing 102 can support each of the plurality of electrical signal contacts 104 and the plurality of ground plates 106 such that only two pairs 113 of electrical signal contacts 104 are disposed between successive ground plates 106 of the plurality of ground plates 106.

The electrical signal contacts 104 of each pair 113 can be aligned along the lateral direction A when supported by the connector housing 102, such that the electrical signal contacts 104 face each other along the lateral direction A. For example, the broadsides of the first and second electrical signal contacts of each pair 113 can be substantially coplanar with respect to one another in a plane defined by the longitudinal direction L and the lateral direction A. For instance, the broadsides of the first and second electrical signal contacts 104*a* and 104*b* of the first pair 113*a* can be substantially coplanar with respect to one another in a plane defined by the longitudinal direction L and the lateral direction A, and the broadsides of the first and second electrical signal contacts 104*c* and 104*d* of the second pair 113*b* can be substantially coplanar with respect to one another in a plane defined by the longitudinal direction L and the lateral direction A The electrical signal contacts 104 can be constructed such that the respective mating ends 112 of the electrical signal contacts on each side of the longitudinal centerline CR3 are substantially aligned with one another along the longitudinal direction L. Furthermore, respective pairs 113 electrical signal contacts 104 disposed adjacent one another between respective first and second ground plates 106 can be constructed such that the respective mounting ends 108 are jogged toward each other along the longitudinal direction L and jogged away from each other along the lateral direction A. For example, in accordance with the illustrated embodiment, the mounting end 108 of a first electrical signal contact 104*a* of the first pair 113*a* is jogged forward along the longitudinal direction L toward the first end 103*a* of the housing body 103 and inward along the lateral direction A toward the longitudinal centerline CR3, and the mounting end 108 of a first electrical signal contact 104*c* of the second pair 113*b* is jogged rearward along the longitudinal direction L toward the second end 103*b* of the housing body 103 and outward along the lateral direction A away from the longitudinal centerline CR3. The mounting end 108 of a second electrical signal contact 104*b* of the first pair 113*a* is jogged forward along the longitudinal direction L toward the first end 103*a* of the housing body 103 and outward along the lateral direction A away from the longitudinal centerline CR3, and the mounting end 108 of a second electrical signal contact 104*d* of the second pair 113*b* is jogged rearward along the longitudinal direction L toward the second end 103*b* of the housing body 103 and inward along the lateral direction A toward the longitudinal centerline CR3. Furthermore, in accordance with the illustrated embodiment, the first electrical signal contact 104*a* of the first pair 113*a* is constructed substantially identically to the second electrical signal contact 104*d* of the second pair 113*b* and the second electrical signal contact 104*b* of the first pair 113*a* is constructed substantially identically to the first electrical signal contact 104*c* of the second pair 113*b*.

The contact bodies 107 electrical signal contacts 104 can be constructed as resilient contact beams that extend between the mounting ends 108 and the mating ends 112. At least a portion of the contact body 107 of each electrical signal contact 104, for instance proximate the mating end 112, can be curved inward along the lateral direction A so as to define a contact region 115, the contact region 115 configured to engage with at least one electrical contact of a complementary electrical component, for example an edge card, that is mated to the electrical connector 100. The respective contact regions 115 of each pair 113 of electrical signal contacts 104 can be curved inward along the lateral direction A toward each other so as to define a narrowed portion between the opposed resilient contact beams of the pair 113 at the respective contact regions 115. Furthermore, the contact region 115 of each electrical signal contact 104 is defined substantially at the mating interface 116. Thus, the electrical connector 100 can be configured as a receptacle connector configured to receive a complementary electrical component at the mating interface 116 so as to mate the electrical connector 100 to the complementary electrical component. It should be appreciated, however, that the electrical connector 100 can alternatively be configured as a plug connector that is configured to be received by the complementary electrical component at the mating interface 116 so as to mate the electrical connector 100 to the complementary electrical component. It should be appreciated that the electrical connector 100 is not limited to the illustrated contact body geometry, and that the electrical signal contacts 104 can be alternatively constructed using any other suitable contact body geometry as desired.

The mounting end 108 of at least one such as each of the electrical signal contacts 104 can include a mounting element such as a tail 111 that extends out from the mounting end 108, for example downward along the transverse direction T. The tail 111 can be integral, such as monolithic, with the contact body 107. In this regard, it can be said that the tail 111 extends out from the mounting end 108. Alternatively, the tail 111 can be separate and can be attached to the mounting end 108. In accordance with the illustrated embodiment, the tail 111 can be constructed as a press-fit tail, for instance an eye of the needle tail configured to be inserted into a corresponding electrical signal via 208 such that a press fit engagement is created between the tail 111 and the respective electrical signal via 208 upon insertion. It should be appreciated that the electrical signal contacts 104 of the electrical connector 100 are not limited to the illustrated tails 111, and that the mounting ends 108 of the electrical signal contacts 104 can be constructed with any other mounting element geometry as desired.

The plurality of electrical signal contacts 104 can be arranged in broadside-coupled differential signal pairs 117. For example, in accordance with the illustrated embodiment, the first electrical signal contact 104*a* of the first pair 113*a* of electrical signal contacts 104 and the first electrical signal contact 104*c* of the second pair 113*b* of electrical signal contacts 104 define a first differential signal pair 117*a*, and the second electrical signal contact 104*b* of the first pair 113*a* of electrical signal contacts 104 and the second electrical signal contact 104*d* of the second pair 113*b* of electrical signal contacts 104 define a second differential signal pair 117*b*.

In accordance with the illustrated embodiment, the first differential signal pair 117*a* is defined in the second row R2 of electrical signal contacts 104, and the second differential signal pair 117*b* is defined in the first row R1 of electrical signal contacts 104. Further in accordance with the illustrated embodiment, the first row R1 of electrical signal contacts 104 can define a first plurality of differential signal pairs 117 of the electrical connector 100, and the second row R1 of electrical signal contacts 104 can define a second plurality of differential signal pairs 117 of the electrical connector 100 that is spaced from the first plurality of differential signal pairs 117 along the column direction C.

Respective pairs of differential signal pairs 117 that are disposed opposite one another in the first and second rows R1 and R2, respectively, for instance the first and second differential signal pairs 117*a* and 117*b*, and are disposed between successive ground plates 106, for instance the first and second ground plates 106*a* and 106*b*, can be spaced along the longitudinal direction L from successive pairs of differential signal pairs 117 that are disposed opposite one another in the first and second rows R1 and R2 and are disposed between respective successive ground plates 106, such that no other differential signal pairs 117 are disposed between successive pairs of differential signal pairs 117 that are disposed opposite one another in the first and second rows R1 and R2 along the longitudinal direction L. In this regard, the connector housing 102 can support each of the plurality of electrical signal contacts 104 and the plurality of ground plates 106 such that only two differential signal pairs 117 are disposed between successive ground plates 106. For example, in accordance with the illustrated embodiment, only the first and second pairs 117*a* and 117*b* of differential signal pairs 117 are disposed between the first and second ground plates 106*a* and 106*b*. It should be appreciated that the electrical connector 100 is not limited to the illustrated broadside-coupled differential signal pairs, and that the plurality of electrical signal contacts 104 can alternatively be configured as desired, for example as edge-coupled differential signal pairs.

With continued reference to FIGS. 3A-3D, each ground plate 106 of the plurality of ground plates 106 includes a plate body 120 that defines opposed upper and lower ends 120*a* and 120*b* that are spaced apart from one another along the transverse direction T, opposed first and second sides 120*c* and 120*d* that are spaced apart from one another along the lateral direction A, and opposed first and second outer plate body surfaces 120*e* and 120*f* that are spaced apart from one another along the longitudinal direction L so as to define a plate body thickness PT. In accordance with the illustrated embodiment, the first and second outer plate body surfaces 120*e* and 120*f* can extend along respective first and second planes defined by the longitudinal direction L and the lateral direction A, so as to define the plate body thickness PT. The plate body thickness PT can be referred to as a material thickness pertaining to a respective thickness of the material of which the plate body 120 is constructed. The plate body 120 can define any suitable shape as desired, for example a substantially rectangular shape such that the plate body 120 is elongate between the first and second sides 120*c* and 120*d*.

Each ground plate 106, can further include at least one mounting end 110 and at least one mating end 114 such as a pair of mating ends 114 that can define ground mating ends, the at least one mounting end 110 opposite the at least one mating end 114 and spaced from the at least one mating end 114 along the transverse direction T. For example, in accordance with the illustrated embodiment, each ground plate 106 can include at least one mounting end 110 that is disposed proximate the lower end 120*b*, and a pair of mating ends 114 that extend out from the plate body 120, for example upward with respect to the upper end 120*a*. Each of the plurality of ground plates 106 can be supported by the connector housing 102, such that the at least one mounting end 110 is disposed proximate the mounting interface 118 and the at least one mating end 114 is disposed proximate the mating interface 116.

The pair of mating ends 114 of each ground plate 106 can include a first mating end 114*a* and a second mating end 114*b*. In accordance with the illustrated embodiment, the first and second mating ends 114*a* and 114*b* can be constructed as resilient contact beams that extend out from the plate body 120, upward along the transverse direction T, and are spaced from one another along the lateral direction A. In this regard, the first and second mating ends 114*a* and 114*b* can be referred to as free mating ends that are cantilevered with respect to the plate body 120. In accordance with the illustrated embodiment, the first and second mating ends 114*a* and 114*b* can be integral, such as monolithic, with the plate body 120. Alternatively, the first and second mating ends 114*a* and 114*b* can be separate and can be attached to the plate body 120.

Each ground plate 106 can be constructed such that the first and second mating ends 114*a* and 114*b* are disposed on the first and second sides of the longitudinal centerline CR3, respectively, and are substantially aligned with the corresponding mating ends 112 of the plurality of electrical signal contacts 104 along the longitudinal direction L. The first and second mating ends 114*a* and 114*b* can be constructed substantially similarly to the corresponding regions of the contact bodies 107 of the plurality of electrical signal contacts 104. For example, each of the first and second mating ends 114*a* and 114*b* of the ground plates 106 can define respective pairs of opposed broadsides 125 and opposed edges 127 that are substantially identical to the respective first and second opposed broadsides 126 and first and second opposed edges 128 of each of the plurality of electrical signal contacts 104.

Furthermore, at least a portion of each of the first and second mating ends 114*a* and 114*b* can be curved inward along the lateral direction A so as to define respective contact regions 119, the contact regions 119 configured to engage with at least one electrical contact of a complementary electrical component, for example an edge card, that is mated to the electrical connector 100. In accordance with the illustrated embodiment, the respective contact regions 119 of each of the first and second mating ends 114*a* and 114*b* define a narrowed portion between the opposed resilient contact beams of the first and second mating ends 114*a* and 114*b* at the respective contact regions 119. Furthermore, the respective contact regions 119 of the first and second mating ends 114*a* and 114*b* are defined substantially at the mating interface 116.

It should be further appreciated that the electrical connector 100 illustrated in FIGS. 3A-4D can define a plurality of mating ends 95 that include collectively the mating ends 112 of the electrical signal contacts 104 and the mating ends 114 of the ground plates 106. The electrical connector 100 is constructed as a card edge electrical connector 100 that defines one hundred seventy mating ends 95, such that the mating ends 95 define a column pitch of approximately 0.75 mm. Thus, the mating ends 95 can be said to be constructed in accordance with the existing MicroTCA® standard, such that the electrical connector 100 is mating compatible with complementary electrical components constructed in accordance with the MicroTCA® standard. In accordance with the illustrated embodiment, the mating ends 95 of the electrical contacts 105 collectively define eighty-five columns and two rows that extend along the row direction R and can be, for instance, the first and second rows R1 and R2. Additionally, because the ground plates 106 can be mounted onto a printed circuit board 202 configured in accordance with the industry standard MicroTCA® PF footprint, the illustrated electrical connector 100 can be said to be footprint compatible with the MicroTCA® standard.

In accordance with the illustrated embodiment, the respective contact regions 119 of the first and second mating ends 114*a* and 114*b* of each ground plate 106 are located a first distance from the upper end 103*e* of the connector housing 102 that is substantially equal to a second distance that the respective contact regions 115 of the plurality of electrical signal contacts 104 are located from the upper end 103*e*, such that when a complementary electrical component is mated to an assembled electrical connector 100, complementary electrical contacts of the complementary electrical component engage substantially simultaneously with the respective contact regions 119 and 115. It should be appreciated that at least one such as each of the plurality of electrical signal contacts 104 or at least one such as each of the plurality of ground plates 106 can be alternatively constructed with the first distance not substantially equal to the second distance, such that as the complementary electrical component is mated to the electrical connector 100 the electrical contacts of the complementary electrical component engage the respective contact regions 119 before the respective contact regions 115, engage the respective contact regions 115 before the respective contact regions 119, or engage the respective contact regions 119 and 115 in any order as desired. It should be appreciated that the ground plate 106 is not limited to the illustrated mating ends 114, and that the ground plate 106 can alternatively be constructed with any other suitable mating end geometry as desired.

At least one ground plate 106 such as each of the plurality of ground plates 106 can further include a tab 122 that extends out from the plate body 120. The tab 122 can have a tab body 123 that defines a proximal end 123*a* that is disposed at a respective location along the first outer plate body surface 120*e*, a distal end 123*b* that is spaced from the proximal end 123*a* along the longitudinal direction L, opposed first and second side surfaces 123*c* and 123*d* that are spaced from one another along the lateral direction A and can define opposed first and second outer tab surfaces that are spaced so as to define a tab thickness, and opposed upper and lower surfaces 123*e* and 123*f* that are spaced from one another along the transverse direction T. In accordance with the illustrated embodiment, the first and second outer tab surfaces can extend along respective third and fourth planes defined by the longitudinal direction L and the transverse direction T. Further in accordance with the illustrated embodiment, the tab thickness is substantially equal to the plate body thickness PT, the tab thickness is defined along the lateral direction A and the plate body thickness PT is defined along the longitudinal direction L. Thus, the tab thickness can be defined along a direction that is angularly offset with respect to a direction in which the plate body thickness PT is defined, and can be defined along a direction that is substantially perpendicular with respect to a direction in which the plate body thickness PT is defined. The proximal end 123*a* of the tab body 123 can be disposed at any desired location along the first outer plate body surface 120*e*. In this regard, the tab 122 can extend out from the plate body 120 at any location along the first outer plate body surface 120*e*. For example, in accordance with the illustrated embodiment, the tab 122 extends out from the plate body 120 at a location that is substantially equidistant between the first and second sides 120*c* and 120*d* along the first direction, and extends out from the plate body 120 substantially at the lower end 120*b*.

The tab body 123 is oriented such that the first and second side surfaces 123*c* and 123*d* are substantially parallel to one another and substantially coplanar with a plane defined by the longitudinal direction L and the transverse direction T, and such that the upper and lower surfaces 123*e* and 123*f* are substantially parallel to one another and substantially coplanar with a plane defined by the longitudinal direction L and the lateral direction A. Thus, in accordance with the illustrated embodiment, the first and second side surfaces 123*c* and 123*d* are substantially perpendicular with respect to the first and second outer plate body surfaces 120*e* and 120*f* of the plate body 120 and are substantially perpendicular with respect to the upper surface 204*e* of the printed circuit board 202 when the electrical connector 100 is mounted to the printed circuit board 202. Furthermore, the upper and lower surfaces 123*e* and 123*f* are substantially perpendicular with respect to the first and second outer plate body surfaces 120*e* and 120*f* of the plate body 120 and are substantially parallel with respect to the upper surface 204*e* of the printed circuit board 202 when the electrical connector 100 is mounted to the printed circuit board 202. It should be appreciated that the tab body 123 can be alternatively oriented as desired.

In accordance with the illustrated embodiment, the upper and lower surfaces 123*e* and 123*f* of the tab body 123 are spaced along the third direction and define a tab height TH of the tab 122, and the first and second side surfaces 123*c* and 123*d* are spaced along the first direction and define a tab width TW of the tab 122. Further in accordance with the illustrated embodiment, the tab width TW is substantially equal to the plate thickness PT of the plate body 120, and the tab height TH is greater than the tab width TW, and thus greater than the tab thickness.

The first and second side surfaces 123*c* and 123*d* can define respective first and second ones of opposed broadsides 129*a* of the tab 122 and the upper and lower surfaces 123*e* and 123*f* can define respective first and second ones of opposed edges 129*b* of the tab 122. Thus, in accordance with the illustrated embodiment, the first and second ones of the broadsides 129*a* of the tab 122 are substantially perpendicular with respect to the upper surface 204*e* of the printed circuit board 202 when the electrical connector 100 is mounted to the printed circuit board 202, and the first and second ones of the edges 129*b* of the tab 122 are substantially parallel with respect to the upper surface 204*e* of the printed circuit board 202 when the electrical connector 100 is mounted to the printed circuit board 202. Furthermore, each of the first and second ones of the broadsides 129*a* has a first length along the transverse direction T from the first one of the edges 129*b* to the second one of the edges 129*b*, and each edge 129*b* has a second length that extends along the lateral direction A from a first one of the broadsides 129*a* to a second one of the broadsides 129*a*, wherein the first length is greater than the second length.

In accordance with the illustrated embodiment, the tab 122 can be integral, such as monolithic, with the plate body 120. Alternatively, the tab 122 can be separate and can be attached to the plate body 120. In accordance with the illustrated embodiment, the tab 122 can be defined by removing sections of material from the plate body 120, for example by making at least one cut 124 such as a plurality of cuts 124 in the plate body 120. The cuts 124 can comprise a first cut 124*a* that extends upward into the lower end 120*b* of the plate body 120 along the transverse direction T to a location between the upper and lower ends 120*a* and 120*b*, for example along a distance from the lower end 120*b* equal to the tab height TH. The first cut 124*a* can be made at a location between the first and second sides 120*c* and 120*d* so as to define the distal end 123*b* of the tab body 123. The cuts 124 can further comprise a second cut 124*b* that extends along the lateral direction A from an upper end of the first cut 124*a* to a desired location of the proximal end 123*a* of the tab body 123. The second cut 124*b* can define the upper surface 123*e* of the tab body 123. After the first and second cuts 124*a* and 124*b* have been made, the tab 122 can be bent out from the plate body 120 around a bend axis that extends along the transverse direction T and can be defined proximate the proximal end 123*a* of the tab body 123. The first and second cuts 124*a* and 124*b* can be located such that the tab 122 is located substantially equidistantly between the first and second sides 120*c* and 120*d* when the tab 122 is bent out from the plate body 120. It should be appreciated that the ground plate 106 is not limited to the illustrated tab geometry, and that the tab 122 can be alternatively constructed as desired.

The plate body 120 of at least one ground plate 106 such as each of the plurality of ground plates 106 can further include at least one retention member 138 supported by the plate body 120 and configured to interface with a complementary retention member of the connector housing 102 so as to retain the ground plate 106 in an inserted position in the connector housing 102. For example, in accordance with the illustrated embodiment, the plate body 120 includes a pair of retention members 138 constructed as generally triangular shaped wings 140 that extend out along the lateral direction A from the first and second sides 120*c* and 120*d* of the plate body 120, respectively. The wings 140 can be configured to be received in the retention slots 139 of the connector housing 102.

The at least one mounting end 110 of each ground plate 106 can be disposed proximate the lower end 120*b*. For example, the at least one mounting end 110 can extend from the tab 122, and thus can be said to extend out from the plate body 120, such as downward with respect to the plate body 120. In accordance with the illustrated embodiment, the at least one mounting end 110 extends downward from the lower surface 123*f* of the tab body 123 along the transverse direction T. Thus, the at least one mounting end 110 extends out from the lower end 120*b* of the plate body 120 and downward from the lower end 120*b* of the plate body 120. The at least one mounting end 110 can include a mounting element that can be configured as a press-fit mounting element such as a press-fit tail 111 that is downwardly elongate along the transverse direction T. The tail 111 can be integral, such as monolithic, with the tab body 123. In this regard, it can be said that the tail 111 extends out from the at least one mounting end 110. Alternatively, the tail 111 can be separate and can be attached to the at least one mounting end 110. In accordance with the illustrated embodiment, the tail 111 can be constructed as a press-fit tail, for instance an eye of the needle tail configured to be inserted into a corresponding ground via 210 such that a press fit engagement is created between the tail 111 and the respective ground via 210 upon insertion. It should be appreciated that the ground plate 106 is not limited to the illustrated tails 111, and that the at least one mounting end 110 of the ground plate 106 can be constructed with any other mounting element geometry as desired.

Figure 3A:
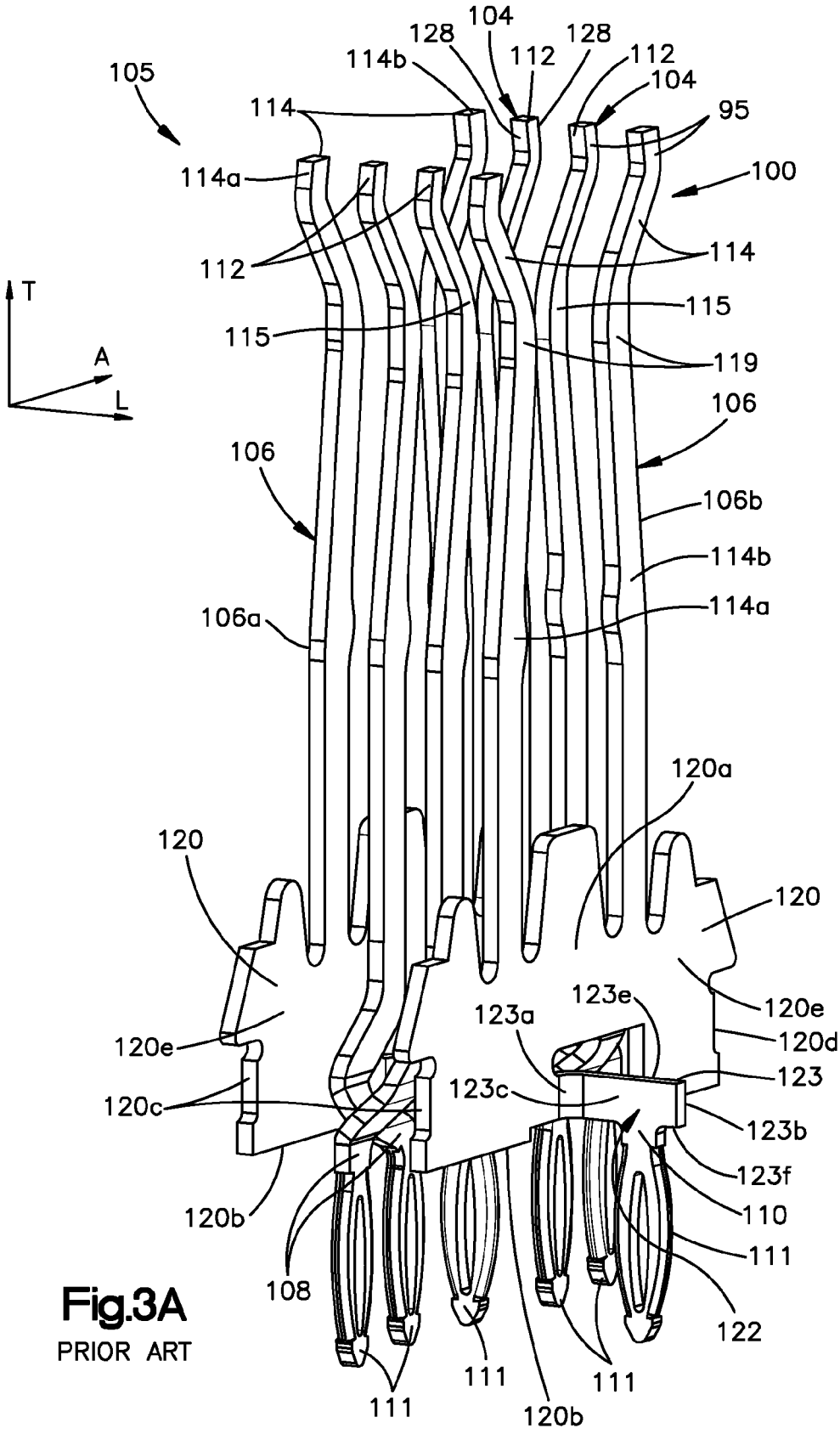
Fig.3A PRIOR ART
FIG. 3A is a perspective view of two pairs of electrical signal contacts and a pair of ground plates constructed in accordance with an embodiment, the electrical signal contacts and the ground plates configured to be supported by the electrical connector illustrated in FIG. 1.
Figure 3B:
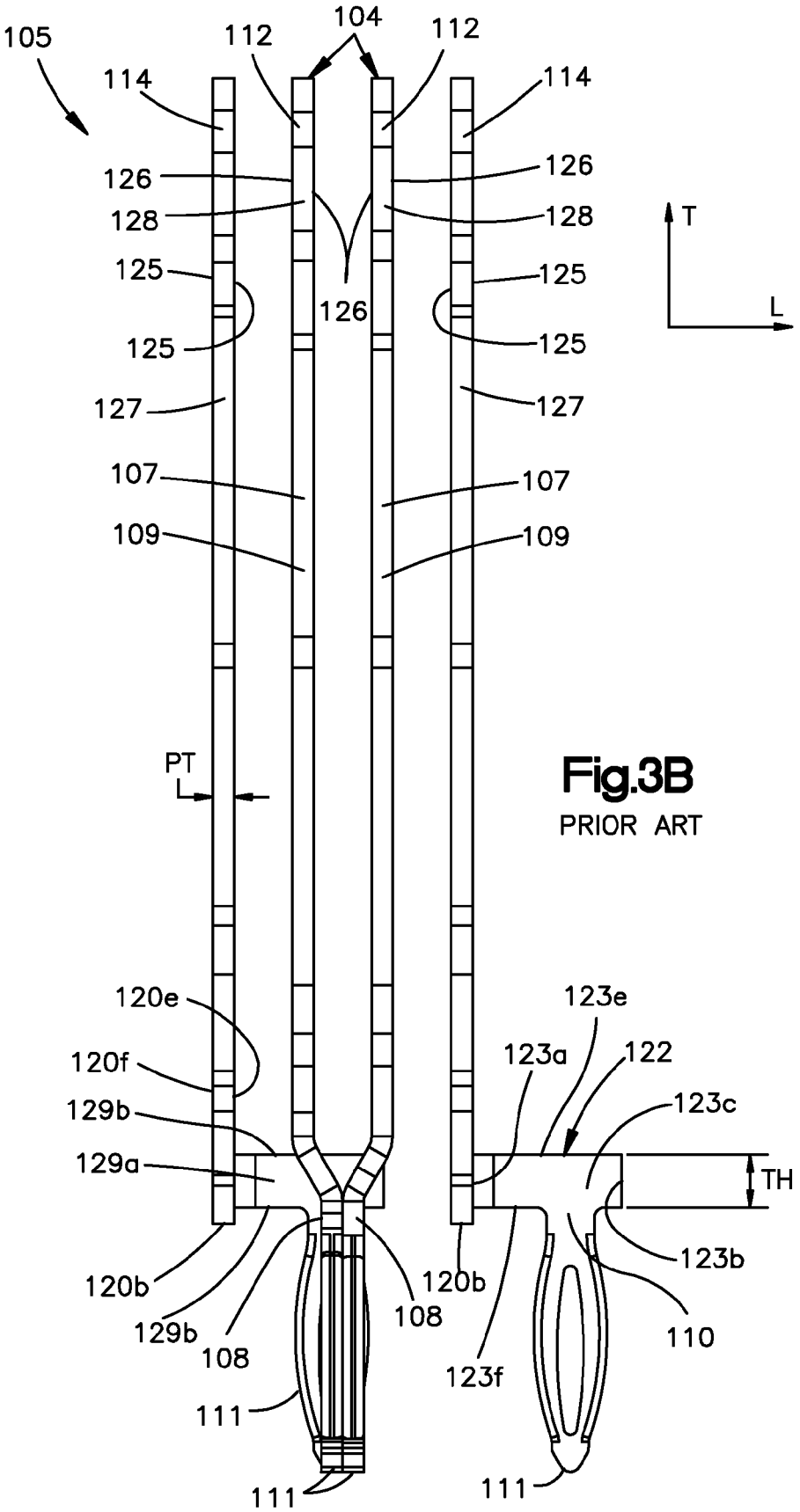
Fig.3B PRIOR ART
FIG. 3B is a side elevation view of the electrical signal contacts and ground plates illustrated in FIG. 3A.
Figure 3C:
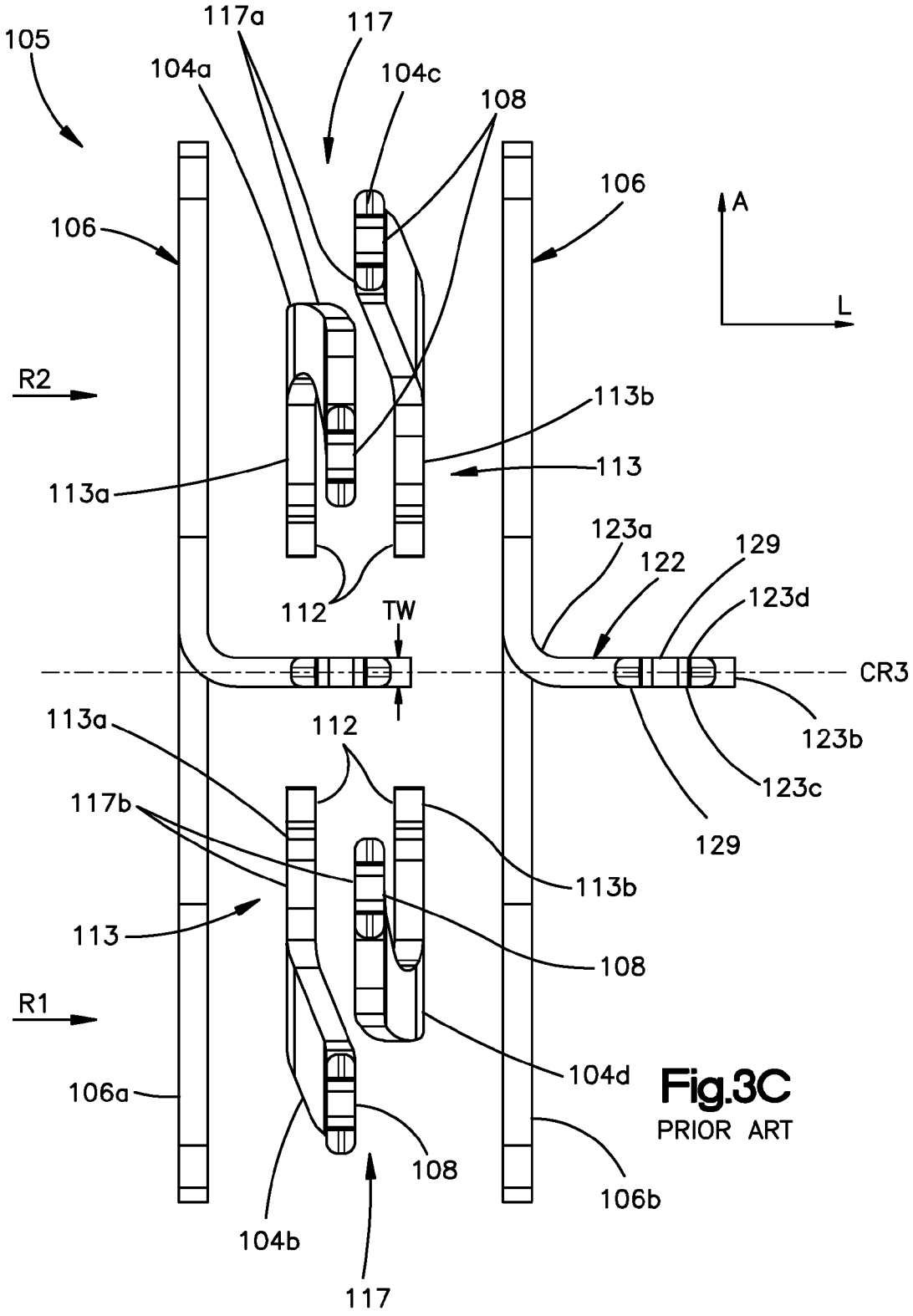
Fig.3C PRIOR ART
FIG. 3C is a bottom elevation view of the electrical signal contacts and ground plates illustrated in FIGS. 3A-3B.
Figure 3D:
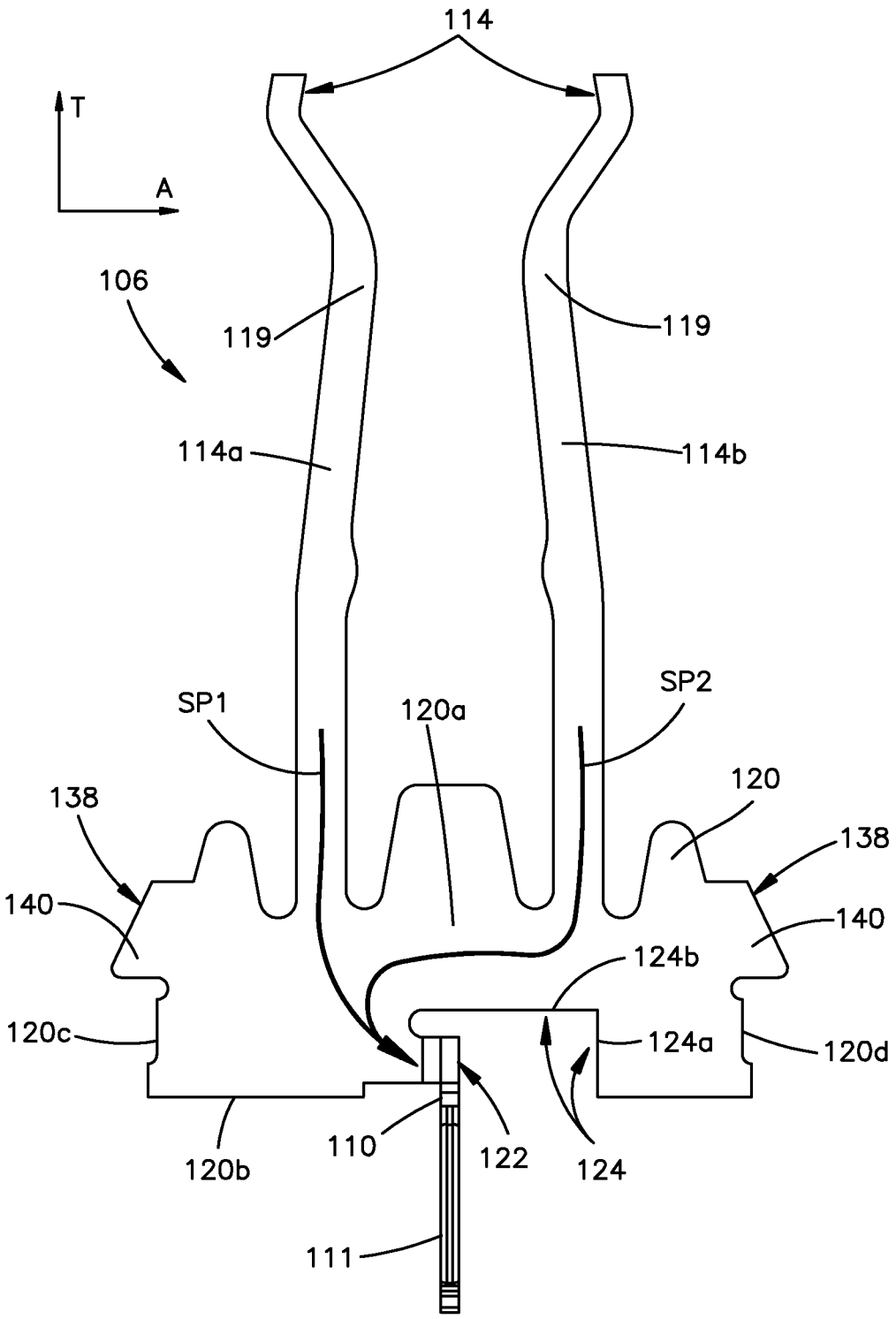
Fig.3D PRIOR ART
FIG. 3D is a front elevation view illustrating an example asymmetric ground return flow path of the ground plates illustrated in FIGS. 3A-3C.

Referring now to FIGS. 3A-3C, when a respective one of the plurality of ground plates 106 and corresponding first and second pairs 113*a* and 113*b* of electrical signal contacts 104 are supported by the connector housing 102, at least a portion of the tab 122, such as the distal end 123*b* of the tab body 123, can be disposed between the mounting ends 108 of the first and second pairs 113*a* and 113*b* of electrical signal contacts 104, respectively, such that the mounting ends 108 of the first and second pairs 113*a* and 113*b* of electrical signal contacts 104 and the mounting end 110 disposed on the tab 122 of the ground plate 106 are substantially aligned along the first direction and thus extend substantially parallel to the first and second outer plate body surfaces 120*e* and 120*f*. The electrical signal contacts 104 of each of the first and second pairs 113*a* and 113*b* of electrical signal contacts 104 are spaced apart along the first direction, and the respective mounting ends 108 of the first and second pairs 113*a* and 113*b* of electrical signal contacts 104 and the mounting end 110 of the ground plate 106 are spaced along the second direction when the first and second pairs 113*a* and 113*b* of electrical signal contacts 104 and the ground plate 106 are supported by the connector housing 102. Furthermore, the first direction extends substantially parallel to the first and second outer plate body surfaces 120*e* and 120*f* when the first and second pairs 113*a* and 113*b* of electrical signal contacts 104 and the ground plate 106 are supported by the connector housing 102. Furthermore, the second direction extends substantially parallel to the first and second outer tab surfaces when the first and second pairs 113*a* and 113*b* of electrical signal contacts 104 and the ground plate 106 are supported by the connector housing 102.

For example, in accordance with the illustrated embodiment, when the first ground plate 106*a* and the first and second pairs 113*a* and 113*b* of electrical signal contacts 104 are supported by the connector housing 102, the mounting end 110 that extends from the tab 122 is disposed between the respective mounting ends 108 of the first and second electrical signal contacts 104*a* and 104*b* of the first pair 113*a* and between the respective mounting ends 108 of the first and second electrical signal contacts 104*c* and 104*d* of the second pair 113*b*. Furthermore, the tail 111 of the mounting end 110 disposed on the tab 122 is oriented substantially perpendicular with respect to the tails 111 that extend from the respective mounting ends 108 of the first and second pairs 113*a* and 113*b* of electrical signal contacts 104. In accordance with the illustrated embodiment, when a respective one of the plurality of ground plates 106 and corresponding first and second pairs 113*a* and 113*b* of electrical signal contacts 104 are supported by the connector housing 102, the tails 111 that extend from the respective mounting ends 108 of the electrical signal contacts 104 and the tail 111 of the mounting end 110 are aligned with respect to each other along the first direction.

The illustrated arrangement of electrical contacts 105, including the first and second pairs 113*a* and 113*b* of electrical signal contacts 104 and the ground plate 106 can be mounted to the industry standard MicroTCA® press fit footprint. For example, in accordance with the illustrated embodiment, when the first and second pairs 113*a* and 113*b* of electrical signal contacts 104 and the ground plate 106 are supported by the connector housing 102, the tails 111 that extend out from the respective mounting ends 108 of the first and second pairs 113*a* and 113*b* of electrical signal contacts 104 can be inserted into corresponding ones of the first and second pairs 212*a* and 212*b* of electrical signal vias 208 of a first column of vias 206, and the tail 111 of the mounting end 110 of the ground plate 106 can be inserted into the electrical ground via 210 of the first column of vias 206.

Referring again to FIGS. 3A-3D, each ground plate 106 can define asymmetrical first and second ground return flow paths SP1 and SP2. For instance, the first mating end 114*a* can define the first ground flow return path SP1 from the first mating end 114*a* to the mounting end 110, and the second mating end 114*b* can define the second ground flow return path SP2 from the second mating end 314*b* to the mounting end 110. The first and second ground flow return paths SP1 and SP2 can define respect paths to ground for corresponding electrical signal contacts 104 disposed proximate the first and second mating ends 114*a* and 114*b*, respectively. For example, in accordance with the illustrated embodiment, electrical signal contacts 104 disposed proximate the first mating end 114*a*, such as the first electrical signal contacts 104*a* and 104*c* of the first and second pairs 113*a* and 113*b*, respectively, that define the first differential signal pair 117*a*, will follow the first ground return flow path SP1 to the mounting end 110, and electrical signal contacts 104 disposed proximate the second mating end 114*b*, such as the second electrical signal contacts 104*b* and 104*d* of the first and second pairs 113*a* and 113*b*, respectively, that define the second differential signal pair 117*b*, will follow the second ground return flow path SP2 to the mounting end 110. The first ground flow return path SP1 is shorter the second ground flow return path SP2, at least in part due to the geometry of the tab 122. Because the second ground flow return path SP2 adjacent to or near the second differential signal pair 117*b* is longer than the first ground flow return path SP1 adjacent to or near the first differential signal pair 117*a*, the first and second ground flow return paths SP1 and SP2 are asymmetrical, and the second differential signal pair 117*b* will exhibit higher inductance levels than the first differential signal pair 117*a*, thereby impacting performance of the electrical connector 100 constructed utilizing a plurality of the ground plates 106.

Figure 4A:
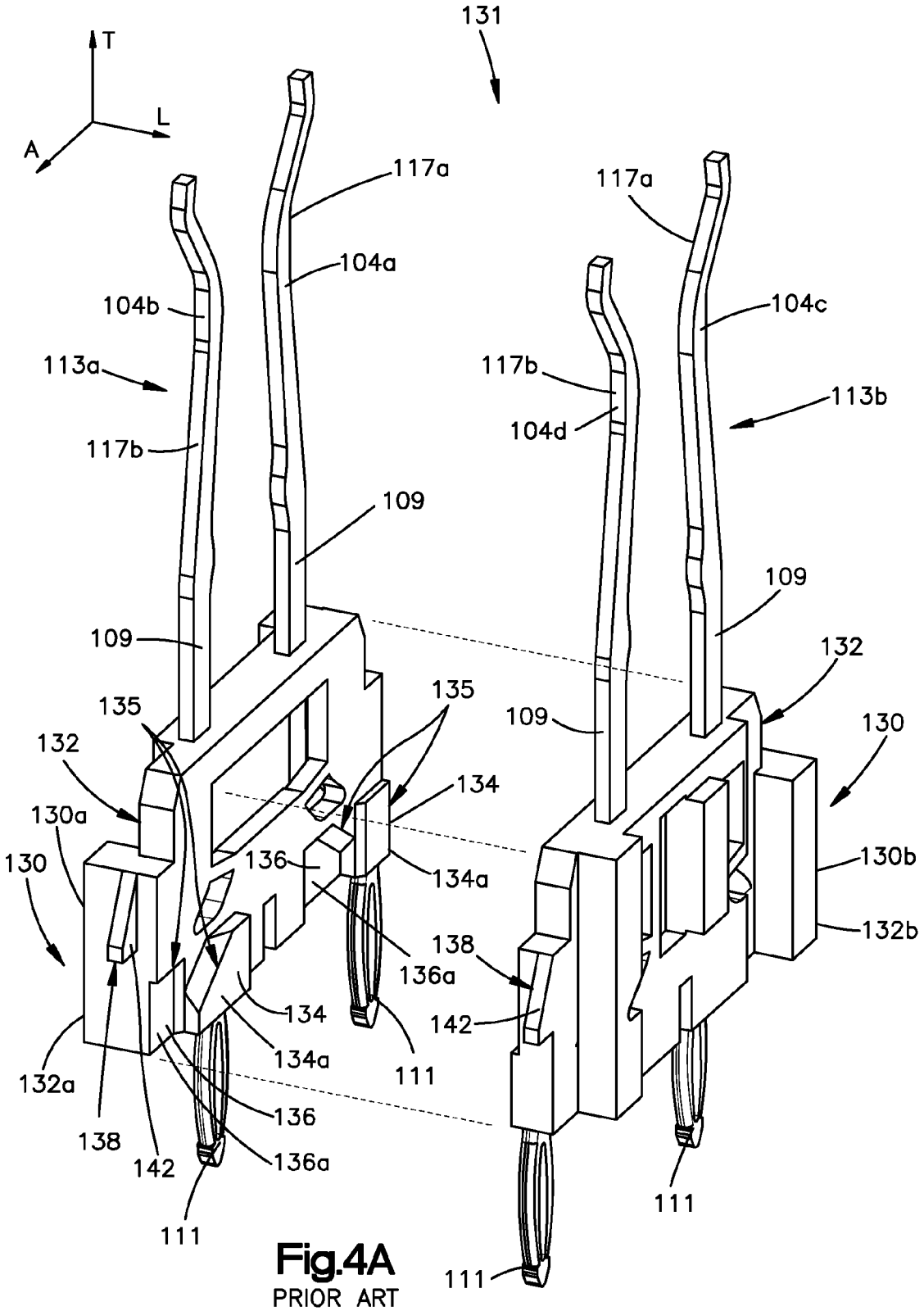
Fig.4A PRIOR ART
FIG. 4A is a perspective view of a pair of leadframe assemblies, each leadframe assembly comprising a pair of the electrical signal contacts illustrated in FIGS. 3A-3C, the pair of leadframe assemblies configured to be inserted into the electrical connector illustrated in FIG. 1.
Figure 4B:
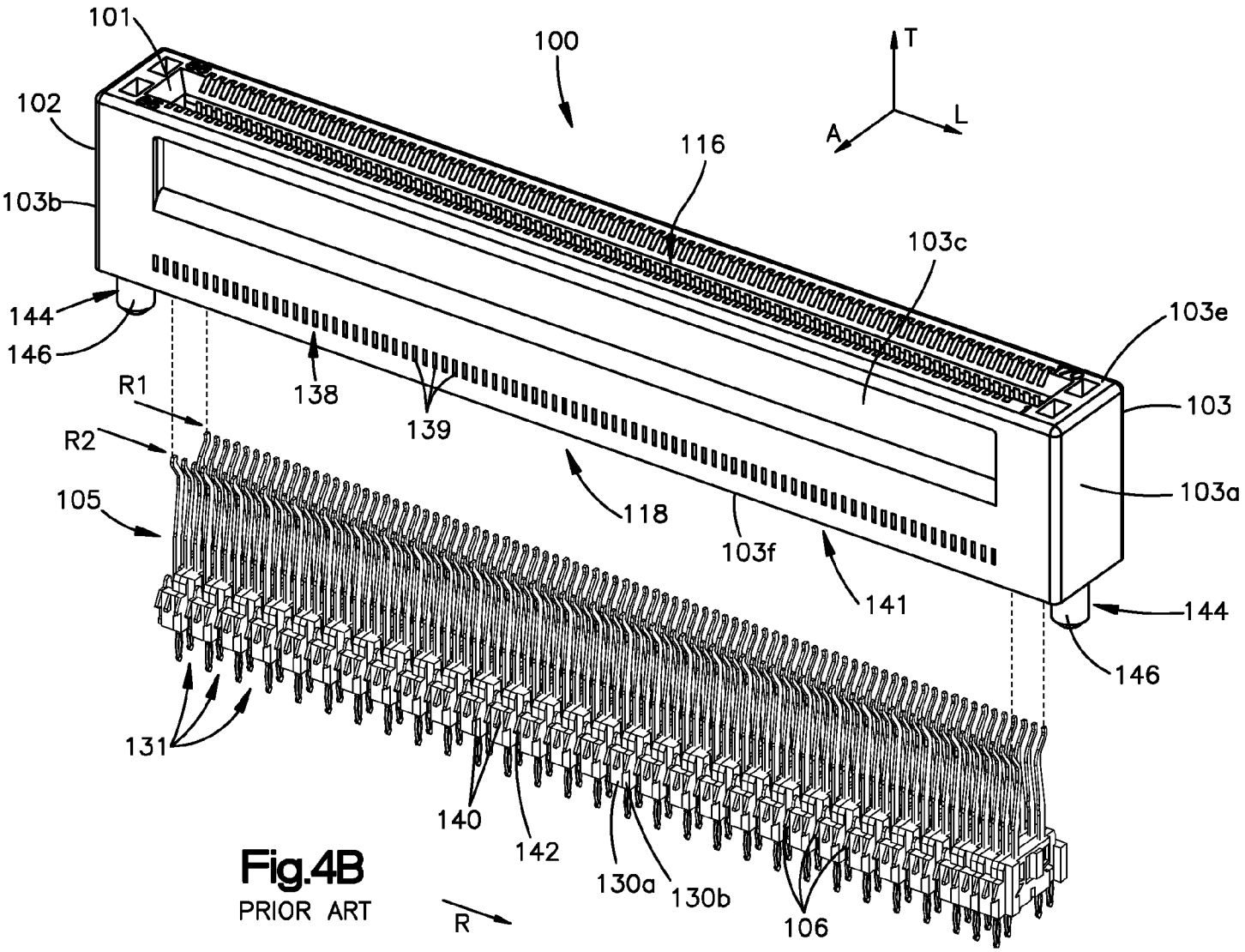
Fig.4B PRIOR ART
FIG. 4B is a perspective view of the electrical connector illustrated in FIG. 1, a plurality of respective pairs of the leadframe assemblies illustrated in FIG. 4A, and a plurality of the ground plates illustrated in FIGS. 3A-3D, the respective pluralities of pairs of leadframe assemblies and ground plates arranged adjacent one another so as to be inserted into the electrical connector.
Figures 4C, 4D:
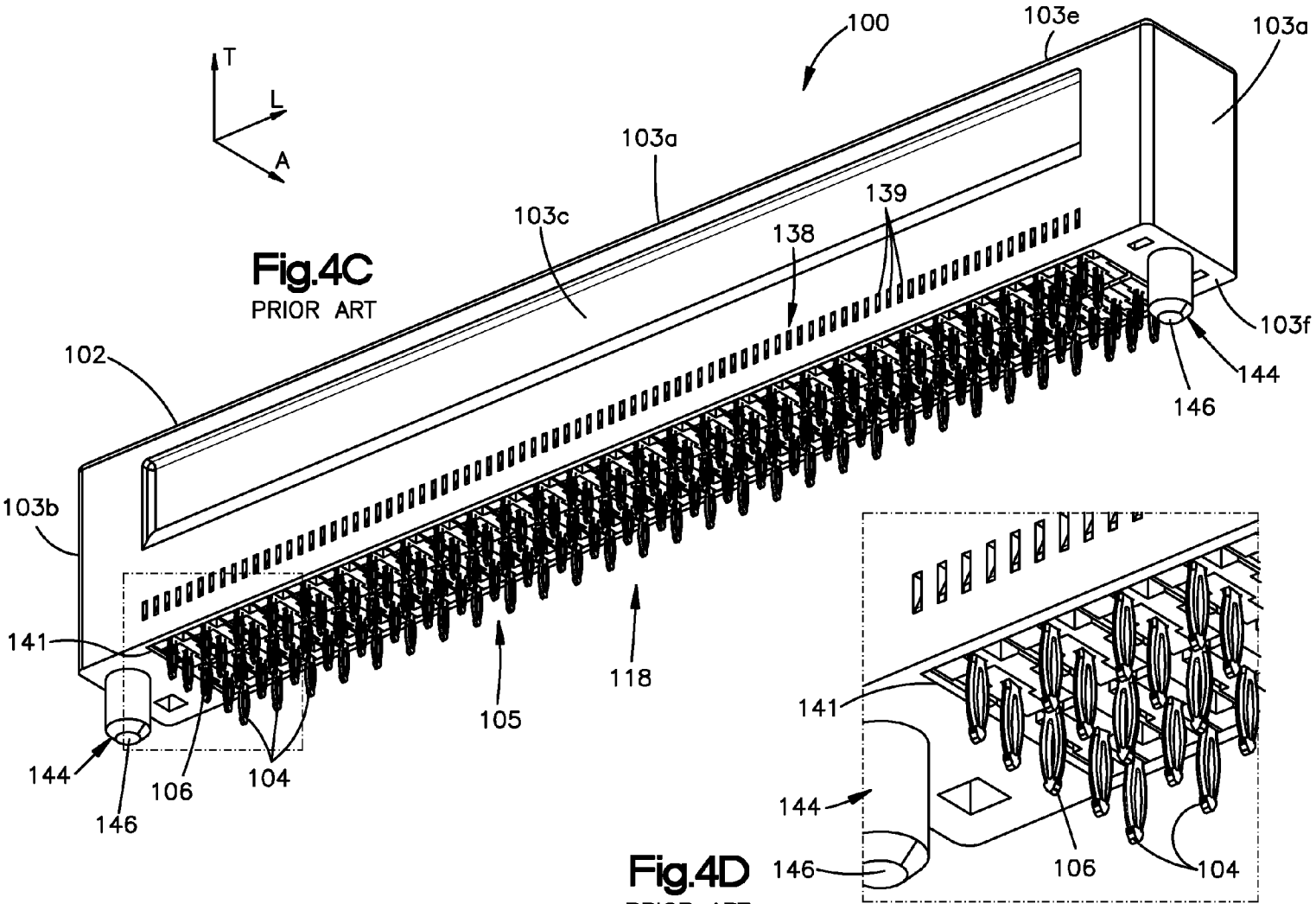
Fig.4C PRIOR ART
Fig.4D PRIOR ART
FIG. 4C is a perspective view of the electrical connector, leadframe assemblies, and ground plates illustrated in FIG. 4A, with the leadframe assemblies and the ground plates inserted into the electrical connector.
FIG. 4D is a zoomed perspective view of a portion of the electrical connector illustrated in FIG. 4C.

Referring now to FIGS. 4A-4C, the illustrated electrical connector 100 can include at least one, such as a plurality of leadframe assemblies 130 configured to be supported by the connector housing 102. Each leadframe assembly 130 can include a dielectric or electrically insulative leadframe housing 132 and at least one such as a plurality of electrical contacts 105 that can be configured as electrical signal contacts 104 that are supported by the leadframe housing 132. In accordance with the illustrated embodiment, each leadframe assembly 130 includes a pair of electrical signal contacts 104 that are spaced apart from one another along the column direction C. The leadframe assemblies 130 can be configured as insert molded leadframe assemblies (IMLAs) whereby the respective leadframe housings 132 are overmolded onto respective ones of the plurality of electrical signal contacts 104. For instance, the leadframe housing 132 of each leadframe assembly 130 can be overmolded onto the corresponding electrical signal contacts 104 such that the leadframe housing 132 is overmolded onto, and thus encloses, at least a portion of the contact body 107, for instance the intermediate region 109, of each of the respective electrical signal contacts 104 supported by the leadframe housing 132. Alternatively, the respective ones of the electrical signal contacts 104 can be stitched into the leadframe housings 132 or otherwise supported by the respective leadframe housings 132.

A plurality up to all of the leadframe assemblies 130 can include at least one pair 131 such as a plurality of pairs 131 of first and second leadframe assemblies 130*a* and 130*b*, respectively. The first and second leadframe assemblies 130*a* and 130*b* of each pair 131 can be constructed substantially identically. The first leadframe assembly 130*a* and the second leadframe assembly 130*b* of each pair 131 can be disposed adjacent each other, for instance along the row direction R, when supported by the connector housing 102, so as to define the first and second differential signal pairs 117*a* and 117*b*. For example, in accordance with the illustrated embodiment, the first leadframe assembly 130*a* can have a first leadframe housing 132*a* that is overmolded onto the first pair 113*a* of electrical signal contacts 104 and the second leadframe assembly 130*b* can have a second leadframe housing 132*b* that is overmolded onto the second pair 113*b* of electrical signal contacts 104. Accordingly, the first electrical signal contact 104*a* of the first leadframe assembly 130*a* and the first electrical signal contact 104*c* of the second leadframe assembly 130*b* can define the first differential signal pair 117*a*, and the second electrical signal contact 104*b* of the first leadframe assembly 130*a* and the second electrical signal contact 104*d* of the second leadframe assembly 130*b* can define the second differential signal pair 117*b*.

The first and second leadframe assemblies 130*a* and 130*b* of each pair 131 can be configured to interface with one another when disposed adjacent to one another in the connector housing 102. For example, the leadframe housing 132 of each of the first and second leadframe assemblies 130*a* and 130*b*, respectively, of each pair 131 can include at least one interface member 135 that is configured to receive a complementary at least one interface member 135 supported by the leadframe housing 132 of the other of the first and second leadframe assemblies 130*a* and 130*b*, respectively, of the pair 131. Thus, the first leadframe housing 132*a* of the first leadframe assembly 130*a* can be at least partially received by the second leadframe housing 132*b* of the second leadframe assembly 130*b*, and the second leadframe housing 132*b* of the second leadframe assembly 130*b* can be at least partially received by the first leadframe housing 132*a* of the first leadframe assembly 130*a*. In accordance with the illustrated embodiment, the leadframe housing 132 of each leadframe assembly 130 includes respective pairs of interface members 135 configured as a pair of projecting portions 134 and a pair pocket portions 136, respectively. The projecting portions 134 of each pair can be constructed the same or differently, and the pocket portions 134 of each pair can be constructed the same or differently. In accordance with the illustrated embodiment, the first leadframe housing 132*a* of the first leadframe assembly 130*a* can include a pair of first projection portions 134*a* and a pair of first pocket portions 136*a*, and the second leadframe housing 132*b* of the second leadframe assembly 130*b* can include a pair of second projection portions (not shown) and a pair of second pocket portions (not shown). The pair of first projection portions 134*a* of the first leadframe housing 132*a* can be configured to be received in respective ones of the pair of second pocket portions of the second leadframe housing 132*b* and the pair of second projection portions of the second leadframe housing 132*b* can be configured to be received in the pair of first pocket portions 136*a* of the first leadframe housing 132*a*.

In accordance with the illustrated embodiment, when the first and second leadframe assemblies 130*a* and 130*b* of each pair 131 are supported by the connector housing 102, the first leadframe assembly 130*a* of each respective pair 131 can be oriented in a first orientation and the second leadframe assembly 130*b* of the corresponding pair 131 can be oriented in a second orientation relative to the first leadframe assembly 130*a* that is rotated 180 degrees about an axis that is substantially perpendicular to the first direction and substantially parallel to the transverse direction T. When the first and second leadframe assemblies 130*a* and 130*b* are oriented in the first and second orientations, respectively, and supported by the connector housing 102, the pair of first projection portions 134*a* of the first leadframe housing 132*a* can be at least partially received in respective ones of the pair of second pocket portions of the second leadframe housing 132*b* and the pair of second projection portions of the second leadframe housing 132*b* can be at least partially received in the pair of first pocket portions 136*a* of the first leadframe housing 132*a*.

Any suitable dielectric material, such as air or plastic, may be used to isolate the respective electrical signal contacts 104 of the first leadframe assembly 130*a* of a pair 131 from the respective electrical signal contacts 104 of the second leadframe assembly 130*b* of the pair 131. In accordance with the illustrated embodiment, the first and second leadframe assemblies 130*a* and 130*b* of each pair 131 abut each other when supported by the connector housing 102. However it should be appreciated that at least one or both of the first and second leadframe assemblies 130*a* and 130*b* or the connector housing 102 can be alternatively constructed such that the first and second leadframe assemblies 130*a* and 130*b* are spaced from each other when supported by the connector housing 102.

At least one such as both of the first and second leadframe assemblies 130*a* and 130*b* of each pair 131 can further include at least one retention member 138 supported by the respective first and second leadframe housings 132*a* and 132*b* and configured to interface with a complementary retention member of the connector housing 102 so as to retain the ground plate 106 in an inserted position in the connector housing 102. For example, in accordance with the illustrated embodiment, both the first and second leadframe housings 132*a* and 132*b* of each pair each include a pair of retention members 138 constructed as generally triangular shaped wings 142 that extend out along the lateral direction A from the first and second leadframe housings 132*a* and 132*b*. The wings 142 can be constructed substantially identically to the wings 140 of the plurality of ground plates 106 and thus can be configured to be received in the retention slots 139 of the connector housing 102.

Referring now to FIGS. 4B-4C, each pair 131 of leadframe assemblies 130 of the plurality of leadframe assemblies 130 can be supported by the connector housing 102 between respective ground plates 106. In this regard, the connector housing 102 supports successive first and second pairs 113*a* and 113*b* of electrical signal contacts 104 and ground plates 106 when the first and second pairs 113*a* and 113*b* of electrical signal contacts 104 and ground plates 106 are supported by the connector housing 102. The respective pluralities of leadframe assemblies 130 and ground plates 106 can be arranged such that a ground plate 106 is disposed between successive adjacent pairs 131 of first and second leadframe assemblies 130*a* and 130*b*, such that the plurality of electrical contacts 105 of the electrical connector 100 define a repeating ground-signal-signal (G-S-S) arrangement of ground plates 106 and electrical signal contacts 104 along the row direction R. The ground plates 106 can be disposed between adjacent pairs 131 of leadframe assemblies 130 along the row direction R such that the ground plates 106 can reduce crosstalk between adjacent differential signal pairs 117 of the adjacent pairs 131 of leadframe assemblies 130 that are aligned along the row direction R.

Referring now to FIGS. 5A-5D, a ground plate 306 that can be mounted onto a printed circuit board 202 configured in accordance with the industry standard MicroTCA® PF footprint is illustrated. In the interest of succinctness, elements of the ground plate 306 that are constructed substantially identically to corresponding elements of the industry standard MicroTCA® ground plate 106 are labeled with reference numbers that are incremented by 200. For example, the mating ends 314 of the ground plate 306 can be constructed substantially identically to the mating ends 114 of the ground plate 106, such that the mating ends 314 are disposed into respective positions that are substantially identical to the mating ends 114 of the ground plate 106 when the ground plate 306 is supported by the connector housing 102. In this regard, the ground plate 306 can be said to be mating compatible with complementary electrical components configured to be mated to the industry standard industry standard MicroTCA® electrical connector 100. The illustrated electrical signal contacts 104 can be constructed substantially identically to the industry standard MicroTCA® electrical signal contacts 104 described above and illustrated in FIGS. 3A-3E, and thus the reference numerals associated therewith are repeated in FIGS. 5A-5D.

In accordance with the illustrated embodiment, the electrical connector 100 can be constructed utilizing at least one such as a plurality of the ground plates 306. In this regard, at least one such as a plurality of ground plates 306 can be substituted for respective ones of the plurality of ground plates 106, and the plurality of ground plates 306 can be supported by the connector housing 102 adjacent to corresponding pairs 113 of electrical signal contacts 104. The electrical connector 100 can be constructed using respective pluralities of electrical signal contacts 104 and ground plates 306, supported by the connector housing 102. For example, the electrical connector 100 can be constructed using a repeating sequence of a ground plate 306, followed by corresponding first and second pairs 113*a* and 113*b* of electrical signal contacts 104 configured as respective differential signal pairs 117, followed by another ground plate 306, and so on. Accordingly, the connector housing 102 can support each of the plurality of electrical signal contacts 104 and the plurality of ground plates 306 such that only two differential signal pairs 117 are disposed between successive ground plates 306.

Using this repeating sequence, the electrical connector 100 can be constructed as a card edge electrical connector 100 that defines one hundred seventy mating ends 95 that can be collectively defined by the mating ends 112 of the electrical signal contacts 104 and the mating ends 114 of the ground plates 306, the mating ends 95 defining a column pitch of approximately 0.75 mm. Thus, the mating ends 95 can be said to be constructed in accordance with the existing MicroTCA® standard, such that the electrical connector 100 is mating compatible with complementary electrical components constructed in accordance with the MicroTCA® standard. Thus, in accordance with the illustrated embodiment, the mating ends of the electrical contacts 105 collectively define eighty-five columns and two rows. Additionally, because the ground plates 306 can be mounted onto a printed circuit board 202 configured in accordance with the industry standard MicroTCA® PF footprint, the illustrated electrical connector 100 can be said to be footprint compatible with the MicroTCA® standard.

In accordance with the illustrated embodiment, the ground plate 306 includes a tab 348 that is constructed differently than the tab 122 of the ground plate 106. The tab 348 extends out from the plate body 320. The tab 348 can have a tab body 349 that defines a proximal end 349*a* that is disposed at a respective location along the first outer plate body surface 320*e*, a distal end 349*b* that is spaced from the proximal end 349*a* along the longitudinal direction L, opposed first and second side surfaces 349*c* and 349*d* that are spaced from one another along the lateral direction A, and opposed upper and lower surfaces 349*e* and 349*f* that are spaced from one another along the transverse direction T and can define opposed first and second outer tab surfaces that are spaced so as to define a tab thickness. In accordance with the illustrated embodiment, the first and second outer tab surfaces can extend along respective third and fourth planes defined by the longitudinal direction L and the lateral direction A. Further in accordance with the illustrated embodiment, the tab thickness is substantially equal to the plate body thickness PT, the tab thickness is defined along the transverse direction A and the plate body thickness PT is defined along the longitudinal direction L. Thus, the tab thickness can be defined along a direction that is angularly offset with respect to a direction in which the plate body thickness PT is defined, and can be defined along a direction that is substantially perpendicular with respect to a direction in which the plate body thickness PT is defined. The proximal end 349*a* can be disposed at any desired location along the first outer plate body surface 320*e*. In this regard, the tab 348 can extend out from the plate body 320 at any location along the first outer plate body surface 320*e*. For example, in accordance with the illustrated embodiment, the tab 348 extends out from the plate body 320 at a location that is substantially equidistant between the first and second sides 320*c* and 320*d*, and extends out from the plate body 320 at a location that is between the upper and lower ends 320*a* and 320*b*.

The tab body 349 is oriented such that the first and second side surfaces 349*c* and 349*d* are substantially parallel to one another and substantially coplanar with a plane defined by the longitudinal direction L and the transverse direction T, and such that the upper and lower surfaces 349*e* and 349*f* are substantially parallel to one another and substantially coplanar with a plane defined by the longitudinal direction L and the lateral direction A. Thus, in accordance with the illustrated embodiment, the first and second side surfaces 349*c* and 349*d* are substantially perpendicular with respect to the first and second outer plate body surfaces 320*e* and 320*f* of the plate body 320 and are substantially perpendicular with respect to the upper surface 204*e* of the printed circuit board 202 when the electrical connector 100 is mounted to the printed circuit board 202. Furthermore, the upper and lower surfaces 349*e* and 349*f* are substantially perpendicular with respect to the first and second outer plate body surfaces 320*e* and 320*f* of the plate body 320 and are substantially parallel with respect to the upper surface 204*e* of the printed circuit board 202 when the electrical connector 100 is mounted to the printed circuit board 202. It should be appreciated that the tab body 349 can be alternatively oriented as desired.

In accordance with the illustrated embodiment, the upper and lower surfaces 349*e* and 349*f* of the tab body 349 are spaced along the third direction and define a tab height TH of the tab 348, and the first and second side surfaces 349*c* and 349*d* are spaced along the first direction and define a tab width TW of the tab 348. Further in accordance with the illustrated embodiment, the tab height TH is substantially equal to the plate thickness PT of the plate body 320, and the tab width TW is greater than the tab height TH, and thus greater than the tab thickness.

The upper and lower surfaces 349*e* and 349*f* can define respective first and second ones of opposed broadsides 350 of the tab 348 and the first and second side surfaces 349*c* and 349*d* can define respective first and second ones of opposed edges 352 of the tab 348. Thus, in accordance with the illustrated embodiment, the first and second edges 352 of the tab 348 are substantially perpendicular with respect to the upper surface 204*e* of the printed circuit board 202 when the electrical connector 100 is mounted to the printed circuit board 202, and the first and second broadsides 350 of the tab 348 are substantially parallel with respect to the upper surface 204*e* of the printed circuit board 202 when the electrical connector 100 is mounted to the printed circuit board 202. Furthermore, each of the first and second ones of the broadsides 350 has a first length along the lateral direction A from the first one of the edges 352 to the second one of the edges 352, and each of the first and second ones of the edges 352 has a second length that extends along the transverse direction T from a first one of the broadsides 350 to a second one of the broadsides 350, wherein the first length is greater than the second length.

The tab 348 can be integral, such as monolithic, with the plate body 320. Alternatively, the tab 348 can be separate and can be attached to the plate body 320. In accordance with the illustrated embodiment, the tab 348 can be defined by removing sections of material from the plate body 320, for example by making at least one cut 324 such as a plurality of cuts 324 in the plate body 320. The cuts 324 can comprise first and second cuts 324*a* and 324*b* that extend upward into the lower end 320*b* of the plate body 320 along the transverse direction T to respective locations between the upper and lower ends 320*a* and 320*b*, the first and second cuts 324*a* and 324*b* spaced from one another along the lateral direction a distance substantially equal to the tab width TW. The first cut 324*a* can be made at a location between the first and second sides 320*c* and 320*d* so as to define the first side 349*c* of the tab body 349. The second cut 324*b* can be made at a location between the first cut 324*a* and the second side 320*d* so as to define the second side 349*d* of the tab body 349. After the first and second cuts 324*a* and 324*b* have been made, the tab 348 can be bent out from the plate body 320 around a bend axis that extends along the lateral direction A and can be defined proximate the proximal end 349*a* of the tab body 349, such that the lower end 320*b* of the plate body 320 defines a void 320*g* that extends upward into the plate body 320 along the transverse direction T. The first and second cuts 324*a* and 324*b* can be located such that the tab 348 is located substantially equidistantly between the first and second sides 320*c* and 320*d* when the tab 348 is bent out from the plate body 320. It should be appreciated that the ground plate 306 is not limited to the illustrated tab geometry, and that the tab 348 can be alternatively constructed as desired.

Similarly to the ground plate 106, the ground plate 306 can include at least one mounting end 310 that can extend from the tab 348, and thus can be said to extend out from the plate body 320. In accordance with the illustrated embodiment, the at least one mounting end 310 can define a first mounting end extends downward from the lower surface 349*f* of the tab body 349 along the transverse direction T, and is located substantially at the distal end 349*b* of the tab body 349, such that the at least one mounting end 310 is substantially aligned with the void 320*g* along the longitudinal direction L and spaced from the first outer plate body surface 320*e* of the plate body 320 a distance D along the longitudinal direction L. The at least one mounting end 310 can include a mounting element that can be configured as a press-fit mounting element such as a press-fit tail 311 that is downwardly elongate along the transverse direction T. The tail 311 can be integral, such as monolithic, with the tab body 349. In this regard, it can be said that the tail 311 extends out from the at least one mounting end 310. Alternatively, the tail 311 can be separate and can be attached to the at least one mounting end 310. In accordance with the illustrated embodiment, the tail 311 can be constructed as a press-fit tail, for instance an eye of the needle tail configured to be inserted into a corresponding ground via 210 such that a press fit engagement is created between the tail 311 and the respective ground via 210 upon insertion. It should be appreciated that the ground plate 306 is not limited to the illustrated tails 311, and that the at least one mounting end 310 of the ground plate 306 can be constructed with any other mounting element geometry as desired.

Figure 5A:
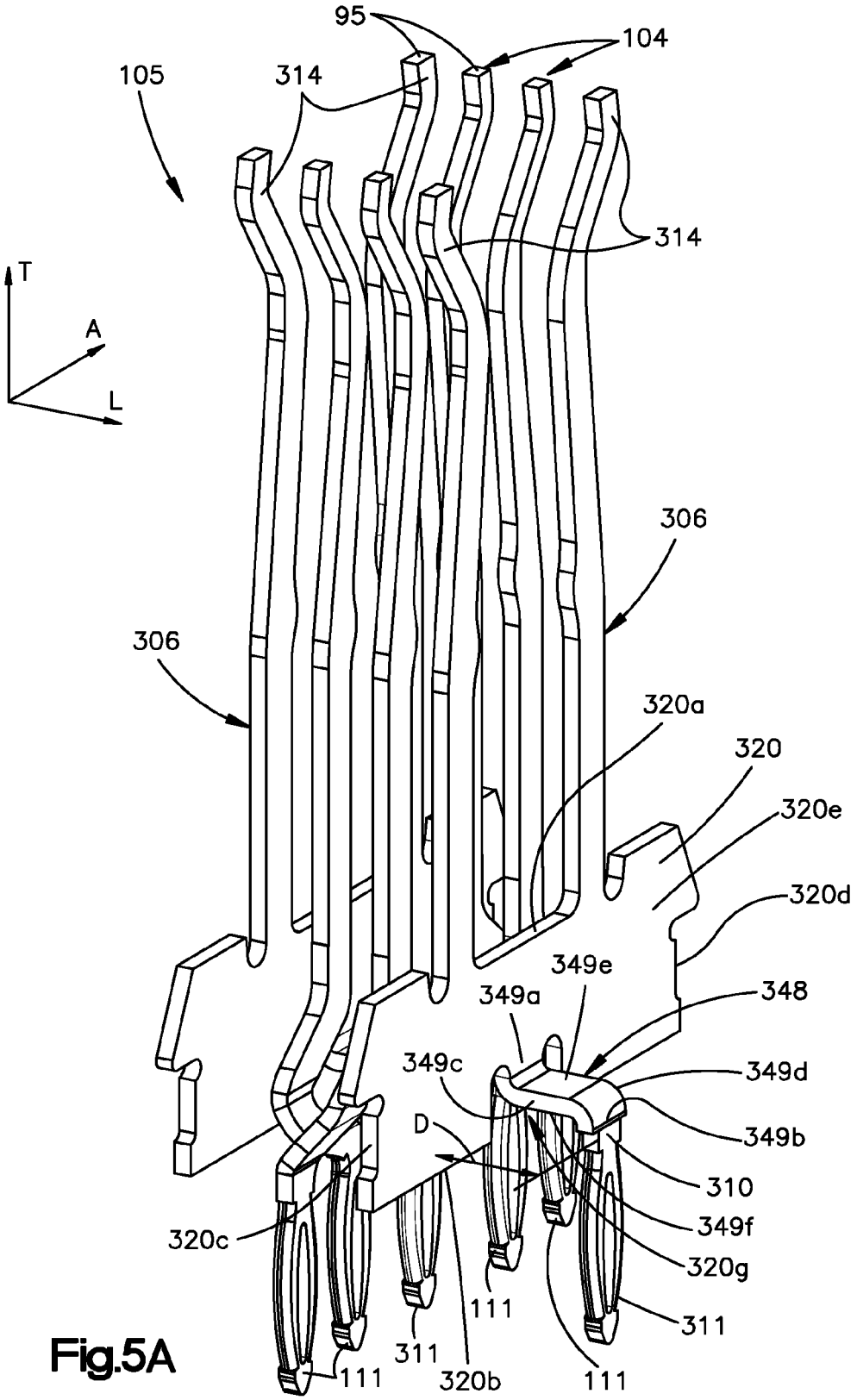
FIG. 5A is a perspective view of the electrical signal contacts illustrated in FIG. 3A and a pair of ground plates constructed in accordance with an alternative embodiment, the electrical signal contacts and the ground plates configured to be supported by the electrical connector illustrated in FIG. 1.
Figure 5B:
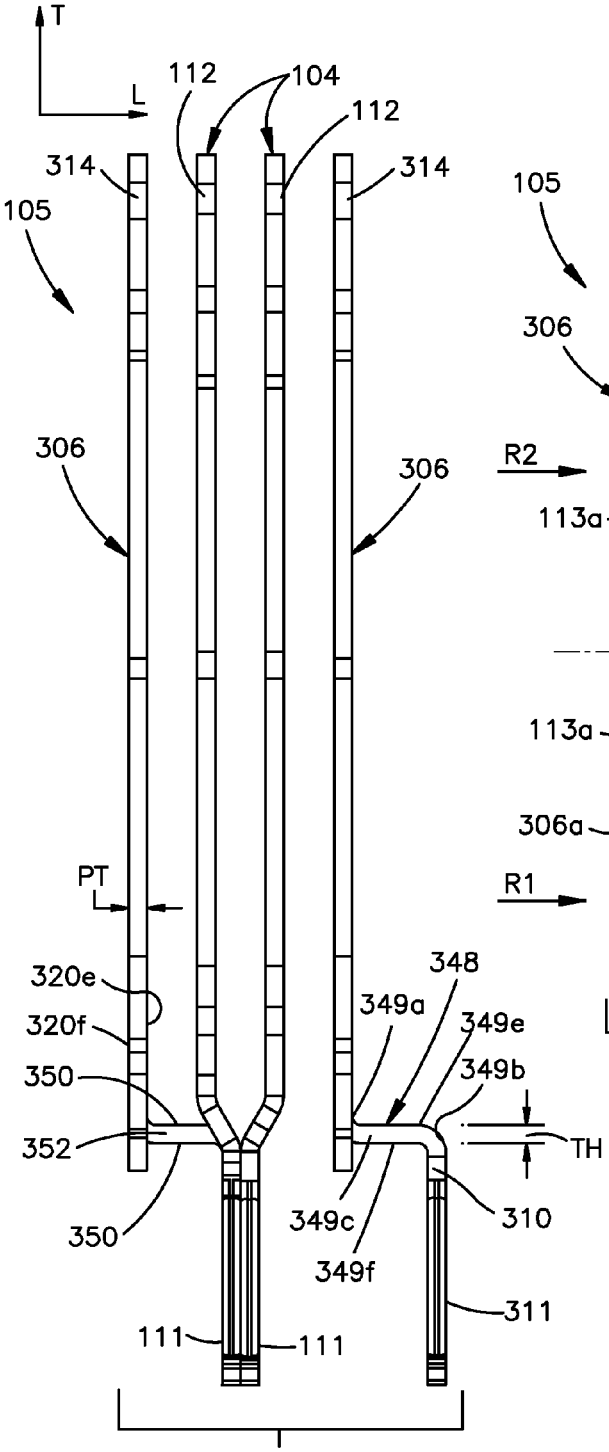
FIG. 5B is a side elevation view of the electrical signal contacts and ground plates illustrated in FIG. 5A.
Figure 5C:
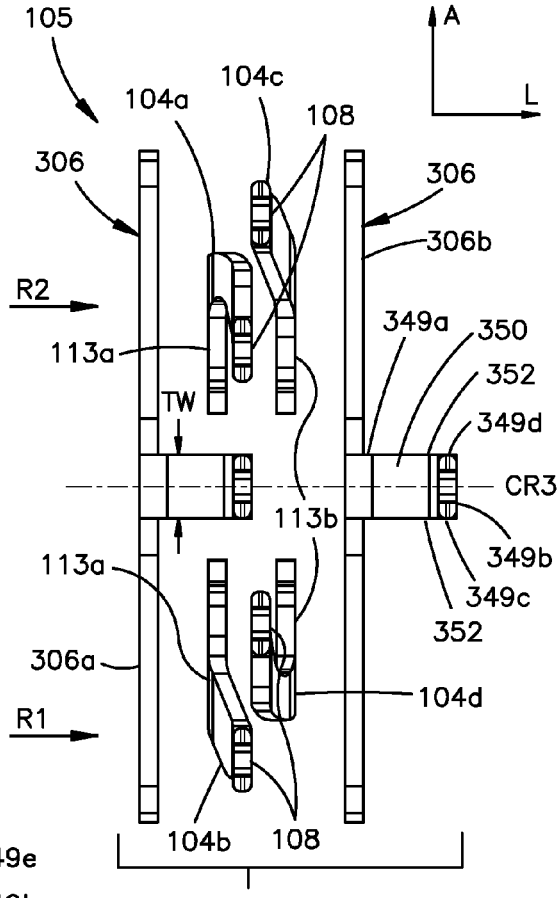
FIG. 5C is a bottom elevation view of the electrical signal contacts and ground plates illustrated in FIGS. 5A-5B.
Figure 5D:
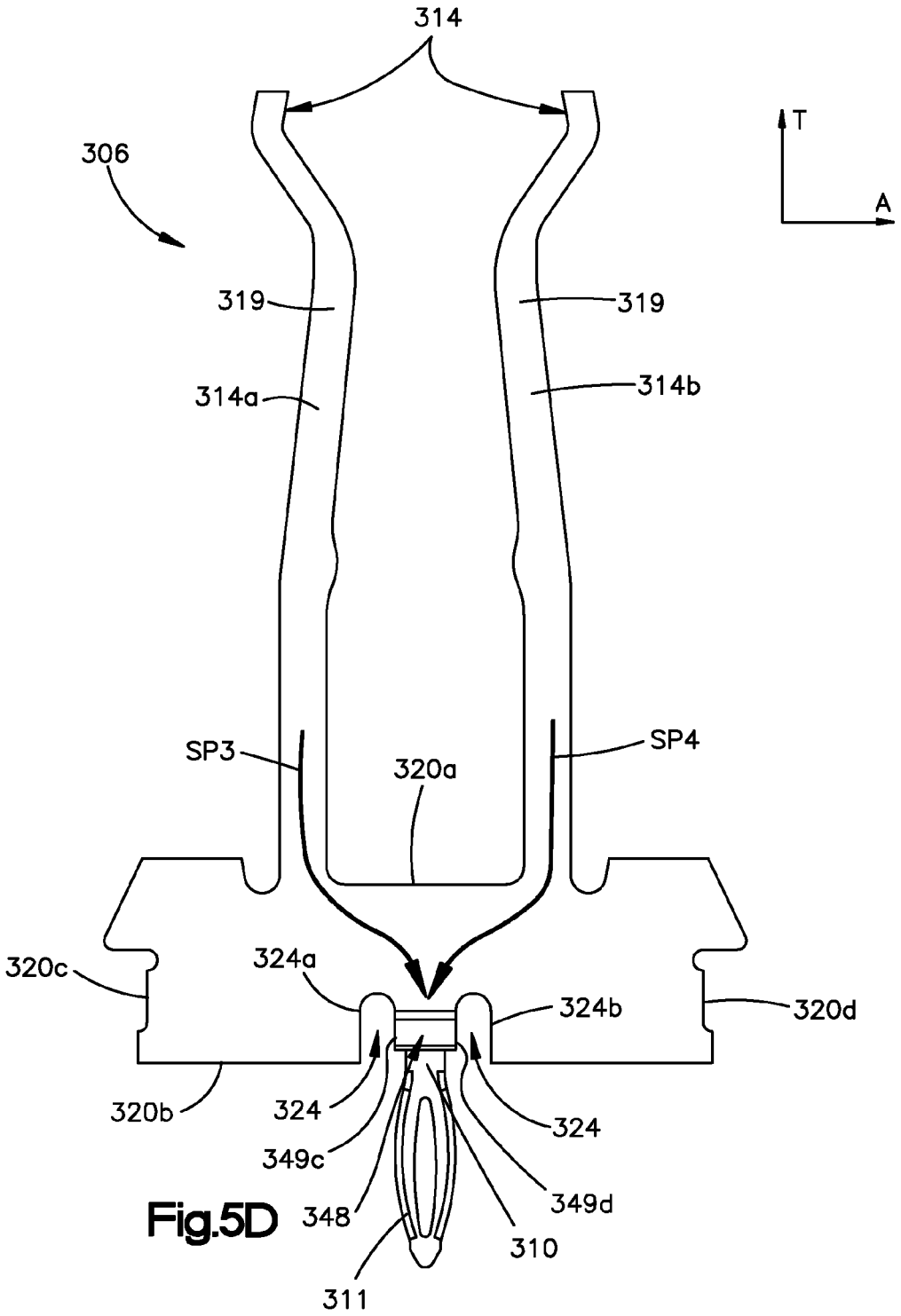
FIG. 5D is a front elevation view illustrating an example symmetric ground return flow path of the ground plates illustrated in FIGS. 5A-5C.
Figures 6A, 6B:
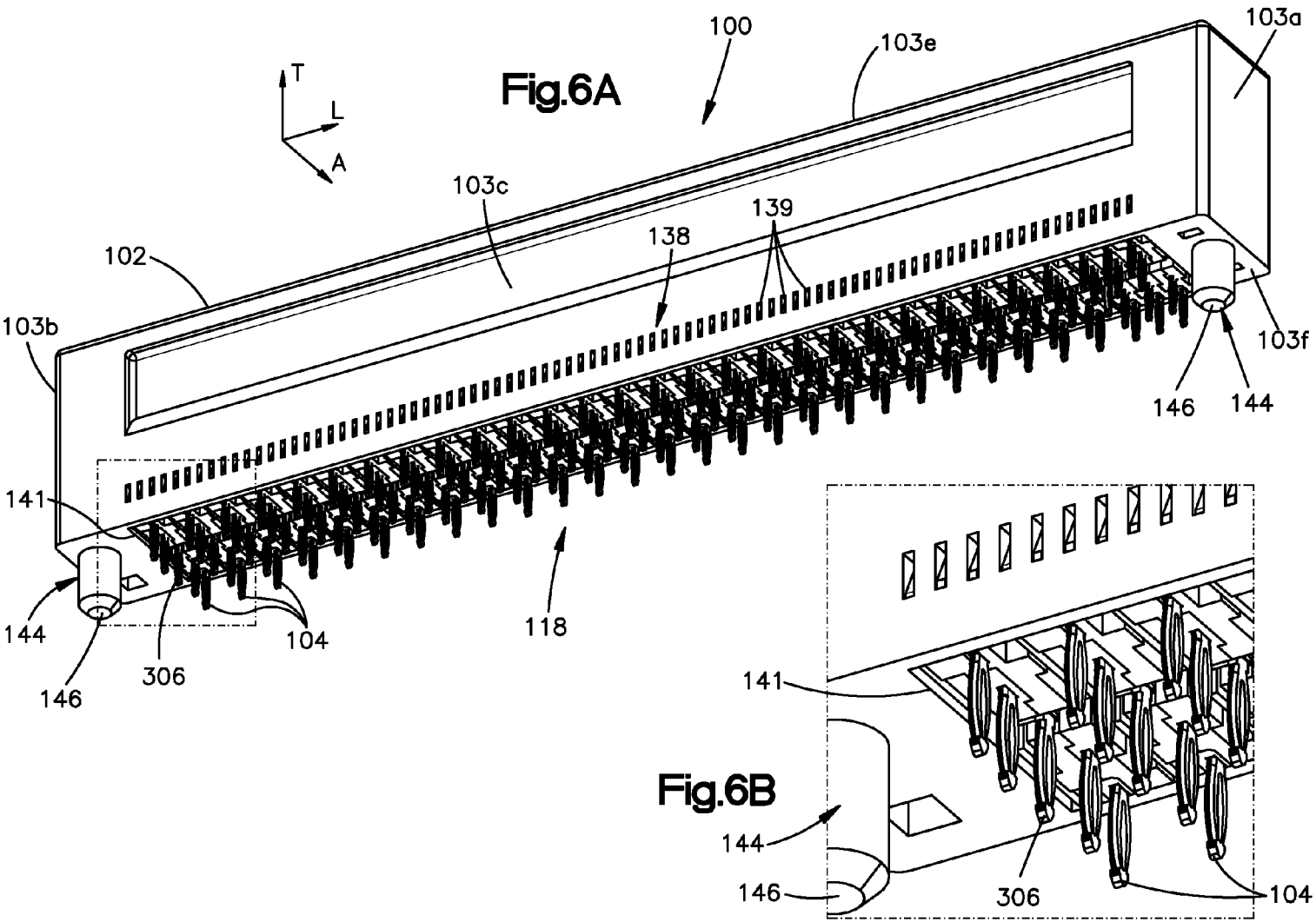
FIG. 6A is a perspective view of an electrical connector supporting a plurality of respective pairs of the leadframe assemblies illustrate d in FIG. 3E and a plurality of the ground plates illustrated in FIGS. 5A-5D.
FIG. 6B is a zoomed perspective view of a portion of the electrical connector illustrated in FIG. 6A.
Figure 7A:
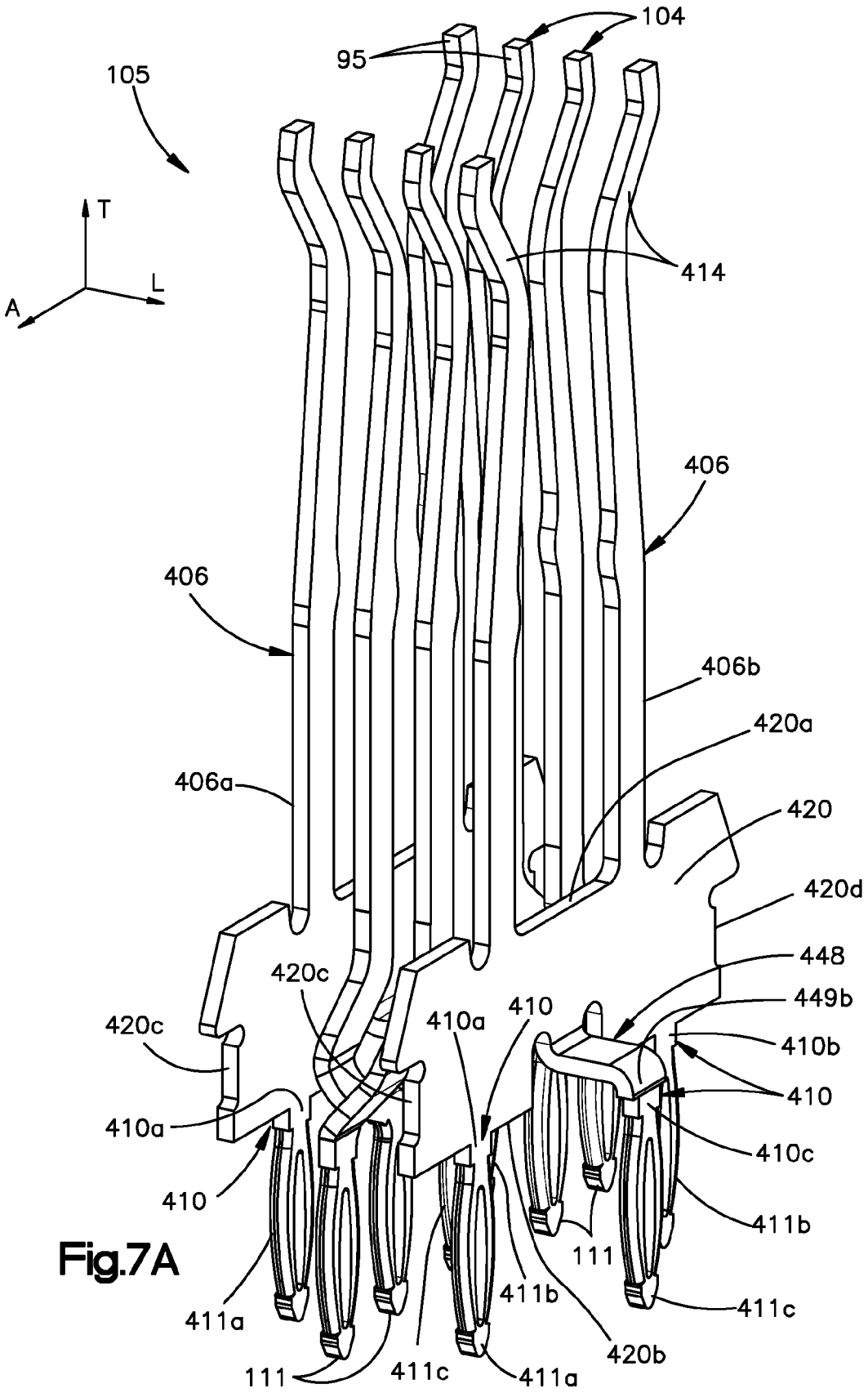
FIG. 7A is a perspective view of the electrical signal contacts illustrated in FIG. 3A and a pair of ground plates constructed in accordance with another alternative embodiment, the electrical signal contacts and the ground plates configured to be supported by the electrical connector illustrated in FIG. 1.
Figure 7B:
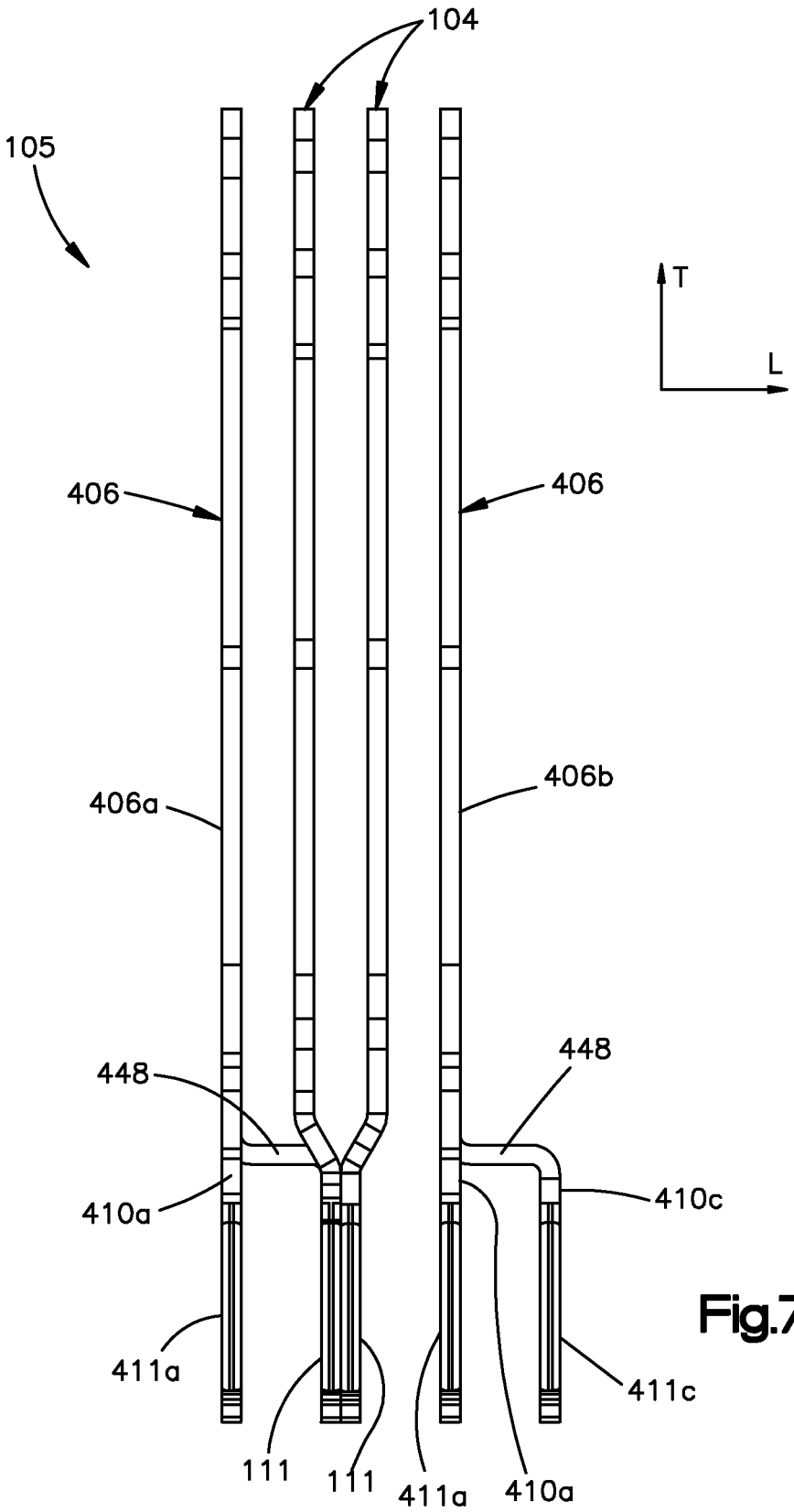
FIG. 7B is a side elevation view of the electrical signal contacts and ground plates illustrated in FIG. 7A.
Figure 7D:
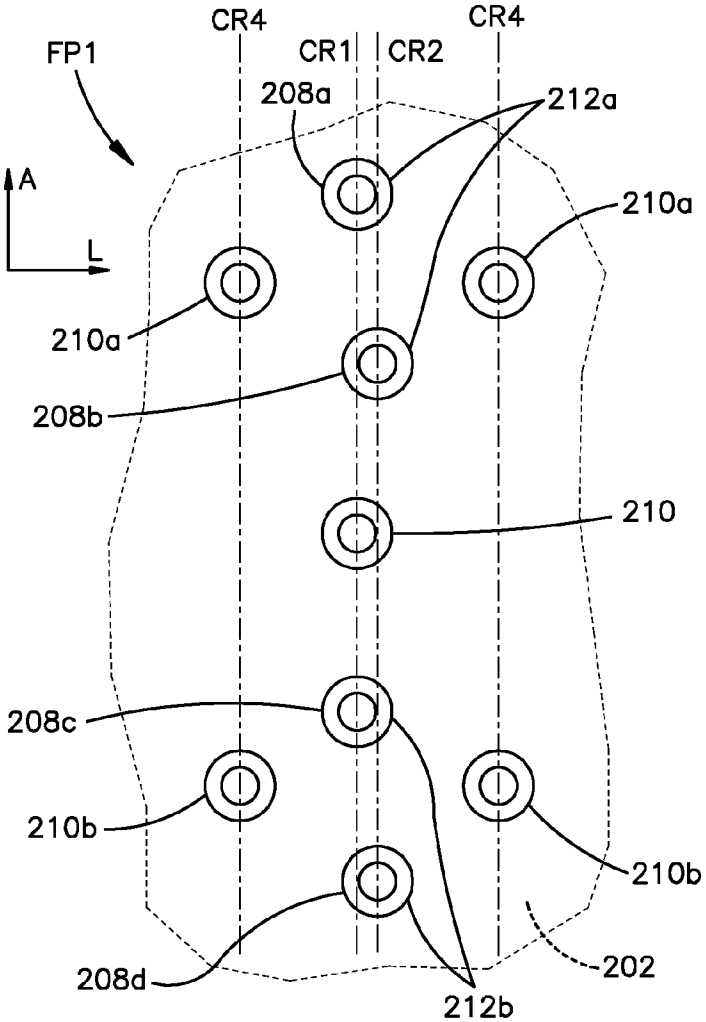
FIG. 7D is a top elevation view of a plurality of printed circuit board vias arranged in accordance with an alternative embodiment of a press fit footprint, the plurality of vias arranged such that the electrical signal contacts and ground plates illustrated in FIGS. 7A-7C can be inserted into the vias.
Figure 7C:
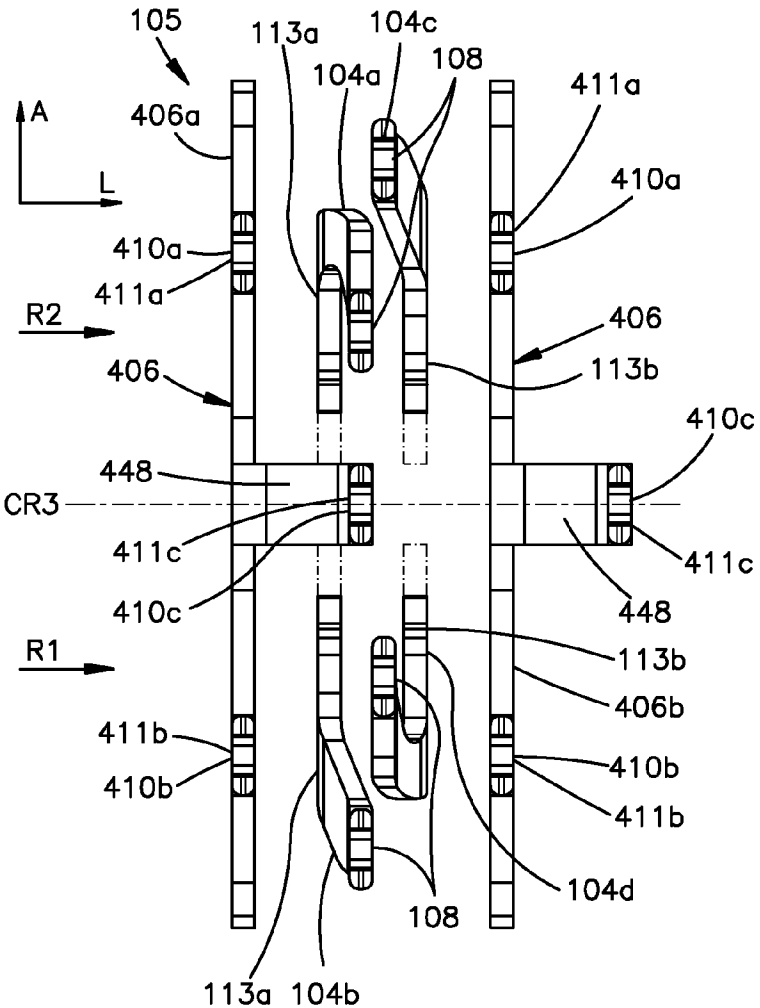
FIG. 7C is a bottom elevation view of the electrical signal contacts and ground plates illustrated in FIGS. 7A-7B.
Figure 8A:
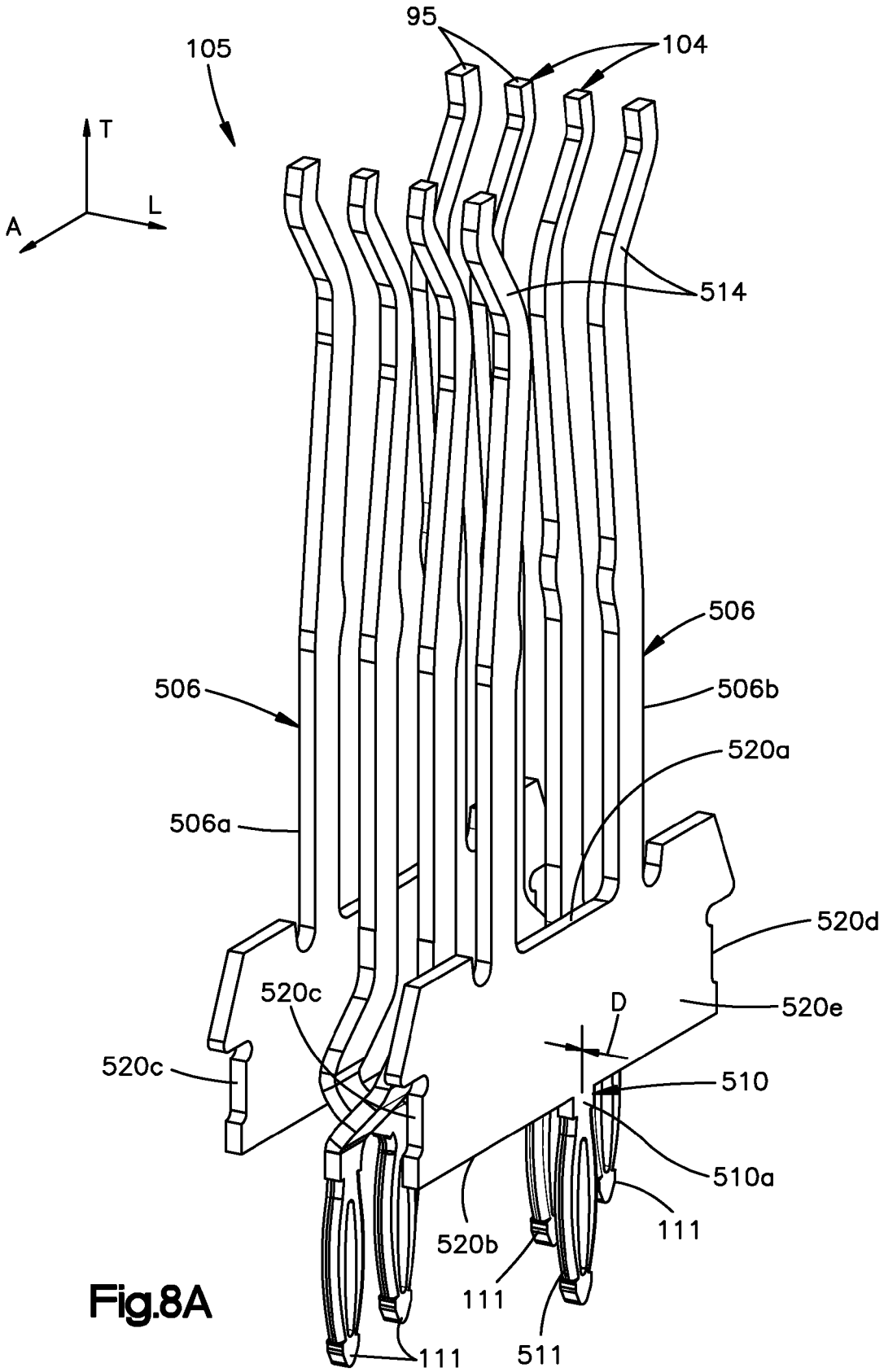
FIG. 8A is a perspective view of the electrical signal contacts illustrated in FIG. 3A and a pair of ground plates constructed in accordance with still another alternative embodiment, the electrical signal contacts and the ground plates configured to be supported by the electrical connector illustrated in FIG. 1.
Figure 8D:
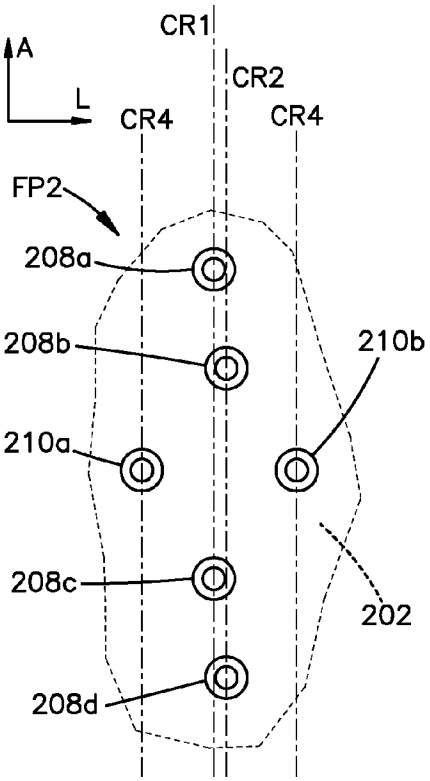
FIG. 8D is a top elevation view of a plurality of printed circuit board vias arranged in accordance with another alternative embodiment of a press fit footprint, the plurality of vias arranged such that the electrical signal contacts and ground plates illustrated in FIGS. 8A-8C can be inserted into the vias.
Figure 8C:
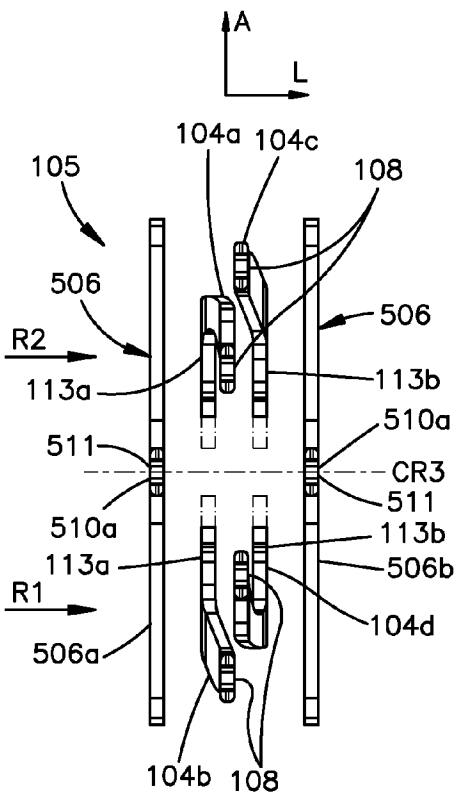
FIG. 8C is a bottom elevation view of the electrical signal contacts and ground plates illustrated in FIGS. 8A-8C.
Figure 8B:
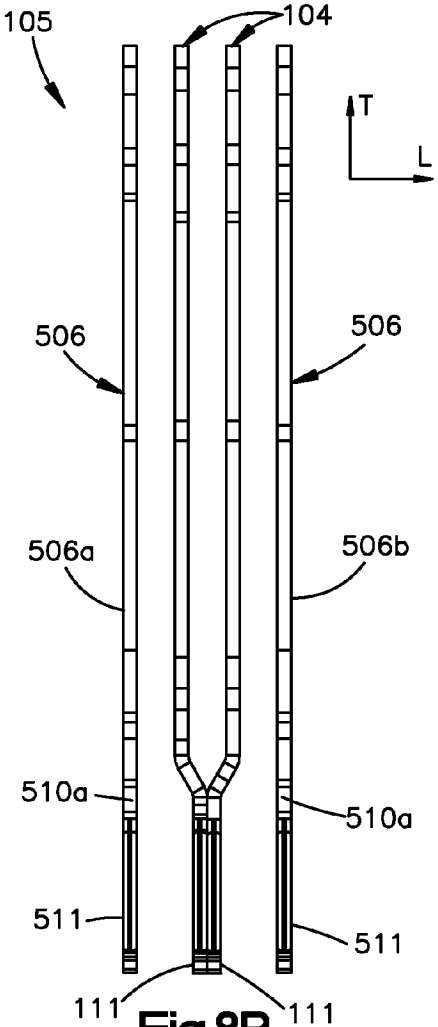
FIG. 8B is a side elevation view of the electrical signal contacts and ground plates illustrated in FIG. 8A.
Figure 9A:
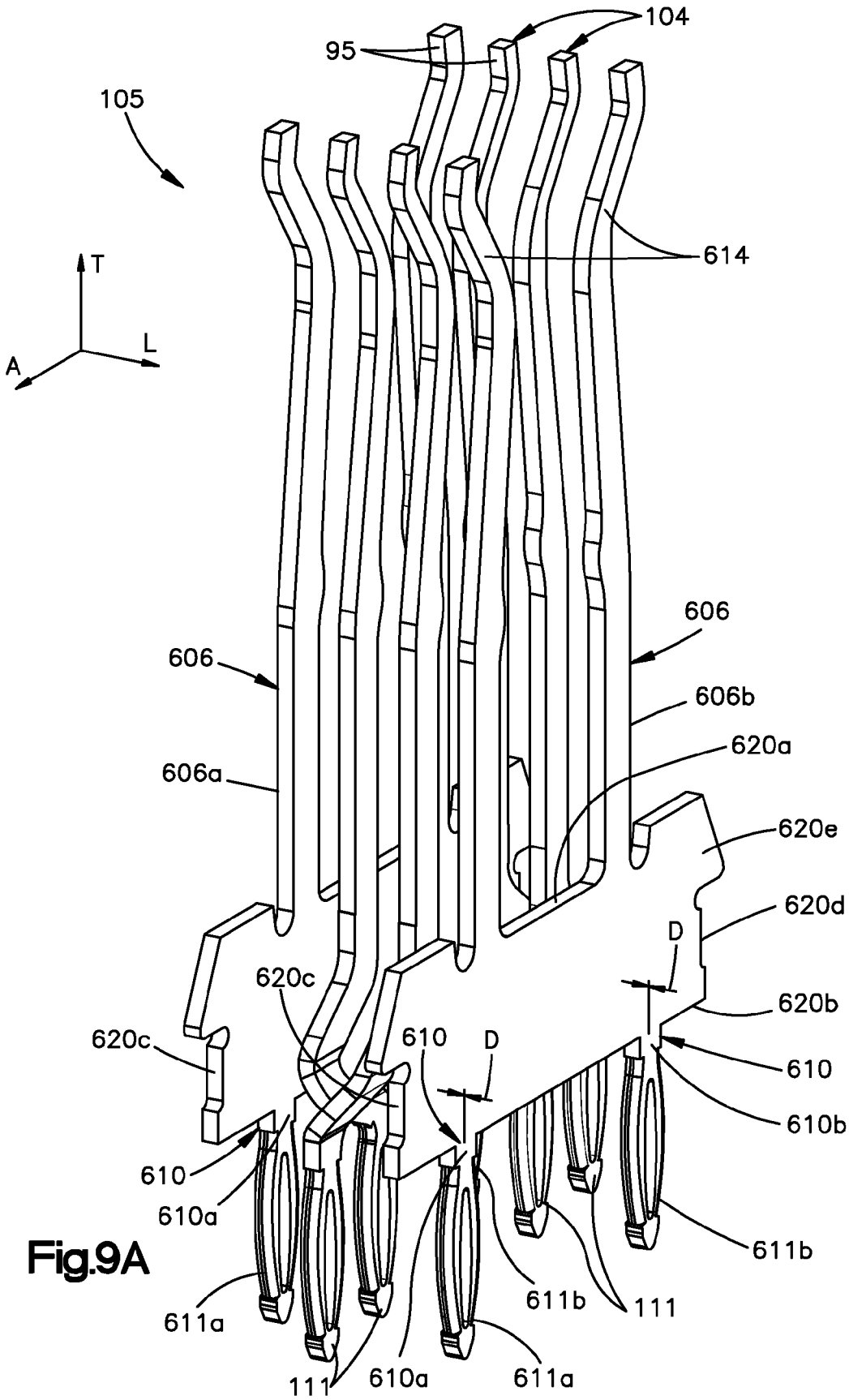
FIG. 9A is a perspective view of the electrical signal contacts illustrated in FIG. 3A and a pair of ground plates constructed in accordance with still another alternative embodiment, the electrical signal contacts and the ground plates configured to be supported by the electrical connector illustrated in FIG. 1.
Figure 9D:
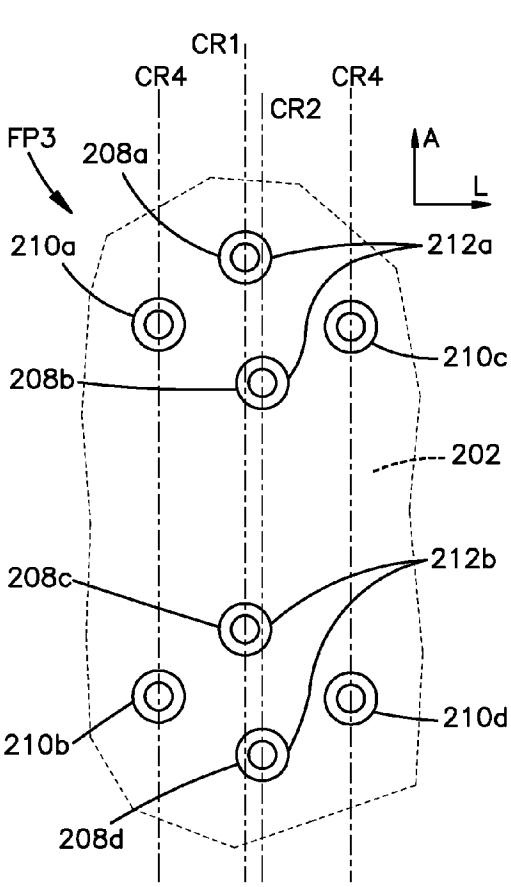
FIG. 9D is a top elevation view of a plurality of printed circuit board vias arranged in accordance with still another alternative embodiment of a press fit footprint, the plurality of vias arranged such that the electrical signal contacts and ground plates illustrated in FIGS. 9A-9C can be inserted into the vias.
Figure 9C:
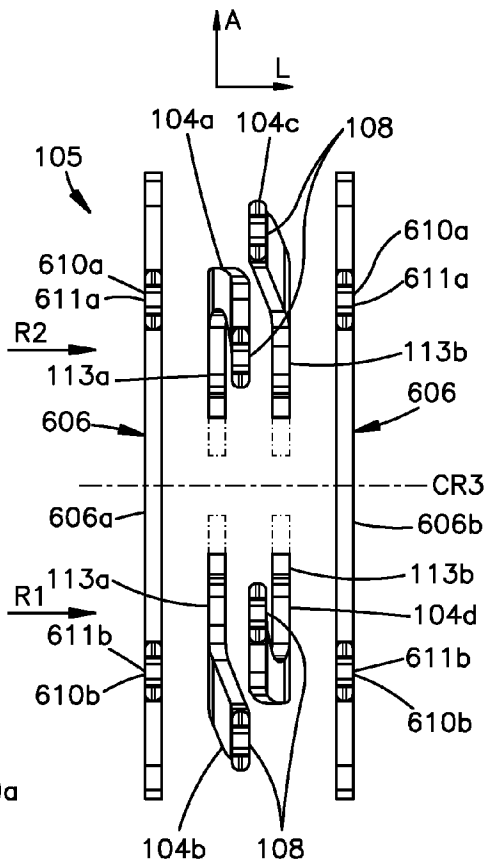
FIG. 9C is a bottom elevation view of the electrical signal contacts and ground plates illustrated in FIGS. 9A-9B.
Figure 9B:
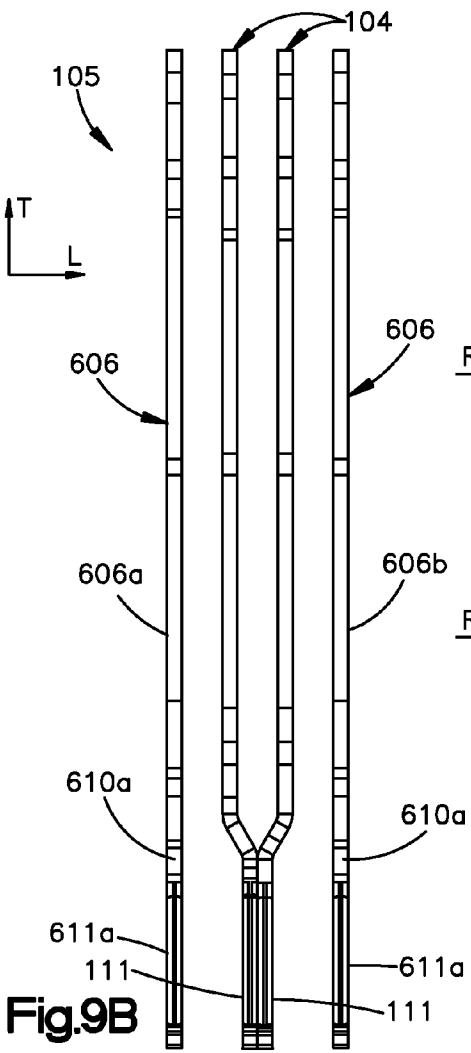
FIG. 9B is a side elevation view of the electrical signal contacts and ground plates illustrated in FIG. 9A.
Figure 10A:
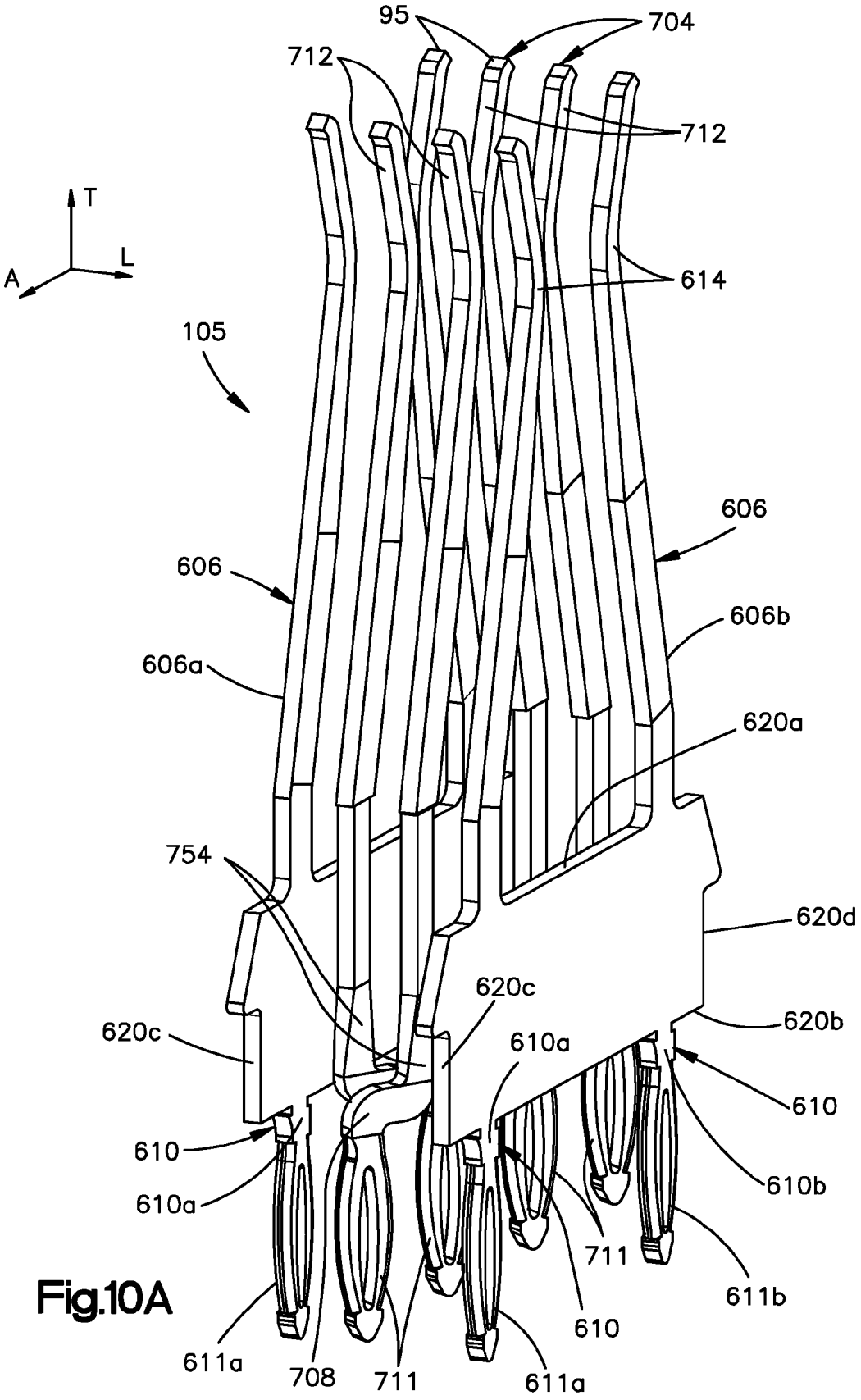
FIG. 10A is a perspective view of two pairs of electrical signal contacts constructed in accordance with an alternative embodiment and a pair of the ground plates illustrated in FIGS. 9A-9C.
Figure 10B:
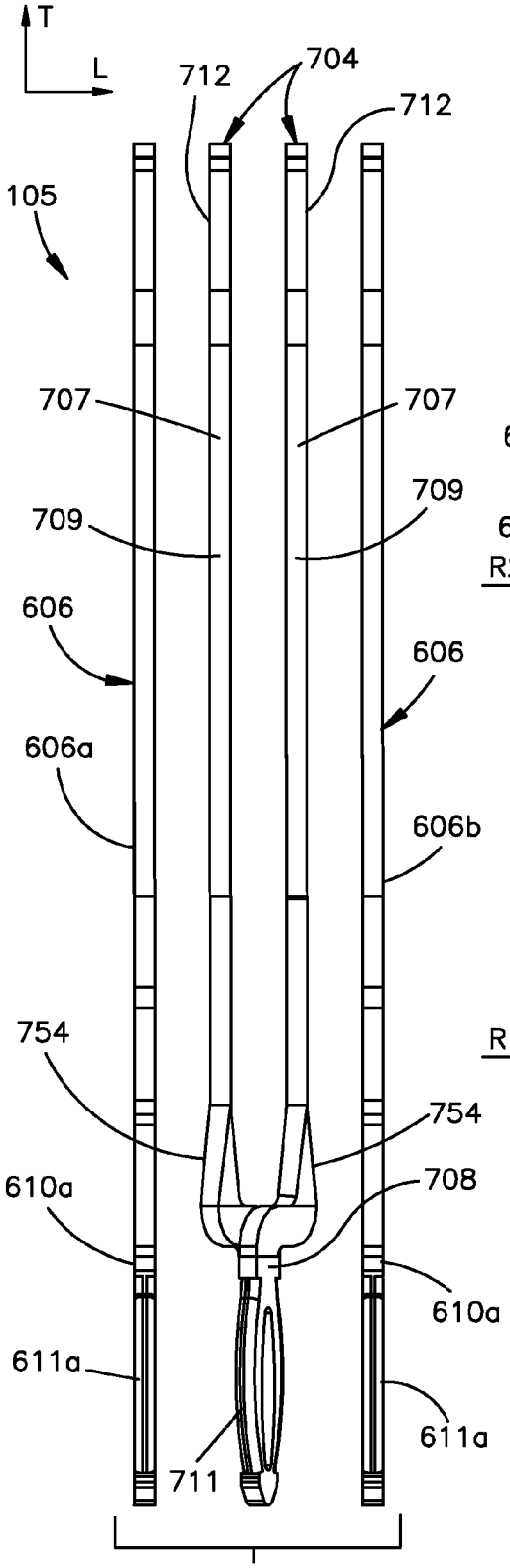
FIG. 10B is a side elevation view of the electrical signal contacts and ground plates illustrated in FIG. 10A.
Figure 10C:
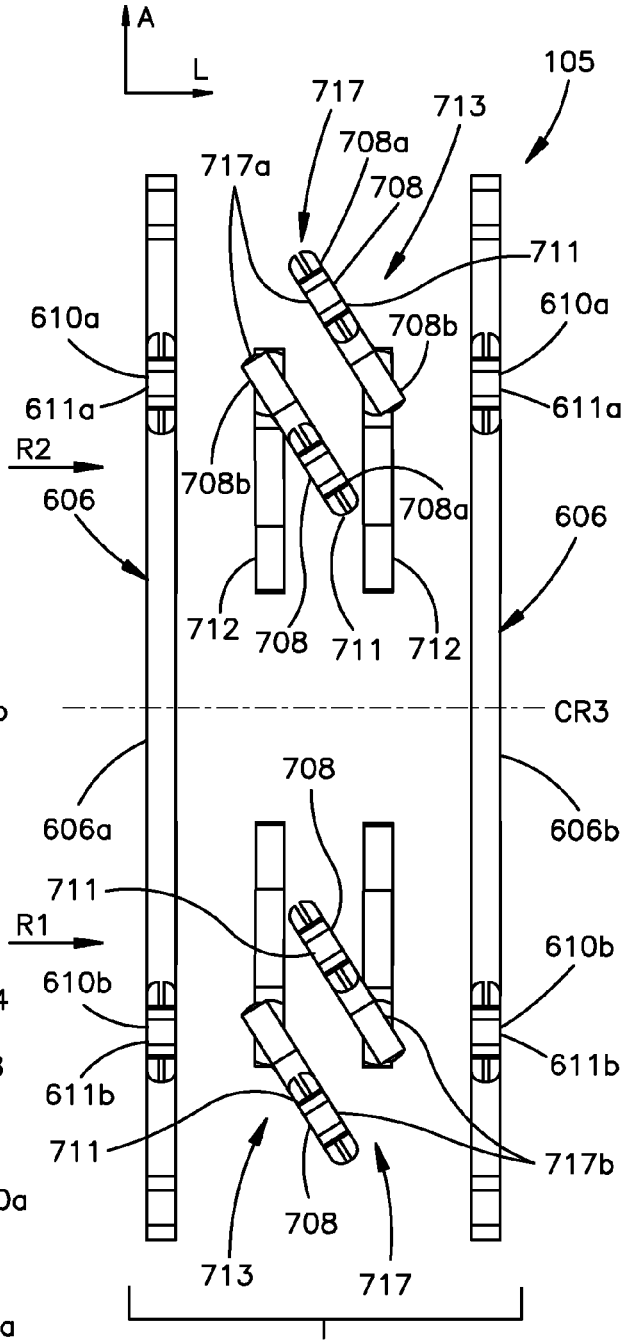
FIG. 10C is a bottom elevation view of the electrical signal contacts and ground plates illustrated in FIGS. 10A-10B.
Figure 10D:
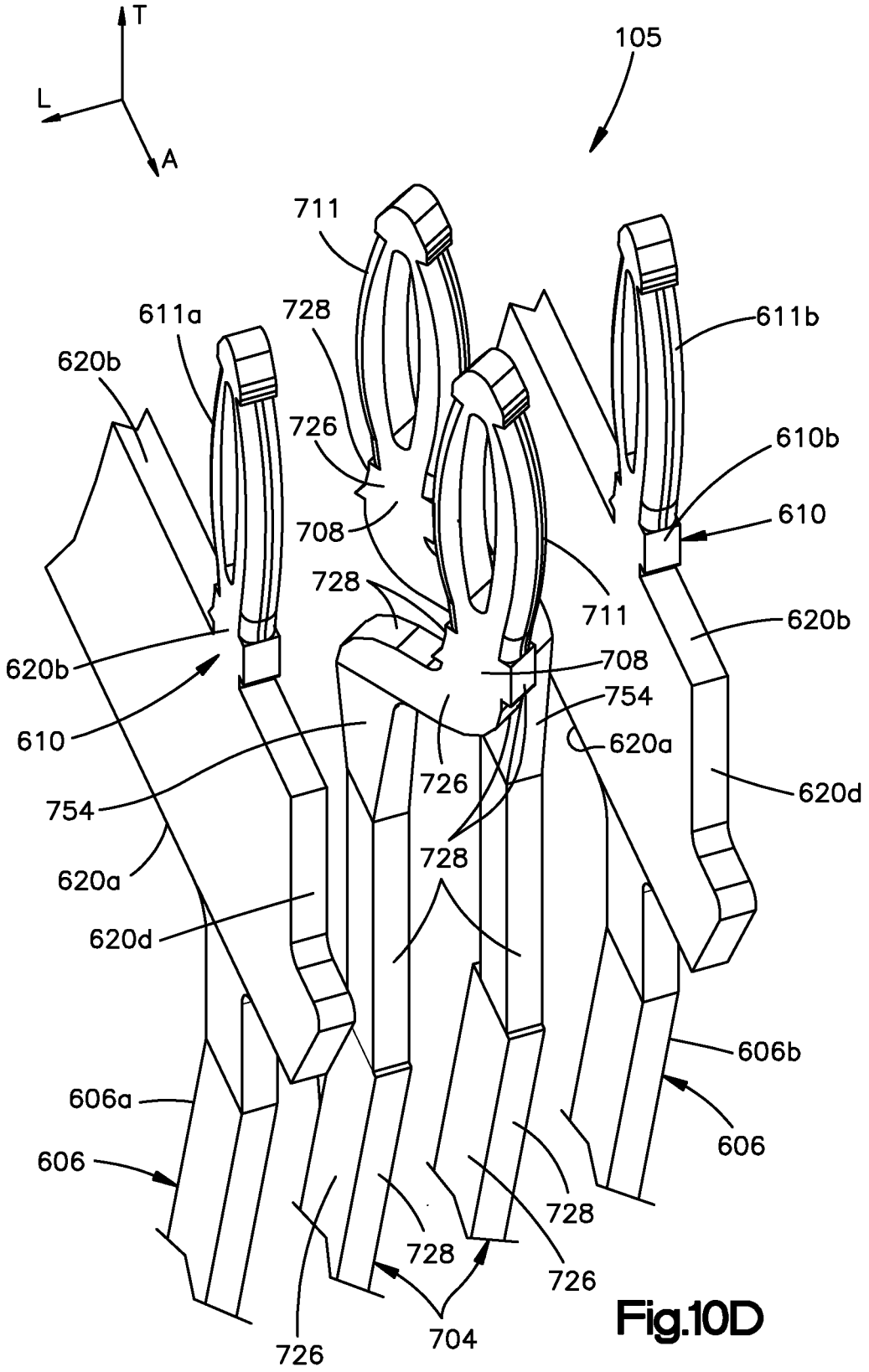
FIG. 10D is a perspective view of respective portions of the electrical signal contacts and ground plates illustrated in FIGS. 10A-10C.
Figure 10E:
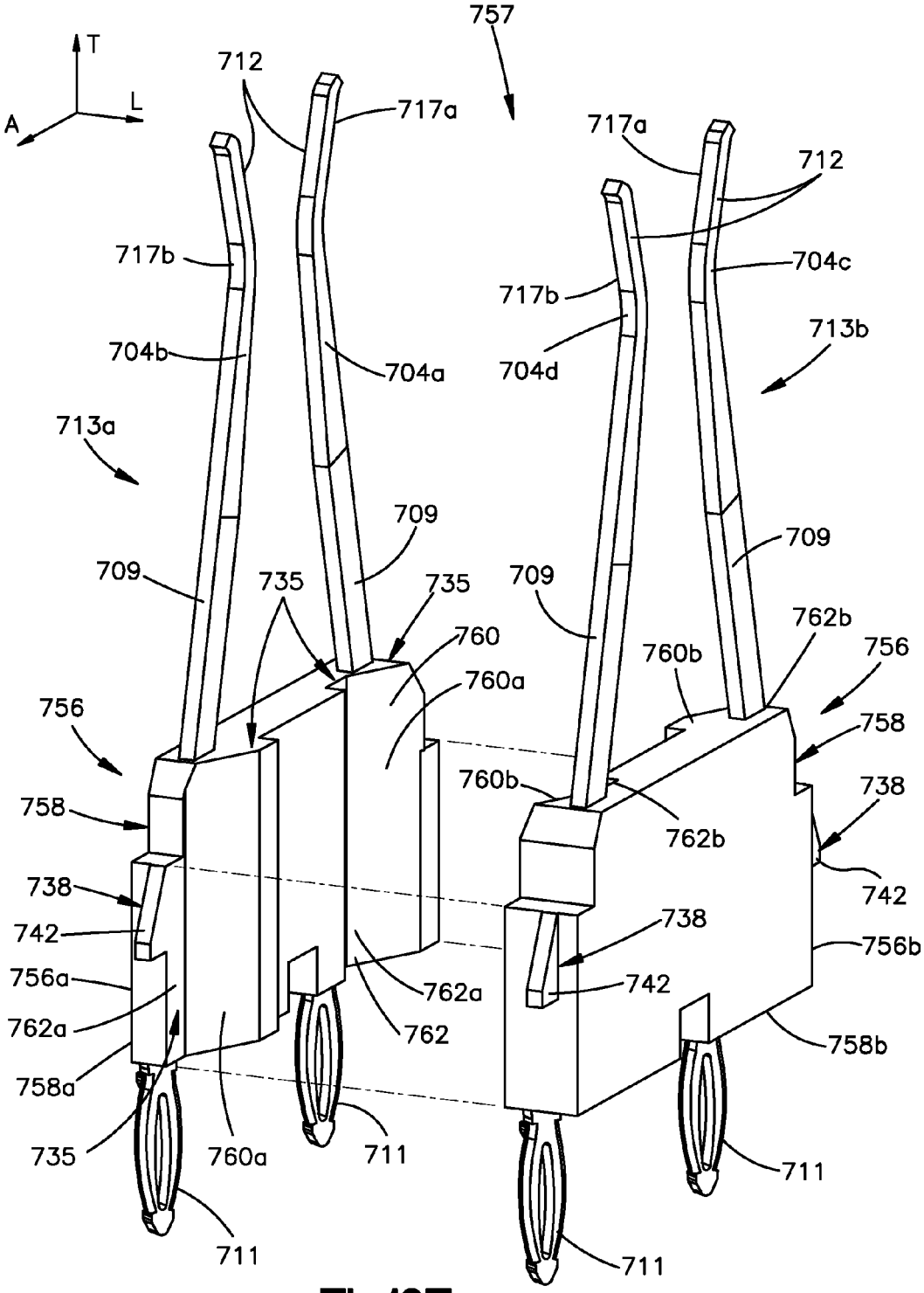
FIG. 10E is a perspective view of a pair of leadframe assemblies, each leadframe assembly comprising a pair of the electrical signal contacts illustrated in FIGS. 10A-10D.
Figure 10G:
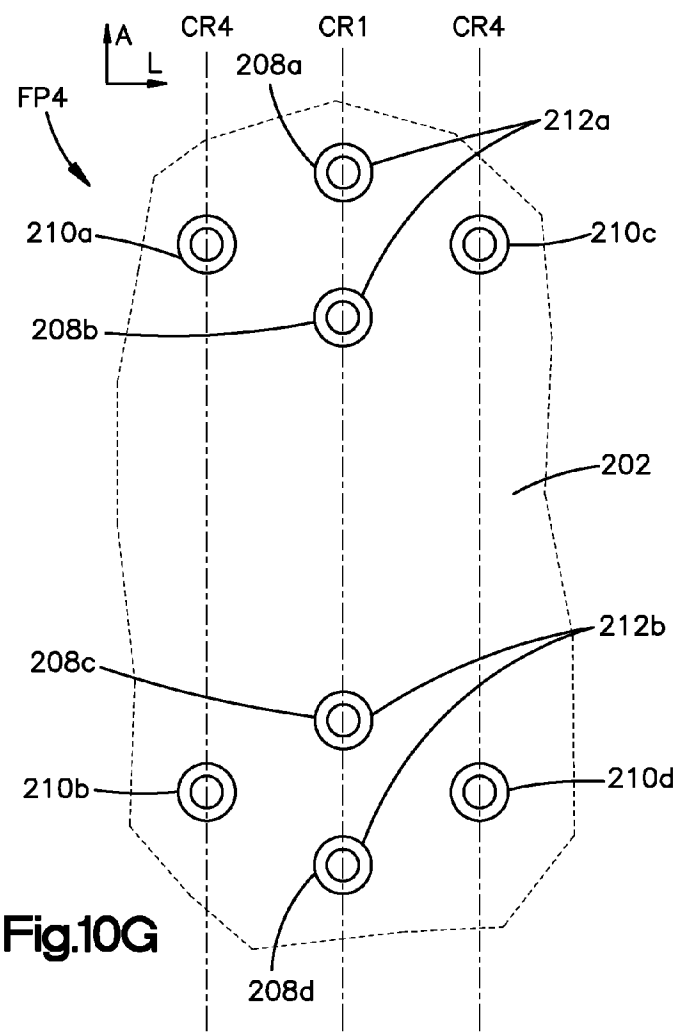
FIG. 10G is a top elevation view of a plurality of printed circuit board vias arranged in accordance with still another alternative embodiment of a press fit footprint, the plurality of vias arranged such that the electrical signal contacts and ground plates illustrated in FIGS. 10A-10F can be inserted into the vias.
Figure 10F:
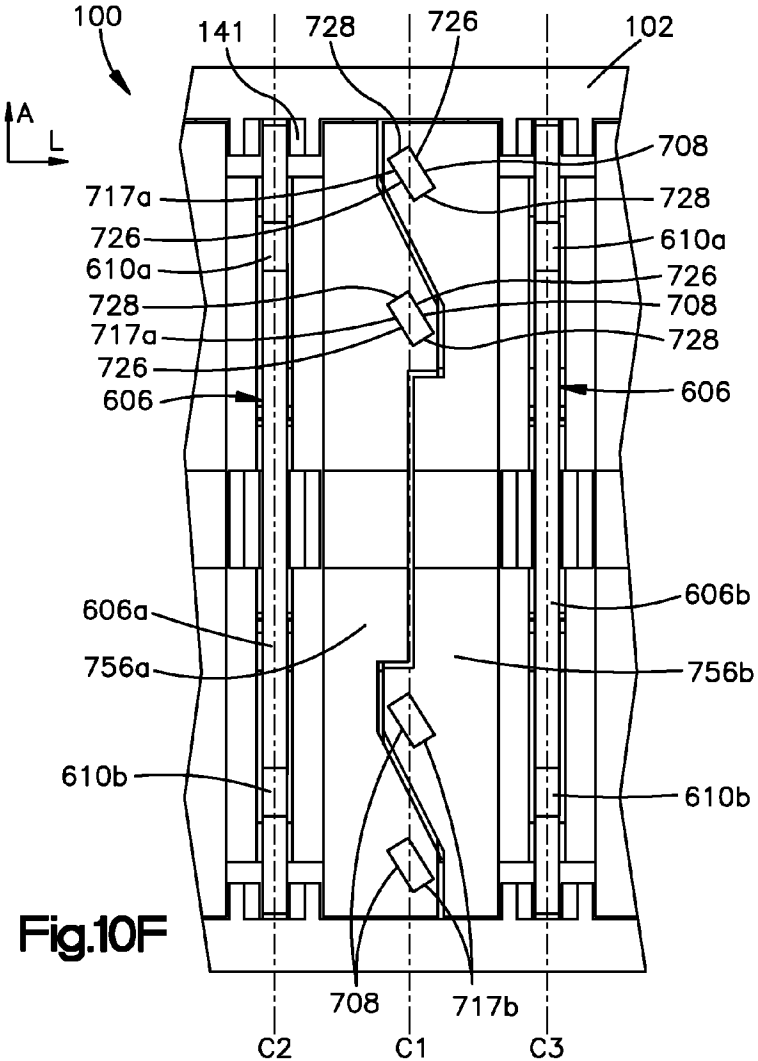
FIG. 10F is a bottom elevation view of the leadframe assemblies illustrated in FIG. 10E and the ground plates illustrated in FIGS. 10A-10D supported by the electrical connector illustrated in FIG. 1.

Referring now to FIGS. 5A-5C, when a respective one of the plurality of ground plates 306 and corresponding first and second pairs 113*a* and 113*b* of electrical signal contacts 104 are supported by the connector housing 102, at least a portion of the tab 348, such as the distal end 349*b* of the tab body 349, can be disposed between the mounting ends 108 of the first and second pairs 113*a* and 113*b* of electrical signal contacts 104, respectively, such that the mounting ends 108 of the first and second pairs 113*a* and 113*b* of electrical signal contacts 104 and the mounting end 310 disposed on the tab 348 of the ground plate 306 are substantially aligned along the first direction. For example, in accordance with the illustrated embodiment, when the first ground plate 306*a* and the first and second pairs 113*a* and 113*b* of electrical signal contacts 104 are supported by the connector housing 102, the mounting end 310 disposed on the tab 348 is disposed between the respective mounting ends 108 of the first and second electrical signal contacts 104*a* and 104*b* of the first pair 113*a* and between the respective mounting ends 108 of the first and second electrical signal contacts 104*c* and 104*d* of the second pair 113*b*. Furthermore, the tail 311 of the mounting end 310 that extends from the tab 348 is oriented substantially parallel with respect to the tails 111 that extend from the respective mounting ends 108 of the first and second pairs 113*a* and 113*b* of electrical signal contacts 104 (see FIG. 6).

The illustrated arrangement of electrical contacts 105, including the first and second pairs 113*a* and 113*b* of electrical signal contacts 104 and the ground plate 306 can be mounted to the industry standard MicroTCA® press fit footprint. Therefore, it can be said that the illustrated electrical connector 100 is footprint compatible with the MicroTCA® standard. For example, in accordance with the illustrated embodiment, when the first and second pairs 113*a* and 113*b* of electrical signal contacts 104 and the ground plate 306 are supported by the connector housing 102, the tails 111 that extend out from the respective mounting ends 108 of the first and second pairs 113*a* and 113*b* of electrical signal contacts 104 can be inserted into corresponding ones of the first and second pairs 212*a* and 212*b* of electrical signal vias 208 of a first column of vias 206, and the tail 311 of the mounting end 310 of the ground plate 306 can be inserted into the electrical ground via 210 of the first column of vias 206. In accordance with the illustrated embodiment, the mounting ends 108 of the plurality of the electrical signal contacts 104 define respective ones of a first plurality of press-fit tails 111, and the mounting end 311 of the tabs 348 of each of the ground plates 306 defines a respective one of a second plurality of press-fit tails 311, such that each of the first and second pluralities of press-fit tails are positioned to be inserted into complementary vias 206 of a printed circuit 202 board that are arranged in accordance with the MicroTCA® standard, such as the MicroTCA® specification Rev. 1.0, and are thus footprint compatible with the industry standard MicroTCA® PF footprint.

Referring again to FIGS. 5A-5D, each ground plate 306 can define symmetrical first and second ground return flow paths SP3 and SP4. For instance, a first mating end 314*a* can define a first ground mating end that defines the first ground flow return path SP3 from the first mating end 314*a* to the mounting end 310, and a second mating end 314*b* can define a second ground mating end that defines the second ground flow return path SP4 from the second mating end 314*b* to the mounting end 310. The first and second ground flow return paths SP3 and SP4 can define respect paths to ground for corresponding electrical signal contacts 104 disposed proximate the first and second mating ends 314*a* and 314*b*, respectively. For example, in accordance with the illustrated embodiment, electrical signal contacts 104 disposed proximate the first mating end 314*a*, such as the first electrical signal contacts 104*a* and 104*c* of the first and second pairs 113*a* and 113*b*, respectively, that define the first differential signal pair 117*a*, will follow the first ground return flow path SP3 to the mounting end 310, and electrical signal contacts 104 disposed proximate the second mating end 314*b*, such as the second electrical signal contacts 104*b* and 104*d* of the first and second pairs 113*a* and 113*b*, respectively, that define the second differential signal pair 117*b*, will follow the second ground return flow path SP4 to the mounting end 310.

The first and second ground flow return paths SP3 and SP4 can be symmetrical with respect to each other due to one or both of substantially equal physical length of the first and second ground flow return paths SP3 and SP4 or substantially equal electrical length of the first and second ground flow return paths SP3 and SP4. For example, in accordance with the illustrated embodiment, first and second the ground flow return paths SP3 and SP4 are substantially equal in physical length, at least in part due to the symmetry of the plate body 320, including the first and second mating ends 314*a* and 314*b*, with respect to the tail 311. Further in accordance with the illustrated embodiment, the first and second ground flow return paths SP3 and SP4 are substantially equal in electrical length. For example, a first electrical signal that propagates from a first location in the first mating end 314*a* of the ground plate 306 to the tail 311 will reach the tail 311 in substantially the same amount of time required for a second electrical signal to propagate from a second location in the second mating end 314*b* of the ground plate 306 to the tail 311, wherein the first location with respect to the first mating end 314*a* substantially corresponds with the second location with respect to the second mating end 314*b*. It should be appreciated that it is possible to alternatively construct the ground plate 306 such that the first and second ground flow return paths SP3 and SP4 are substantially equal in electrical length but not substantially equal in physical length. Because the first and second differential signal pairs 117*a* and 117*b* are adjacent to or near substantially equal length first and second ground flow return paths SP3 and SP4, respectively, the inductance levels exhibited by the first and second differential signal pairs 117*a* and 117*b* can be substantially the same, resulting in an overall performance increase over an electrical connector 100 constructed utilizing a plurality of ground plates 106.

Referring generally now to FIGS. 7A-9D, the ground plate of the electrical connector 100 can be differently constructed in accordance with additional alternative embodiments, so as to improve the path to ground characteristics associated with the plurality of electrical signal contacts 104 supported by the connector housing 102. To improve the ground path characteristics of the electrical connector 100, the ground plates can be differently constructed to introduce additional symmetries to the respective ground flow return paths defined by the ground plates of the electrical connector 100. In order to maintain compatibility between printed circuit board 202 and the electrical connectors 100 utilizing the alternatively constructed ground plates, the plurality of vias 206 can be disposed along the printed circuit board 202 in accordance with corresponding alternative arrangements, so as to define respective alternative footprints that differ from the industry standard MicroTCA® PF footprint, as described in more detail below. It should be further appreciated that electrical connectors 100 illustrated in FIGS. 7A-9D define mating ends 95 that are constructed in accordance with the existing MicroTCA® standard, such that the respective electrical connectors 100 are mating compatible with complementary electrical components constructed in accordance with the MicroTCA® standard as described above with respect to FIGS. 5A-C. Thus, in accordance with the illustrated embodiments illustrated in FIGS. 7A-9D, the mating ends 95 of the electrical contacts 105 collectively define eighty-five columns and two rows.

Referring now to FIGS. 7A-7D, a ground plate 406 constructed in accordance with an alternative embodiment is illustrated. In the interest of succinctness, elements of the ground plate 406 that are constructed substantially identically to corresponding elements of the ground plate 306 are labeled with reference numbers that are incremented by 100. The illustrated electrical signal contacts 104 can be constructed substantially identically to the electrical signal contacts 104 described above and illustrated in FIGS. 3A-3E, and thus the reference numerals associated therewith are repeated in FIGS. 7A-7D. The electrical connector 100 can be constructed utilizing at least one such as a plurality of the ground plates 406. In this regard, a plurality of ground plates 406 can be substituted for the plurality of ground plates 106, and the plurality of ground plates 406 can be supported by the connector housing 102 adjacent to corresponding pairs 113 of electrical signal contacts 104.

In accordance with the illustrated embodiment, the ground plate 406 includes a tab 448 that is constructed substantially identically to the tab 348 of the ground plate 306. The ground plate 406 can further include a plurality of mounting ends 410, for instance first, second, and third mounting ends 410*a*, 410*b*, and 410*c*. The first and second mounting ends 410*a* and 410*b* can be disposed substantially at the lower end 420*b* of the plate body 420, proximate the first and second sides 420*c* and 420*d*, respectively, such that the first mounting end 410*a* extends from the plate body 420 at a location closer to the first side 420*c* than the second side 420*d*, and the second mounting end 410*b* extends from the plate body 420 at a location closer to the second side 420*d* than the first side 420*c*. The first and second mounting ends 410*a* and 410*b* can extend out from the lower end 420*b* of the plate body 420, for instance downward from the lower end 420*b* along the transverse direction T. The third mounting end 410*c* can extend from the tab 448, substantially at the distal end 449*b*, and can extend out from the distal end 449*b*, for instance downward from the distal end 449*b* along the transverse direction T.

The first, second, and third mounting ends 410*a*, 410*b*, and 410*c* can include a first, second, and third tail 411*a*, 411*b*, and 411*c*, respectively. The first, second, and third tail 411*a*, 411*b*, and 411*c* extend out from the first, second, and third mounting ends 410*a*, 410*b*, and 410*c*, respectively, for example downward along the transverse direction T. The first, and second tails 411*a* and 411*b* can be integral, such as monolithic, with the first and second mounting ends 410*a* and 410*b*, respectively, and thus monolithic with the plate body 420. The third tail 411*c* can be can be integral, such as monolithic, with the third mounting end 410*c*, and thus monolithic with the tab body 349 and the plate body 420. In this regard, it can be said that the first, second, and third tails 411*a*, 411*b*, and 411*c* extend out from the first, second, and third mounting ends 410*a*, 410*b*, and 410*c*, respectively. Alternatively, the first, second, and third tails 411*a*, 411*b*, and 411*c* can be separate and can be attached to the first, second, and third mounting ends 410*a*, 410*b*, and 410*c*, respectively. In accordance with the illustrated embodiment, the first, second, and third tails 411*a*, 411*b*, and 411*c* can be constructed as press-fit tails, for instance eye of the needle tails configured to be inserted into corresponding electrical ground vias 210 such that press fit engagement is created between each of the first, second, and third tails 411*a*, 411*b*, and 411*c* and respective ones of the electrical ground vias 210 upon insertion. It should be appreciated that the ground plate 406 is not limited to the illustrated tails 411, and that the first, second, and third mounting ends 410*a*, 410*b*, and 410*c* can be constructed with any other mounting element geometry as desired.

Further in accordance with the illustrated embodiment, when respective pluralities of the electrical signal contacts 104 and the ground plates 406 are supported by the connector housing 102, the tails 111 that extend from the plurality of electrical signal contacts 104 can define a first plurality of press-fit tails of the electrical connector 100. Additionally, the third tails 411*c* that extend from the tab 448 of each ground plate 406 can define a second plurality of press-fit tails of the electrical connector 100. Moreover, the first and second tails 411*a* and 411*b* of each ground plate 406 can define a third plurality of press-fit tails of the electrical connector 100. It should be appreciated that the first and second pluralities of press-fit tails are configured to be inserted into complementary vias 206 of a printed circuit board 202 that are arranged in accordance with the MicroTCA®, such as the MicroTCA® specification Rev. 1.0, and are thus footprint compatible with the industry standard MicroTCA® PF footprint. It should further be appreciated that the third plurality of press-fit tails are positioned so as to not be insertable into complementary vias 206 of the printed circuit board 202 that are arranged in accordance with MicroTCA specification Rev. 1.0. Furthermore, select ones of the third plurality of press-fit tails includes first and second press-fit tails that are disposed on opposite sides of each of select ones of the first and second pluralities of press-fit tails, such that the mating ends 112 and 314 of the respective electrical signal contacts 104 and ground plates 306 that defines the select ones of the first, second, and third pluralities of the press-fit tails are aligned along the column direction C.

When a respective one of the plurality of ground plates 406 and corresponding first and second pairs 113*a* and 113*b* of electrical signal contacts 104 are supported by the connector housing 102, at least a portion of the tab 448, such as the distal end 449*b* of the tab body 449 and thus the third mounting end 410*c*, can be disposed between the mounting ends 108 of the first and second pairs 113*a* and 113*b* of electrical signal contacts 104, respectively, such that the mounting ends 108 of the first and second pairs 113*a* and 113*b* of electrical signal contacts 104 and the third mounting end 410*c* disposed on the tab 448 of the ground plate 406 are substantially aligned along the first direction.

Additionally, when a respective pair of successive first and second ground plates 406*a* and 406*b* and corresponding first and second pairs 113*a* and 113*b* of electrical signal contacts 104 are supported by the connector housing 102, respective ones of the mounting ends 108 of the first and second pairs 113*a* and 113*b* of electrical signal contacts 104 can be disposed between respective ones of the first and second mounting ends 410*a* and 410*b* of the first and second ground plates 406*a* and 406*b*. For example, in accordance with the illustrated embodiment, the first electrical signal contact 104*a* of the first pair 113*a* of electrical signal contacts 104 and the first electrical signal contact 104*c* of the second pair 113*b* of electrical signal contacts 104 are disposed proximate to, such as between the first mounting end 410*a* of the first ground plate 406*a* and the first mounting end 410*a* of the second ground plate 406*b*, and the second electrical signal contact 104*b* of the first pair 113*a* of electrical signal contacts 104 and the second electrical signal contact 104*d* of the second pair 113*b* of electrical signal contacts 104 are disposed proximate to, such as between the second mounting end 410*b* of the first ground plate 406*a* and the second mounting end 410*b* of the second ground plate 406*b*.

The electrical connector 100 can further include third and fourth pairs 113 of electrical signal contacts 104 supported by the connector housing 102. For example, when the third and fourth pairs 113 of electrical signal contacts are supported by the connector housing 102 adjacent to the second ground plate 406*b* and on the opposite side of the second ground plate 406*b* from the first and second pairs 113*a* and 113*b* of electrical signal contacts 104, that the third mounting end 410*c* of the second ground plate 406*b* of the pair of ground plates 406 can be disposed between the respective mounting ends 108 of the third and fourth pairs 113 of electrical signal contacts, respectively.

The industry standard MicroTCA® PF footprint can be modified to operate with the illustrated configuration of electrical signal contacts 104 and ground plates 406. For example, the plurality of vias 206 can be disposed along the printed circuit board so as to define a first alternative footprint FP1. In accordance with the illustrated embodiment, the first and second pairs 212*a* and 212*b* of electrical signal vias 208 and the central electrical ground via 210 of the industry standard MicroTCA® PF footprint are retained. In this regard, the alternative footprint FP1 is backwards compatible with existing industry standard MicroTCA® PF electrical connectors. In order to make the alternative footprint FP1 compatible with the illustrated configuration of electrical signal contacts 104 and ground plates 406, columns of additional electrical ground vias 210 can be disposed between each column of the industry standard MicroTCA® PF footprint. For example, in accordance with the illustrated embodiment, each column of additional electrical ground vias 210 comprises a pair of electrical ground vias 210 disposed along a centerline CR4 that is spaced substantially equidistantly along the longitudinal direction L between respective adjacent centerlines CR1 of the industry standard MicroTCA® PF footprint. A first electrical ground via 210*a* of each column is disposed proximate the first and second electrical signal vias 208*a* and 208*b* of the first pair 212*a*, and a second electrical ground via 210*b* can be spaced from the first electrical ground via 210*a* along the lateral direction A and disposed proximate the second electrical signal vias 208*c* and 208*d* of the second pair 212*b*.

Referring now to FIGS. 8A-8D, a ground plate 506 constructed in accordance with another alternative embodiment is illustrated. In the interest of succinctness, elements of the ground plate 506 that are constructed substantially identically to corresponding elements of the ground plate 306 are labeled with reference numbers that are incremented by 200. The illustrated electrical signal contacts 104 can be constructed substantially identically to the electrical signal contacts 104 described above and illustrated in FIGS. 3A-3E, and thus the reference numerals associated therewith are repeated in FIGS. 8A-8D. The electrical connector 100 can be constructed utilizing at least one such as a plurality of the ground plates 506. In this regard, a plurality of ground plates 506 can be substituted for the plurality of ground plates 106, and the plurality of ground plates 506 can be supported by the connector housing 102 adjacent to corresponding pairs 113 of electrical signal contacts 104.

In accordance with the illustrated embodiment, the ground plate 506 is constructed without a tab, such that the lower end is substantially straight along the lateral direction A. The ground plate 506 can include a first mounting ends 510*a*. The first mounting end 510*a* can be disposed substantially at the lower end 520*b* of the plate body 520, and can be located substantially equidistantly between the first and second sides 520*c* and 520*d*, respectively. The first mounting ends 510*a* can extend out from the lower end 520*b* of the plate body 520, for instance downward from the lower end 520*b* along the transverse direction T. The first mounting end 510*a* can extend from the plate body 520 so as to be substantially inline with the plate body 520, such that the at least one mounting end 510*a* is spaced from the first outer plate body surface 520*e* of the plate body 520 a distance that is shorter than the distance D along the longitudinal direction L, and thus is positioned so as to not be insertable into any of the complementary vias of a printed circuit board that are arranged in accordance with MicroTCA specification Rev. 1.0. For example, in accordance with the illustrated embodiment, the distance D that the first mounting end 510*a* is spaced from the first outer plate body surface 520*e* of the plate body 520 can be zero, such that the first mounting end 510*a* is substantially coplanar with the plate body 520. Further in accordance with the illustrated embodiment, the first mounting end 510*a* extends downwardly from the lower end 520*b* of the plate body 520 substantially along the transverse direction T.

The first mounting end 510*a* can include a mounting element that can be configured as a press-fit mounting element such as a press-fit tail 511 that is downwardly elongate along the transverse direction T. The tail 511 can be integral, such as monolithic, with the first mounting end 510*a*, and thus monolithic with the plate body 520. In this regard, it can be said that the tail 511 extends out from the first mounting end 510*a*. Alternatively, the tail 511 can be separate and can be attached to the first mounting end 510*a*. In accordance with the illustrated embodiment the tail 511 can be constructed as a press-fit tail, for instance an eye of the needle tail configured to be inserted into a corresponding ground via 210 such that a press fit engagement is created between the tail 511 and a respective one of the electrical ground vias 210 upon insertion. It should be appreciated that the ground plate 506 is not limited to the illustrated tail 511, and that the first mounting end 510*a* can be constructed with any other mounting element geometry as desired.

Further in accordance with the illustrated embodiment, when respective pluralities of the electrical signal contacts 104 and the ground plates 506 are supported by the connector housing 102, the tails 111 that extend from the plurality of electrical signal contacts 104 can define a first plurality of press-fit tails of the electrical connector 100. Additionally, the tails 511 that extend from the ground plates 506 can define a second plurality of press-fit tails of the electrical connector 100. It should be appreciated that the first plurality of press-fit tails is configured to be inserted into complementary vias 206 of a printed circuit board 202 that are arranged in accordance with the MicroTCA®, such as the MicroTCA® specification Rev. 1.0, and are thus footprint compatible with the industry standard MicroTCA® PF footprint. It should further be appreciated that the second plurality of press-fit tails are positioned so as to not be insertable into complementary vias 206 of the printed circuit board 202 that are arranged in accordance with MicroTCA specification Rev. 1.0. Furthermore, select ones of the second plurality of press-fit tails includes first and second press-fit tails that are disposed on opposite sides of each of select ones of the first and second pluralities of press-fit tails, such that the mating ends 112 and 514 of the respective electrical signal contacts 104 and ground plates 506 that defines the select ones of the first and second pluralities of the press-fit tails are aligned along the column direction C.

When a respective pair of successive first and second ground plates 506*a* and 506*b* and corresponding first and second pairs 113*a* and 113*b* of electrical signal contacts 104 are supported by the connector housing 102, the respective first mounting ends 510*a* of the first and second ground plates 506*a* and 506*b* are disposed between the respective mounting ends 108 of the first and second pairs 113*a* and 113*b* of electrical signal contacts 104, respectively. For example, in accordance with the illustrated embodiment, the first electrical signal contact 104*a* of the first pair 113*a* of electrical signal contacts 104 and the first electrical signal contact 104*c* of the second pair 113*b* of electrical signal contacts 104 are disposed on a first side of the centerline CR3 and the second electrical signal contact 104*b* of the first pair 113*a* of electrical signal contacts 104 and the second electrical signal contact 104*d* of the second pair 113*b* of electrical signal contacts 104 are disposed on a second side of the centerline CR3 that is opposite and spaced along the lateral direction A from the first side of the centerline CR3.

The industry standard MicroTCA® PF footprint can be modified to operate with the illustrated configuration of electrical signal contacts 104 and ground plates 506. For example, the plurality of vias 206 can be disposed along the printed circuit board 202 so as to define a second alternative footprint FP2. In accordance with the illustrated embodiment, the first and second pairs 212*a* and 212*b* of electrical signal vias 208 of the industry standard MicroTCA® PF footprint are retained. In order to make the alternative footprint FP2 compatible with the illustrated configuration of electrical signal contacts 104 and ground plates 506, additional electrical ground vias 210 can be disposed between the columns of electrical signal vias 208 of the industry standard MicroTCA® PF footprint. For example, in accordance with the illustrated embodiment, the alternative footprint FP2 defines a plurality of centerlines CR4, each centerline CR4 spaced substantially equidistantly along the row direction R between successive centerlines CR1 of the industry standard MicroTCA® PF footprint. At least one electrical ground via 210 is disposed along each of the plurality of centerlines CR4, such that each of the at least one electrical ground vias 210 is disposed between successive columns of electrical signal vias 208. Additionally, the central electrical ground via 210 of the industry standard MicroTCA® PF footprint can be omitted if backwards compatibility is not desired.

It should be appreciated that the printed circuit board 202 can alternatively be constructed in accordance with the alternative footprint FP2. For example, the printed circuit 202 constructed in accordance with the alternative footprint FP2 and configured to receive mounting tails of only a single connector can include a first pair of electrical signal vias 208, such as electrical signal vias 208*a* and 208*c*, respectively, that are arranged inline with respect to each other along a first column that extends along the column direction C and can be coincident with the centerline CR1. The printed circuit 202 constructed in accordance with the alternative footprint FP2 can further include a second pair of electrical signal vias 208, such as electrical signal vias 208*b* and 208*d* that are arranged inline with respect to each other along a second column that extends along the column direction C and can be coincident with the centerline CR2. The first and second columns are spaced apart from each other along the row direction. The printed circuit 202 constructed in accordance with the alternative footprint FP2 can further include at least a first electrical ground via 210*a*, such as no more than a pair of first electrical ground vias 210, disposed in a third column that extends substantially along the column direction C and can be coincident with a first one of the centerlines CR4. The printed circuit 202 constructed in accordance with the alternative footprint FP2 can further include at least a second electrical ground via 210*b*, such as no more than a pair of second electrical ground vias 210, disposed in a fourth column that extends substantially along the column direction C and can be coincident with a second one of the centerlines CR4. Further in accordance with the illustrated embodiment, the first and second ground vias 210*a* and 210*b* are each disposed between each of the first pair of signal vias along the column direction C, and are further disposed between each of the second pair of signal vias along the column direction C, and the first and second columns are disposed between the third and fourth columns.

Referring now to FIGS. 9A-9D, a ground plate 606 constructed in accordance with still another alternative embodiment is illustrated. In the interest of succinctness, elements of the ground plate 606 that are constructed substantially identically to corresponding elements of the ground plate 506 are labeled with reference numbers that are incremented by 100. The illustrated electrical signal contacts 104 can be constructed substantially identically to the electrical signal contacts 104 described above and illustrated in FIGS. 3A-3E, and thus the reference numerals associated therewith are repeated in FIGS. 8A-8D. The electrical connector 100 can be constructed utilizing at least one such as a plurality of the ground plates 606. In this regard, a plurality of ground plates 606 can be substituted for the plurality of ground plates 106, and the plurality of ground plates 606 can be supported by the connector housing 102 adjacent to corresponding pairs 113 of electrical signal contacts 104.

In accordance with the illustrated embodiment, the ground plate 606 can include a plurality of mounting ends 610, for instance first and second mounting ends 610*a* and 610*b*. The first and second mounting ends 610*a* and 610*b* can be disposed substantially at the lower end 620*b* of the plate body 620, proximate the first and second sides 620*c* and 620*d*, respectively, such that the first mounting end 610*a* extends from the plate body 620 at a location closer to the first side 620*c* than the second side 620*d*, and the second mounting end 610*b* extends from the plate body 620 at a location closer to the second side 620*d* than the first side 620*c*. The first and second mounting ends 610*a* and 610*b* can extend out from the lower end 620*b* of the plate body 620, for instance downward from the lower end 620*b* along the transverse direction T. The first and second mounting ends 610*a* and 610*b* can extend from the plate body 620 so as to be substantially inline with the plate body 620, as described above with respect to the first mounting end 510*a* of the ground plate 506. For example, in accordance with the illustrated embodiment, the distance D that the first and second mounting ends 610*a* and 610*b* are spaced from the first outer plate body surface 620*e* of the plate body 620 can be zero, such that the first and second mounting ends 610*a* and 610*b* are substantially coplanar with the plate body 620. Further in accordance with the illustrated embodiment, the first and second mounting ends 610*a* and 610*b* extend downwardly from the lower end 620*b* of the plate body 620 substantially along the transverse direction T.

The first and second mounting ends 610*a* and 610*b* can include first and second tails 611*a* and 611*b*, respectively. The first and second tails 611*a* and 611*b* can extend out from the first and second mounting ends 610*a* and 610*b*, respectively, for example downward along the transverse direction T. The first and second tails 611*a* and 611*b* can be integral, such as monolithic, with the first and second mounting ends 610*a* and 610*b*, respectively, and thus monolithic with the plate body 620. In this regard, it can be said that the first and second tails 611*a* and 611*b* extend out from the first and second mounting ends 610*a* and 610*b*, respectively. Alternatively, the first and second tails 611*a* and 611*b* can be separate and can be attached to the first and second mounting ends 610*a* and 610*b*, respectively. In accordance with the illustrated embodiment, the first and second tails 611*a* and 611*b* can be constructed as press-fit tails, for instance eye of the needle tails configured to be inserted into corresponding electrical ground vias 210 such that press fit engagement is created between each of the first and second tails 611*a* and 611*b* and respective ones of the electrical ground vias 210 upon insertion. It should be appreciated that the ground plate 606 is not limited to the illustrated tails 611, and that the first and second mounting ends 610*a* and 610*b* can be constructed with any other mounting element geometry as desired.

Further in accordance with the illustrated embodiment, when respective pluralities of the electrical signal contacts 104 and the ground plates 606 are supported by the connector housing 102, the tails 111 that extend from the plurality of electrical signal contacts 104 can define a first plurality of press-fit tails of the electrical connector 100. Additionally, the first and second tails 611*a* and 611*b* that extend from the ground plates 606 can define a second plurality of press-fit tails of the electrical connector 100. It should be appreciated that the first plurality of press-fit tails is configured to be inserted into complementary vias 206 of a printed circuit board 202 that are arranged in accordance with the MicroTCA®, such as the MicroTCA® specification Rev. 1.0, and are thus footprint compatible with the industry standard MicroTCA® PF footprint. It should further be appreciated that the second plurality of press-fit tails are positioned so as to not be insertable into complementary vias 206 of the printed circuit board 202 that are arranged in accordance with MicroTCA specification Rev. 1.0. Furthermore, select ones of the second plurality of press-fit tails includes first and second pairs of press-fit tails that are disposed on opposite sides of each of select ones of the first plurality of press-fit tails, such that the mating ends of the respective electrical signal contacts and ground plates that defines the select ones of the first and second pluralities of the press-fit tails are aligned along the column direction C.

When a respective pair of successive first and second ground plates 606*a* and 606*b* and corresponding first and second pairs 113*a* and 113*b* of electrical signal contacts 104 are supported by the connector housing 102, respective ones of the mounting ends 108 of the first and second pairs 113*a* and 113*b* of electrical signal contacts 104 can be disposed between respective ones of the first and second mounting ends 610*a* and 610*b* of the first and second ground plates 606*a* and 606*b*. For example, in accordance with the illustrated embodiment, the first electrical signal contact 104*a* of the first pair 113*a* of electrical signal contacts 104 and the first electrical signal contact 104*c* of the second pair 113*b* of electrical signal contacts 104 are disposed proximate to, such as between the first mounting end 610*a* of the first ground plate 606*a* and the first mounting end 610*a* of the second ground plate 606*b*, and the second electrical signal contact 104*b* of the first pair 113*a* of electrical signal contacts 104 and the second electrical signal contact 104*d* of the second pair 113*b* of electrical signal contacts 104 are disposed proximate to, such as between the second mounting end 610*b* of the first ground plate 606*a* and the second mounting end 610*b* of the second ground plate 606*b*.

The industry standard MicroTCA® PF footprint can be modified to operate with the illustrated configuration of electrical signal contacts 104 and ground plates 606. For example, the plurality of vias 206 can be disposed along the printed circuit board so as to define a third alternative footprint FP3. In accordance with the illustrated embodiment, the first and second pairs 212*a* and 212*b* of electrical signal vias 208 of the industry standard MicroTCA® PF footprint are retained.

In order to make the alternative footprint FP3 compatible with the illustrated configuration of electrical signal contacts 104 and ground plates 606, additional electrical ground vias 210 can be disposed between the columns of electrical signal vias 208 of the industry standard MicroTCA® PF footprint. For example, in accordance with the illustrated embodiment, the alternative footprint FP3 defines a plurality of centerlines CR4, each centerline CR4 spaced substantially equidistantly along the row direction R between successive centerlines CR1 of the industry standard MicroTCA® PF footprint. At least one electrical ground via 210 such as a pair of electrical ground vias 210 is disposed along each of the plurality of centerlines CR4, such that each of the at least one electrical ground vias 210 is disposed between successive columns of electrical signal vias 208. Additionally, the central electrical ground via 210 of the industry standard MicroTCA® PF footprint can be omitted if backwards compatibility is not desired.

It should be appreciated that the printed circuit board 202 can alternatively be constructed in accordance with the alternative footprint FP3. For example, the printed circuit 202 constructed in accordance with the alternative footprint FP3 and configured to receive mounting tails of only a single connector can include a first pair of electrical signal vias 208, such as electrical signal vias 208*a* and 208*c*, respectively, that are arranged inline with respect to each other along a first column that extends along the column direction C and can be coincident with the centerline CR1. The printed circuit 202 constructed in accordance with the alternative footprint FP3 can further include a second pair of electrical signal vias 208, such as electrical signal vias 208*b* and 208*d* that are arranged inline with respect to each other along a second column that extends along the column direction C and can be coincident with the centerline CR2. The first and second columns are spaced apart from each other along the row direction. The printed circuit 202 constructed in accordance with the alternative footprint FP3 can further include a first pair of electrical ground vias 210*a* and 210*b*, that are each inline with each other along a third column that extends substantially along the column direction C and can be coincident with the a first one of the centerlines CR4. The printed circuit 202 constructed in accordance with the alternative footprint FP3 can further include a second pair of electrical ground vias 210*c* and 210*d*, that are each inline with each other along a fourth column that extends substantially along the column direction C and can be coincident with the a second one of the centerlines CR4. Further in accordance with the illustrated embodiment, the first pair of electrical ground vias is disposed between each of the first pair of electrical signal vias 208 along the column direction C, and the second pair of ground vias are further disposed between the second pair of electrical signal vias 208 along the column direction C, and the first and second columns are disposed between the third and fourth columns.

Further in accordance with the illustrated embodiment, each electrical ground via 210 of the first and second pairs of electrical ground vias 210 is disposed substantially equidistantly between one of the first pair of electrical signal vias 208 and one of the second pair of electrical signal vias 208 along the column direction C. For instance, a first electrical ground via 210*a* of the first pair of electrical ground vias 210 is disposed substantially equidistantly between a first electrical signal via 208*a* of the first pair of electrical signal vias 208 and a first electrical signal via 208*b* of the second pair of electrical signal vias 208. Similarly, a first electrical ground via 210*c* of the second pair of electrical ground vias 210 is disposed substantially equidistantly between the first electrical signal via 208*a* of the first pair of electrical signal vias 208 and the first electrical signal via 208*b* of the second pair of electrical signal vias 208. Additionally, a second electrical ground via 210*b* of the first pair of electrical ground vias 210 is disposed substantially equidistantly between a second electrical signal via 208*c* of the first pair of electrical signal vias 208 and a second electrical signal via 208*d* of the second pair of electrical signal vias 208. Similarly, a second electrical ground via 210*d* of the second pair of electrical ground vias 210 is disposed substantially equidistantly between the second electrical signal via 208*c* of the first pair of electrical signal vias 208 and the second electrical signal via 208*d* of the second pair of electrical signal vias 208.

Referring now to FIGS. 10A-10G, a plurality of electrical signal contacts 704 constructed in accordance with an alternative embodiment is illustrated. In the interest of succinctness, elements of the electrical signal contacts 704 that are constructed substantially identically to corresponding elements of the electrical signal contacts 104 are labeled with reference numbers that are incremented by 600. It should be appreciated that at least one such as a plurality of the electrical signal contacts 704 can be supported by the connector housing 102 of the electrical connector 100 along with at least one such as a plurality of any of the ground plates described herein, for instance any of the ground plates 106, 306, 406, 506, or 606, as desired. In accordance with the illustrated embodiment, the electrical signal contacts 704 are depicted in a configuration of electrical contacts 105 utilizing a pair of the ground plates 606, including a first ground plate 606*a* and a second ground plate 606*b*.

In accordance with the illustrated embodiment, at least one such as each electrical signal contact 704 of the plurality can be twisted about a respective twist axis that extends through at least a portion of the contact body 707. For example, the twist axis can extend substantially along the third direction, and can extend through at least a portion of the intermediate region 709 of the contact body 707. Accordingly, the contact body 707 of each of the plurality of electrical signal contacts 704 can define at least one twisted region 754 that is twisted about the respective twist axis. The twisted region 754 can be located along the contact body 707. For example, the twisted region 754 can be located between the mating end 712 and the mounting end 708. In accordance with one embodiment, the twisted region 754 can be located closer to the mounting end 708 than the mating end 712, such as closer to the mounting end 708 than to a midpoint of the contact body 707 that is disposed equidistantly between the mating end 712 and the mounting end 708 along the transverse direction T. In this regard, it can be said that the twisted region 754 of each contact body 707 is located nearer the respective mounting end 708 than the respective mating end 712. It should be appreciated that the electrical signal contacts 704 are not limited to the illustrated twisted region 754, and that the electrical signal contacts 704 can be alternatively constructed with any other twist geometry as desired.

The contact body 707 of each of the electrical signal contacts 704 can be twisted about a respective twist axis such that the first and second ones of the broadsides 726 at the mating end 712 of each of the electrical signal contacts 704 are angularly offset with respect to the first and second ones of the broadsides 726 at the mounting end 708 of the electrical signal contact 704. For example, in accordance with the illustrated embodiment, the first and second ones of the broadsides 726 are oriented along the first direction at the mating end 712, and the first and second ones of the broadsides 726 at the mounting end 708 can define a portion of the mounting end 708, such as a first portion 708*a* that is offset from the first and second ones of the broadsides 726 at the mating end 712 along the second direction. Furthermore, the first and second ones of the broadsides 726 at the mounting end 708 can define a second portion 708*b* of the mounting end 708 that is substantially aligned with the first and second ones of the broadsides 726 at the mating end 712 along the third direction.

Additionally, the first and second broadsides 726 of each electrical signal contact 704 can define a first region at the respective mounting end 708 and a second region at the respective mating end 712, such that the first region is angularly offset with respect to the second region. Furthermore, the first and second edges 728 of the each electrical signal contact 704 can define a first region at the respective mounting end 708 and a second region at the respective mating end 712, such that the first region is angularly offset with respect to the second region. In this regard, it can thus be said that the mounting end 708 of each electrical signal contact 704 is out of plane with respect the corresponding mating end 712. It can further be said that the mating end 712 of each electrical signal contact 704 is oriented along the first direction, and that the mounting end 708 of each electrical signal contact 704 can be oriented along a second direction that is angularly offset relative to the first direction.

Furthermore, the first region of the broadside 726 of at least one or more, up to all, of the electrical signal contacts 704 can extend substantially parallel with the first region of the broadsides 726 of at least one or more, up to all, of the others of the electrical signal contacts 704. Similarly, the first region of the edges 728 of at least one or more, up to all, of the electrical signal contacts 704 can extend substantially parallel with the first region of the edges 728 of at least one or more, up to all, of the others of the electrical signal contacts 704.

With continuing reference to FIGS. 10A-10G, a plurality of leadframe assemblies 756 constructed in accordance with an alternative embodiment are illustrated. The leadframe assemblies 756 can be supported by the connector housing 102, as described above with reference to the leadframe assemblies 130. Each leadframe assembly 756 can include a dielectric or electrically insulative leadframe housing 758 and at least one such as a plurality of electrical contacts 105 that can be configured as electrical signal contacts 704 that are supported by the leadframe housing 758. In accordance with the illustrated embodiment, each leadframe assembly 756 includes a pair of electrical signal contacts 704 that are spaced apart from one another along the column direction C. The leadframe assemblies 756 can be configured as insert molded leadframe assemblies (IMLAs) whereby the respective leadframe housings 758 are overmolded onto respective ones of the plurality of electrical signal contacts 704. For instance, the leadframe housing 758 of each leadframe assembly 756 can be overmolded onto the corresponding electrical signal contacts 704 such that the leadframe housing 758 is overmolded onto, and thus encloses, at least a portion of the contact body 707, for instance the twisted regions 754, of each of the respective electrical signal contacts 704 supported by the leadframe housing 758. Alternatively, the respective ones of the electrical signal contacts 704 can be stitched into the leadframe housings 758 or otherwise supported by the respective leadframe housings 758.

A plurality up to all of the leadframe assemblies 756 can include at least one pair 757 such as a plurality of pairs 757 of first and second leadframe assemblies 756*a* and 756*b*, respectively. The first and second leadframe assemblies 756*a* and 756*b* of each pair 757 can be constructed substantially identically. The first leadframe assembly 756*a* and the second leadframe assembly 756*b* of each pair 757 can be disposed adjacent each other, for instance along the row direction R, when supported by the connector housing 102, so as to define the first and second differential signal pairs 717*a* and 717*b*. For example, in accordance with the illustrated embodiment, the first leadframe assembly 756*a* can have a first leadframe housing 758*a* that is overmolded onto the first pair 713*a* of electrical signal contacts 704 and the second leadframe assembly 756*b* can have a second leadframe housing 758*b* that is overmolded onto the second pair 713*b* of electrical signal contacts 704. Accordingly, the first electrical signal contact 704*a* of the first leadframe assembly 756*a* and the first signal electrical contact 704*c* of the second leadframe assembly 756*b* can define the first differential signal pair 717*a*, and the second electrical signal contact 704*b* of the first leadframe assembly 756*a* and the second electrical signal contact 704*d* of the second leadframe assembly 756*b* can define the second differential signal pair 717*b*.

The first and second leadframe assemblies 756*a* and 756*b* of each pair 757 can be configured to interface with one another when disposed adjacent to one another in the connector housing 102. For example, the leadframe housing 758 of each of the first and second leadframe assemblies 756*a* and 756*b*, respectively, of each pair 757 can include at least one interface member 735 that is configured to receive a complementary at least one interface member 735 supported by the leadframe housing 758 of the other of the first and second leadframe assemblies 756*a* and 756*b*, respectively, of the pair 757. Thus, the first leadframe housing 758*a* of the first leadframe assembly 756*a* can be at least partially received by the second leadframe housing 758*b* of the second leadframe assembly 756*b*, and the second leadframe housing 758*b* of the second leadframe assembly 756*b* can be at least partially received by the first leadframe housing 758*a* of the first leadframe assembly 756*a*. In accordance with the illustrated embodiment, the leadframe housing 758 of each leadframe assembly 756 includes respective pairs of interface members 735 configured as a pair of projecting portions 760 and a pair of pocket portions 762, respectively. The projecting portions 760 of each pair can be constructed the same or differently, and the pocket portions 762 of each pair can be constructed the same or differently. In accordance with the illustrated embodiment, the first leadframe housing 758*a* of the first leadframe assembly 756*a* can include a pair of first projection portions 760*a* and a pair of first pocket portions 762*a*, and the second leadframe housing 758*b* of the second leadframe assembly 756*b* can include a pair of second projection portions 760*b* and a pair of second pocket portions 762*b*. The pair of first projection portions 760*a* of the first leadframe housing 758*a* can be configured to be received in respective ones of the pair of second pocket portions 762*b* of the second leadframe housing 758*b* and the pair of second projection portions 760*b* of the second leadframe housing 758*b* can be configured to be received in the pair of first pocket portions 762*a* of the first leadframe housing 758*a*.

In accordance with the illustrated embodiment, when the first and second leadframe assemblies 756*a* and 756*b* of each pair 757 are supported by the connector housing 102, the first leadframe assembly 756*a* of each respective pair 757 can be oriented in a first orientation and the second leadframe assembly 756*b* of the corresponding pair 757 can be oriented in a second orientation relative to the first leadframe assembly 756*a* that is rotated 180 degrees about an axis that extends substantially perpendicular to the first direction and substantially parallel to the transverse direction T. When the first and second leadframe assemblies 756*a* and 756*b* are oriented in the first and second orientations, respectively, and supported by the connector housing 102, the pair of first projection portions 760*a* of the first leadframe housing 758*a* can be at least partially received in respective ones of the pair of second pocket portions 762*b* of the second leadframe housing 758*b* and the pair of second projection portions 760*b* of the second leadframe housing 758*b* can be at least partially received in the pair of first pocket portions 762*a* of the first leadframe housing 758*a*.

The projecting portions 760 of the illustrated leadframe housings 758 can at least partially enclose the mounting ends 708 of the respective electrical signal contacts 704 of the leadframe assemblies 756. Any suitable dielectric material, such as air or plastic, may be used to isolate the respective electrical signal contacts 704 of the first leadframe assembly 756*a* of a pair 757 from the respective electrical signal contacts 704 of the second leadframe assembly 756*b* of the pair 757. In accordance with the illustrated embodiment, the first and second leadframe assemblies 756*a* and 756*b* of each pair 757 are spaced from each other when supported by the connector housing 102. However it should be appreciated that at least one or both of the first and second leadframe assemblies 756*a* and 756*b* or the connector housing 102 can be alternatively constructed such that the first and second leadframe assemblies 756*a* and 756*b* abut one another when supported by the connector housing 102.

In accordance with the illustrated embodiment, each pair 757 of leadframe assemblies 756 of the plurality of leadframe assemblies 756 can be supported by the connector housing 102 between respective ground plates, for instance ground plates 606. In this regard, the connector housing 102 supports successive first and second pairs 713*a* and 713*b* of electrical signal contacts 704 and ground plates 606 when the first and second pairs 713*a* and 713*b* of electrical signal contacts 704 and ground plates 606 are supported by the connector housing 102. The respective pluralities of leadframe assemblies 756 and ground plates 606 can be arranged such that a ground plate 606 is disposed between successive adjacent pairs 757 of first and second leadframe assemblies 756*a* and 756*b*, such that the plurality of electrical contacts 105 of the electrical connector 100 define a repeating ground-signal-signal (G-S-S) arrangement of ground plates 606 and electrical signal contacts 704 along the row direction R. The ground plates 606 can be disposed between adjacent pairs 757 of leadframe assemblies 756 along the row direction R such that the ground plates 606 can reduce crosstalk between adjacent differential signal pairs 717 of the adjacent pairs 757 of leadframe assemblies 756 that are aligned along the row direction R.

Furthermore, when respective pairs of leadframe assemblies 756, for instance first and second leadframe assemblies 756*a* and 756*b*, respectively, are supported by the connector housing 102 in accordance with the illustrated embodiment, the mounting ends 708 of each electrical signal contacts 704 of the respective first and second leadframe assemblies 756*a* and 756*b* are aligned along a column that extends along the column direction C, which can be substantially parallel to the lateral direction A. Accordingly, a plane defined by the lateral direction A and the transverse direction T can extend through the mounting end 708 of each electrical signal contact 704 of each of the first and second leadframe assemblies 756*a* and 756*b* of a given pair 757. Thus also, a straight line that extends along the lateral direction A extends through the mounting end 708 of each electrical signal contact 704 of each of the first and second leadframe assemblies 756*a* and 756*b* of a given pair 757. The plane and the straight line can extend substantially parallel to one or both of the first and second ground plates 606*a* and 606*b*.

Additionally, the mounting ends 708 of each electrical signal contact 704 of each of the first and second leadframe assemblies 756*a* and 756*b* of a given pair 757 can be evenly spaced from one or both of the adjacent first and second ground plates 606*a* and 606*b*. For instance, the mounting ends 708 of each electrical signal contact 704 of each of the first and second leadframe assemblies 756*a* and 756*b* of a given pair 757 can support a tail 711, and the tails 711 can be evenly spaced from one or both of the adjacent first and second ground plates 606. The straight line and the plane can extend through the tail 711 of each electrical signal contact 704 of each of the first and second leadframe assemblies 756*a* and 756*b* of a given pair 757. The plane and the straight line can extend through the same respective portion of the tail 711 of each of the electrical signal contacts 704, such that the tails 711 of the electrical signal contacts 704 are substantially inline along the lateral direction A, for example along centerline CR1 (see FIG. 10G). For instance, the straight line and the plane can extend through the eye of the needle opening of the tail 711 of each of the electrical signal contacts 704.

Accordingly, the tails 711 of each electrical signal contact 704 of each of the first and second leadframe assemblies 756*a* and 756*b* of a given pair 757 can be said to be inline relative to each other along the column direction C, for example along a column. In this regard, it can be said that the respective tails 711 of the first and second pairs 713*a* and 713*b* of electrical signal contacts 704 are aligned with respect to each other along the first direction. Moreover, it should be appreciated that the first and second mounting ends 610*a* and 610*b* of each of the ground plates 606 are aligned along respective columns that extend along the column direction C. For example, in accordance with the illustrated embodiment, the mounting ends 708 of the electrical signal contacts 704 of the first and second leadframe assemblies 756*a* and 756*b* are aligned along a first column C1, the first and second mounting ends 610*a* and 610*b* of the first ground plate 606*a* that is disposed adjacent the first leadframe assembly 756*a* are aligned along a second column C2 that is disposed adjacent to the first column C1 and substantially parallel to the first column C1, and the first and second mounting ends 610*a* and 610*b* of the second ground plate 606*b* that is disposed adjacent the second leadframe assembly 756*b* are aligned along a third column C3 that is disposed adjacent and substantially parallel to the first column C1. Thus, the first column C1 is disposed between the second and third columns C2 and C3. It should be appreciated that the electrical connector 100 is not limited to the illustrated columns C1, C2, C3, and that the electrical connector 100 can define more or fewer columns of electrical contacts 105, for instance in accordance with the number of ground plates 606 and the number of pairs of leadframe assemblies 756 supported by the connector housing 102.

The ground plates 606 and the pairs 757 of leadframe assemblies 756 can be spaced apart from one another in the connector housing 102 along the longitudinal direction L in accordance with a pre-determined column pitch. For instance, in accordance with the illustrated embodiment, the electrical connector 100 is constructed with a column pitch of between approximately 0.6 mm to approximately 1.4 mm, including approximately 0.75 mm, such that the mounting ends 708 of the electrical signal contacts 704 of a first one of the pairs 757 of leadframe assemblies 756 are spaced from the mounting ends 610 of a first ground plate 606*a* approximately 0.75 mm along the row direction R, and spaced from the mounting ends 610 of a second ground plate 606*b* approximately 0.75 mm along the row direction R, such that the first column C1 is spaced from each of the second and third columns C2 and C3 approximately 0.75 mm along the row direction R. In accordance with an alternative embodiment, the electrical connector 100 can be alternatively constructed with a column pitch of approximately 1 mm.

The industry standard MicroTCA® PF footprint can be modified to operate with the illustrated configuration of electrical signal contacts 704 and ground plates 606. For example, the plurality of vias 206 can be disposed along the printed circuit board so as to define a fourth alternative footprint FP4. It should be appreciated that in accordance with the illustrated embodiment, the contact bodies 707 of the electrical signal contacts 704 are twisted such that the mounting ends 708 of the respective electrical signal contacts 704 of the first and second leadframe assemblies 756*a* and 756*b* of each pair 757 are substantially aligned with respect to each other along the lateral direction A, and thus can be said to be inline with respect to each other along the first direction.

In order to make the alternative footprint FP4 compatible with the illustrated configuration of electrical signal contacts 704 and ground plates 606, the respective electrical signal vias 208 of the first and second pairs 212*a* and 212*b* of the industry standard MicroTCA® PF footprint can be repositioned and aligned with respect to each other along the centerline CR1. For example, in accordance with the industry standard MicroTCA® PF footprint, the electrical signal vias 208*a* and 208*c* can be said to be inline with each other in a first column that is coincident with the centerline CR1 and the electrical signal vias 208*b* and 208*d* can be said to be inline with each other in a second column that is coincident with the centerline CR2. In accordance with the alternative footprint FP4, the electrical signal vias 208*b* and 208*d* can be repositioned such that the first and second columns are coincident with each other; so that the electrical signal vias 208*a*-208*d* of each column are inline with each other in the column direction C along respective centerlines CR1. In this regard, it can be said that each centerline CR1 passes through the geometric center of each of the respective electrical signal vias 208 of the first and second pairs 212*a* and 212*b* of electrical signal vias 208 of each column, and thus that the first and second pairs 212*a* and 212*b* or electrical signal vias 208 are centrally disposed along respective centerlines CR1. This arrangement increases available routing channel width, for instance the channel width available for routing electrical traces, within a printed circuit board 202 constructed in accordance with the alternative footprint FP4, as compared to a printed circuit board 202 constructed in accordance with the industry standard MicroTCA® PF footprint, wherein the vias 206 are not inline with respect to one another along the column direction C.

In order to further make the alternative footprint FP4 compatible with the illustrated configuration of electrical signal contacts 704 and ground plates 606, additional electrical ground vias 210 can be disposed between the columns of electrical signal vias 208 of the industry standard MicroTCA® PF footprint. For example, in accordance with the illustrated embodiment, the alternative footprint FP4 defines a plurality of centerlines CR4, each centerline CR4 spaced substantially equidistantly along the row direction R between successive centerlines CR1 of the industry standard MicroTCA® PF footprint. At least one electrical ground via 210 such as a pair of electrical ground vias 210 is disposed along each of the plurality of centerlines CR4, such that each of the at least one electrical ground vias 210 is disposed between successive columns of electrical signal vias 208.

It should be appreciated that the printed circuit board 202 can alternatively be constructed in accordance with the alternative footprint FP4. For example, the printed circuit 202 constructed in accordance with the alternative footprint FP4 and configured to receive mounting tails of only a single connector can include a first pair of electrical signal vias 208, such as electrical signal vias 208*a* and 208*c*, and a second pair of electrical signal vias 208, such as electrical signal vias 208*b* and 208*d*, wherein the electrical signal vias 208 of the first and second pairs are arranged inline with respect to each other along respective first and second columns that extend along the column direction C and can be coincident with each and coincident with the centerline CR1. The printed circuit 202 constructed in accordance with the alternative footprint FP4 can further include a first pair of electrical ground vias 210*a* and 210*b*, that are each inline with each other along a third column that extends substantially along the column direction C and can be coincident with the a first one of the centerlines CR4. The printed circuit 202 constructed in accordance with the alternative footprint FP3 can further include a second pair of electrical ground vias 210*c* and 210*d*, that are each inline with each other along a fourth column that extends substantially along the column direction C and can be coincident with the a second one of the centerlines CR4. It should be appreciated that the first and second columns are disposed substantially equidistantly between the third and fourth columns.

Further in accordance with the illustrated embodiment, each electrical ground via 210 of the first and second pairs of electrical ground vias 210 is disposed substantially equidistantly between one of the first pair of electrical signal vias 208 and one of the second pair of electrical signal vias 208 along the column direction C. For instance, a first electrical ground via 210*a* of the first pair of electrical ground vias 210 is disposed substantially equidistantly between a first electrical signal via 208*a* of the first pair of electrical signal vias 208 and a first electrical signal via 208*b* of the second pair of electrical signal vias 208. Similarly, a first electrical ground via 210*c* of the second pair of electrical ground vias 210 is disposed substantially equidistantly between the first electrical signal via 208*a* of the first pair of electrical signal vias 208 and the first electrical signal via 208*b* of the second pair of electrical signal vias 208. Additionally, a second electrical ground via 210*b* of the first pair of electrical ground vias 210 is disposed substantially equidistantly between a second electrical signal via 208*c* of the first pair of electrical signal vias 208 and a second electrical signal via 208*d* of the second pair of electrical signal vias 208. Similarly, a second electrical ground via 210*d* of the second pair of electrical ground vias 210 is disposed substantially equidistantly between the second electrical signal via 208*c* of the first pair of electrical signal vias 208 and the second electrical signal via 208*d* of the second pair of electrical signal vias 208.

The embodiments illustrated and described herein, for example the embodiments of the electrical connector 100, when utilized with the corresponding printed circuit board 202 footprints, for instance the industry standard MicroTCA® PF footprint or the alternative footprints FP1, FP2, FP3, or FP4, can exhibit enhanced electrical performance with respect to the industry standard MicroTCA® PF footprint and the existing industry standard MicroTCA® PF electrical connectors utilized therewith. For instance, electrical simulation has demonstrated that the herein described embodiments of electrical connectors 100 and printed circuit board 202 footprints, for instance electrical connectors 100 constructed using the electrical contacts 105 illustrated in FIGS. 9A-9D and in FIGS. 10A-10F and printed circuit boards 202 constructed in accordance with the alternative footprints FP3 and FP4, respectively, can operate to transfer data, for example between the respective mating and mounting ends of each electrical contact, in the range between and including approximately 8 Gigabits/sec (including approximately 9 Gigabits/sec) and approximately 30 Gigabits/sec, such as at a minimum of approximately 12.5 Gigabits/sec (with a range of about 20 through 60 picosecond rise times, such as about 25 picosecond rise times), at a minimum of approximately 20.0 Gigabits/sec (with a range of about 20 through 60 picosecond rise times, such as about 25 picosecond rise times), and at a minimum of approximately 25 Gigabits/sec (with a range of about 20 through 60 picosecond rise times, such as about 25 picosecond rise times), including any 0.25 Gigabits/sec increments between approximately therebetween, with worst-case, multi-active crosstalk on a victim pair of between 1%-6%, including all sub ranges and all integers, for instance 1%-2%, 2%-3%, 3%-4%, 4%-5%, and 5%-6%, including 1%, 2%, 3%, 4%, 5%, and 6% within acceptable crosstalk levels of the MicroTCA® standard, for instance somewhere below about four percent (4%), such as below about three percent (3%), approximately. Furthermore, the herein described embodiments of electrical connectors 100 and printed circuit board 202 footprints can operate in the range between and including approximately 1 and 15 GHz, including any 0.25 GHz increments between 1 and 15 GHz.

Figure 12A:
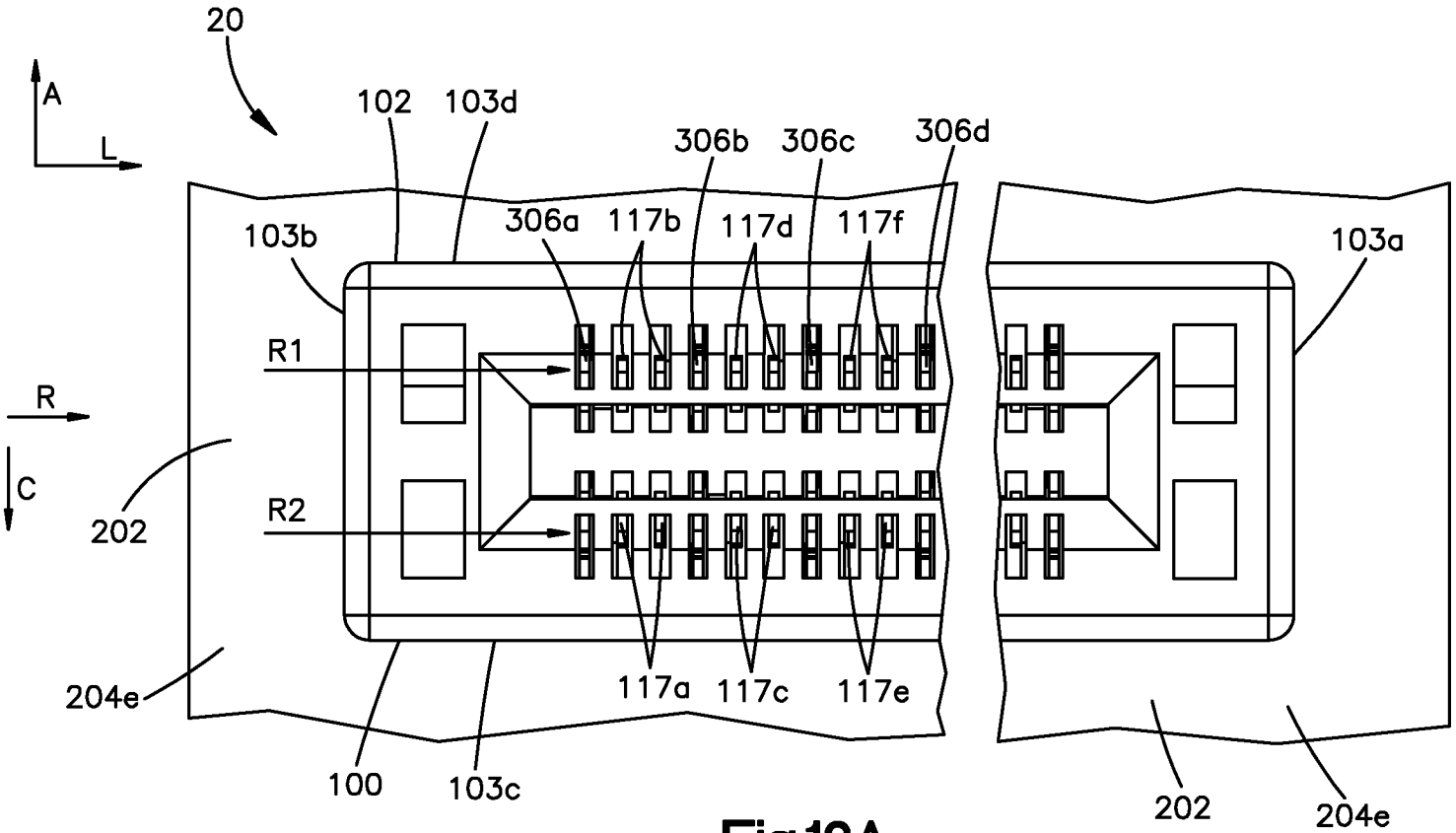
FIG. 12A is a top elevation view of an electrical assembly including the electrical connector illustrated in FIGS. 6A-6B, mounted to a printed circuit board, illustrating a crosstalk victim differential signal pair and five aggressor differential signal pairs.
Figure 12B:
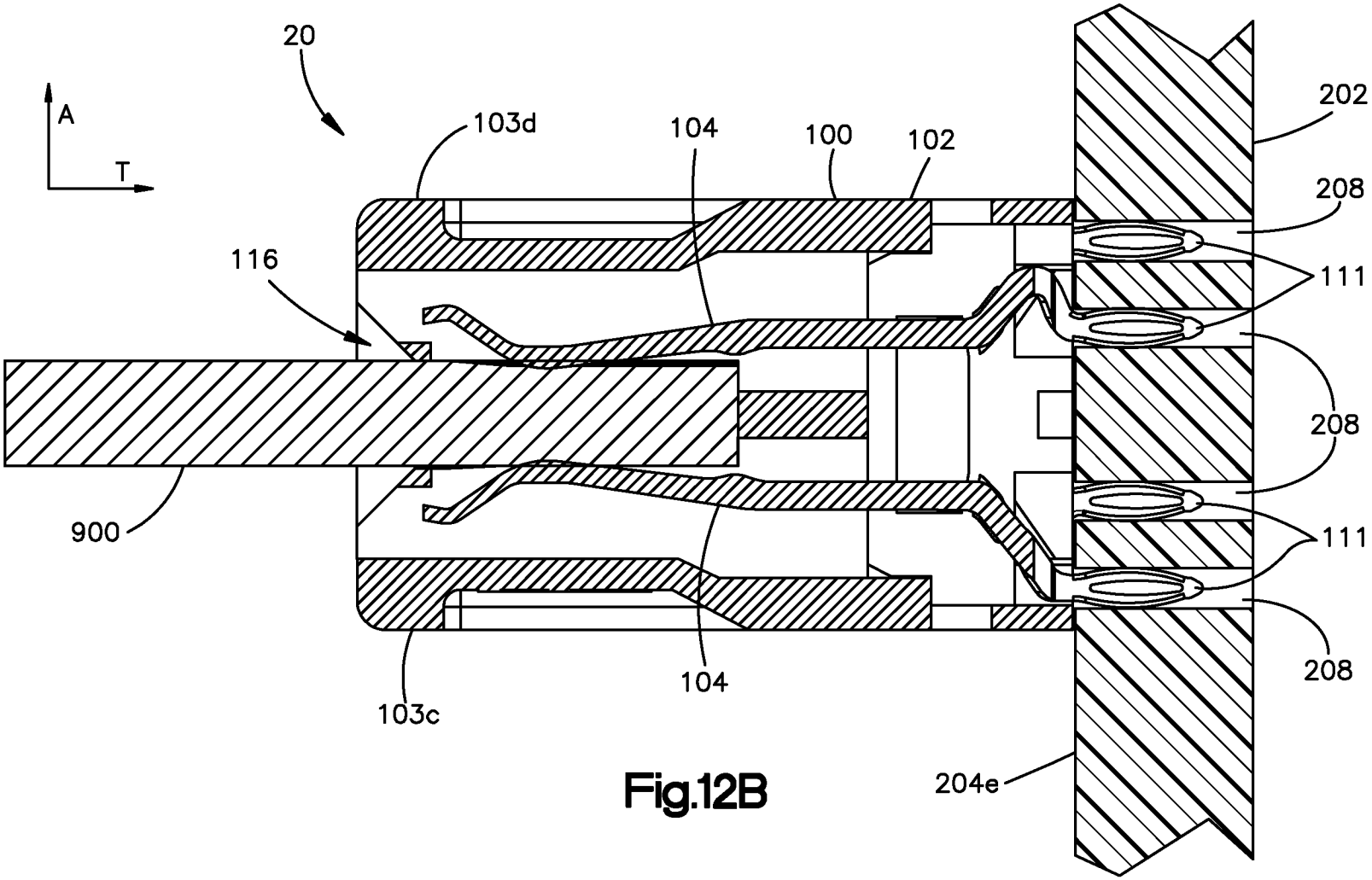
FIG. 12B is a side elevation view of the electrical assembly illustrated in FIG. 12A.

Referring now to FIGS. 12A-12B, in accordance with the MicroTCA® standard, the accepted level of crosstalk, such as near end crosstalk, can be dependent upon the particular type of MicroTCA® electrical assembly. For instance, an electrical assembly 20 constructed as an AdvancedMC Backplane Connector in accordance with the MicroTCA® standard can include a printed circuit board 202 and an electrical connector 100 mounted to the printed circuit board 202. In accordance with the illustrated embodiment, the electrical assembly 20 further includes a complementary electrical component in the form of an edge card configured as an AdvancedMC module 900 that is mated to the mating interface 116 of the electrical connector 100 so as to place the AdvancedMC module 900 in electrical communication with the electrical connector 100, and thus with the printed circuit board 202. It should be appreciated that the electrical connector 100 of the electrical assembly 20 can be constructed in accordance with any of the herein described embodiments of the electrical connectors 100 and can be configured as an AdvancedMC Backplane Connector configured to operate in accordance with the acceptable levels of crosstalk specified in accordance with the MicroTCA® standard. Similarly, the printed circuit board 202 of the electrical assembly 20 can be configured with any of the herein described printed circuit board footprints, such that the electrical connector 100 of the electrical assembly 20 can be mounted onto the printed circuit board 202 of the electrical assembly 20.

The crosstalk of the electrical connector 100 of the illustrated electrical assembly 20 should be measured under environment impedance of approximately 100 Ohms differential and at twenty to eighty percent (20%-80%) twenty five picosecond maximum input rise time. The crosstalk amplitude should be measured in a multi aggressor condition. For example the connector housing 102 can support a plurality of ground plates 306 that are spaced from each other along the row direction R, a first row R1 of electrical signal contacts 104 arranged in respective differential signal pairs 117 that are spaced from each other along the row direction R, with each differential signal pair 117 disposed between successive ones of the ground plates 306, and a second row R2 of electrical signal contacts 104 arranged in respective differential signal pairs 117 that are spaced from each other along the row direction R, with each differential signal pair 117 disposed between successive ones of the ground plates 306. The first and second rows R1 and R2 of electrical signal contacts 104 are spaced from each other along the column direction C, with corresponding differential signal pairs 117 in the first and second rows R1 and R2 that are disposed between respective successive ones of the ground plates 306 substantially aligned with respect to each other along the column direction C.

In accordance with the illustrated embodiment, the electrical connector 100 comprises a first ground plate 306*a* supported by the connector housing 102 substantially at the second end 103*b* of the housing body 103 and respective pairs 113 of electrical signal contacts configured as first and second differential signal pairs 117*a* and 117*b* are disposed between the first ground plate 306*a* and a second ground plate 306*b* that is successive with respect to the first ground plate 306*a*. The first differential signal pair 117*a* is disposed in the second row R2 of electrical signal contacts 104, and the second differential signal pair 117*b* is disposed in the first row R1 of electrical signal contacts 104. The illustrated electrical connector 100 further comprises third and fourth differential signal pairs 117*c* and 117*d* that are disposed between the second ground plate 306*b* and a third ground plate 306*c* that is successive with respect to the second ground plate 306*b*. The third differential signal pair 117*c* is disposed in the second row R2 of electrical signal contacts 104 and is successive with respect to the first differential signal pair 117*a*, and the fourth differential signal pair 117*d* is disposed in the first row R1 of electrical signal contacts 104 and is successive with respect to the second differential signal pair 117*b*. The illustrated electrical connector 100 further comprises fifth and sixth differential signal pairs 117*e* and 117*f* that are disposed between the third ground plate 306*c* and a fourth ground plate 306*d* that is successive with respect to the third ground plate 306*c*. The fifth differential signal pair 117*e* is disposed in the second row R2 of electrical signal contacts 104 and is successive with respect to the third differential signal pair 117*c*, and the sixth differential signal pair 117*f* is disposed in the first row R1 of electrical signal contacts 104 and is successive with respect to the fourth differential signal pair 117*d*.

In order to measure the crosstalk amplitude of the electrical assembly 20 in a multi aggressor condition, and therefore in accordance with the MicroTCA® standard, the crosstalk induced by five differential signal pairs designated as multi-aggressor differential signal pairs at a single differential signal pair designated as a victim differential signal pair should be measured. In accordance with the illustrated embodiment, the third differential signal pair 117*c* is designated as the victim differential signal pair, and the first, second, fourth, fifth, and sixth differential signal pairs 117*a*, 117*b*, 117*d*, 117*e*, and 117*f*, respectively, are designated as the five multi-aggressor differential signal pairs that induce crosstalk at the victim differential signal pair. In accordance with the MicroTCA® standard, the differential crosstalk amplitude induced by the five multi-aggressor differential signal pairs at the victim differential signal pair should be less than three percent (3%). It should be appreciated that the crosstalk amplitude at the victim, or third, differential signal pair 117*c* should be less than 3% for an electrical connector 100 including electrical contacts having any type of mounting elements, for example press-fit mounting elements such as eye of the needle tails, surface mounting elements such as solder balls, or any other suitable mounting elements. The differential attenuation profile, or insertion loss, of the electrical assembly 20 should be greater than −1 dB at 6.5 GHz, greater than −2 dB at 12 GHz and greater than −4 dB at 14.5 GHz. It should be appreciated that the differential attenuation profile should be substantially equal to the above for an electrical connector 100 including electrical contacts having any type of mounting elements, for example press-fit mounting elements such as eye of the needle tails, surface mounting elements such as solder balls, or any other suitable mounting elements.

Figure 13A:
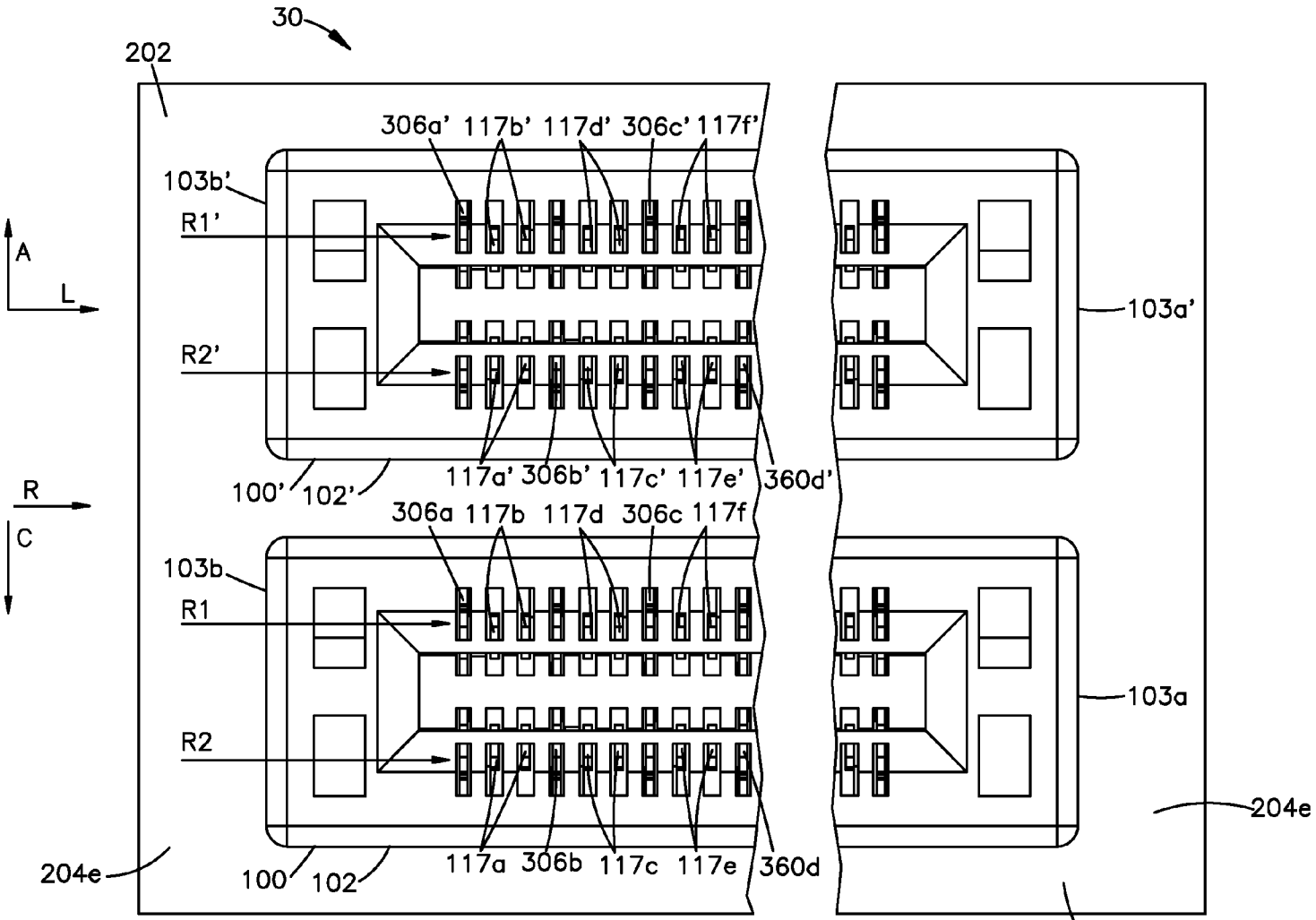
FIG. 13A is a top elevation view of a pair of electrical connectors constructed in accordance with the electrical connector illustrated in FIGS. 6A-6B, illustrating a crosstalk victim differential signal pair and eight aggressor differential signal pairs.
Figure 13B:
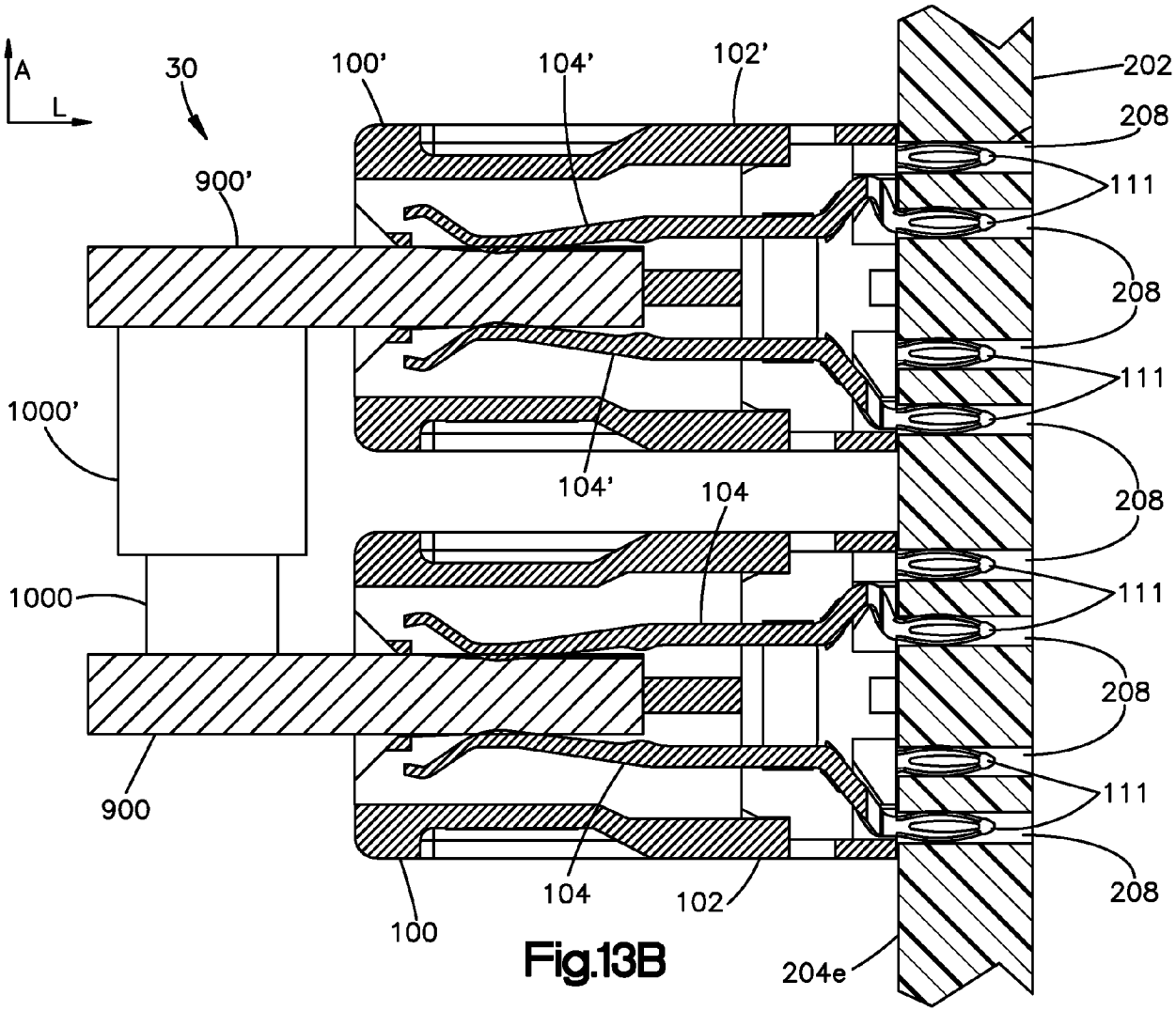
FIG. 13B is a side elevation view of the electrical assembly illustrated in FIG. 13A.

Referring now to FIGS. 13A-13B, in accordance with the MicroTCA® standard, the accepted level of crosstalk, such as near end crosstalk, is different for an electrical assembly 30 constructed as a MicroTCA® Carrier Hub (MCH) than for the electrical assembly 20. The electrical assembly 30 can include a printed circuit board 202 and first and second electrical connectors 100 and 100' mounted to the printed circuit board 202 and spaced apart from each other along the lateral direction A. In accordance with the illustrated embodiment, the first and second electrical connectors 100 and 100' are constructed substantially identically and are mounted to the printed circuit board 202 such that the connector housings 102 and 102' of the first and second electrical connectors 100 and 100' are substantially parallel with respect to each other and with respect to the longitudinal direction L, and such that the first and second ends 103*a* and 103*b* of the housing body 103 of the connector housing 102 of the first electrical connector 100 are substantially aligned with the first and second ends 103*a*' and 103*b*', respectively, of the housing body 103' of the connector housing 102' of the second electrical connector 100' along the lateral direction A.

In accordance with the illustrated embodiment, the electrical assembly 30 further includes a pair of complementary electrical components in the form of first and second edge cards configured as first and second AdvancedMC modules 900 and 900' that are mated to the first and second electrical connectors 100 and 100', respectively, so as to place the first and second AdvancedMC modules 900 and 900' in electrical communication with the respective first and second electrical connectors 100 and 100', and thus with the printed circuit board 202. The electrical assembly 30 further includes complementary electrical connectors 1000 and 1000' mounted to the first and second AdvancedMC modules 900 and 900', respectively. The complementary electrical connectors 1000 and 1000' are configured to be mated to each other so as to place the first and second AdvancedMC modules 900 and 900' in electrical communication with each other.

The first and second electrical connectors 100 and 100' can be constructed substantially the same or differently, for example in accordance with any of the herein described embodiments of the electrical connector 100. Similarly the respective footprints on the printed circuit board 202 that correspond to the first and second electrical connectors 100 and 100' can be arranged substantially the same or differently. For example, it should be appreciated that one or both of the first and second electrical connectors 100 and 100' of the electrical assembly 30 can be constructed in accordance with any of the herein described embodiments of the electrical connectors 100, and can be configured as a MicroTCA® Carrier Hub (MCH) configured to operate in accordance with the acceptable levels of crosstalk specified in accordance with the MicroTCA® standard. Similarly, the printed circuit board 202 of the electrical assembly 30 can be configured with one or more of any of the herein described printed circuit board footprints, such that the first and second electrical connectors 100 and 100' of the electrical assembly 30 can be mounted onto the printed circuit board 202 of the electrical assembly 30. It should be further be appreciated that a MicroTCA® Carrier Hub (MCH) is not limited to two electrical connectors, and that a MicroTCA® Carrier Hub (MCH) can be alternatively constructed including more than two, such as four, electrical connectors.

The crosstalk of the first electrical connector 100 of the illustrated electrical assembly 30 should be measured under environment impedance of approximately 100 Ohms differential and at twenty to eighty percent (20%-80%) twenty five picosecond maximum input rise time. The crosstalk amplitude should be measured in a multi aggressor condition. In accordance with the illustrated embodiment, the electrical connector 100 of the electrical assembly 30 is constructed substantially identically to the electrical connector 100 of the electrical assembly 20. Furthermore, the electrical connector 100' is constructed substantially identically to the electrical connector 100, and includes first, second, third, and fourth ground plates 306*a*', 306*b*', 306*c*', and 306*d*', and first, second, third, fourth, fifth, and sixth differential signal pairs 117*a*', 117*b*', 117*c*', 117*d*', 117*e*', and 117*f*, disposed in the connector housing 102' along respective first and second rows R1' and R2' of electrical signal contacts 104'.

In order to measure the crosstalk amplitude of the electrical assembly 30 in a multi aggressor condition, and therefore in accordance with the MicroTCA® standard, the crosstalk induced by eight differential signal pairs designated as multi-aggressor differential signal pairs at a single differential signal pair designated as a victim differential signal pair should be measured. In accordance with the illustrated embodiment, the fourth differential signal pair 117*d* of the first electrical connector 100 is designated as the victim differential signal pair, and the first, second, third, fifth, and sixth differential signal pairs 117*a*, 117*b*, 117*c*, 117*e*, and 117*f* of the first electrical connector 100, and the first, third, and fifth differential signal pairs 117*a*', 117*c*', and 117*e*' of the second electrical connector 100', respectively, are designated as the eight multi-aggressor differential signal pairs that induce crosstalk at the victim differential signal pair. In accordance with the MicroTCA® standard, the differential crosstalk amplitude induced by the eight multi-aggressor differential signal pairs at the victim differential signal pair should be less than four percent (4%). It should be appreciated that the crosstalk amplitude at the victim, or fourth, differential signal pair 117*d* should be less than 4% for first and second electrical connectors 100 and 100' including electrical contacts having any type of mounting elements, for example press-fit mounting elements such as eye of the needle tails, surface mounting elements such as solder balls, or any other suitable mounting elements. The differential attenuation profile, or insertion loss, of the electrical assembly 30 should be greater than −1 dB at 6.5 GHz, greater than −2 dB at 12 GHz and greater than −4 dB at 14.5 GHz. It should be appreciated that the differential attenuation profile should be substantially equal to the above for first and second electrical connectors 100 and 100' including electrical contacts having any type of mounting elements, for example press-fit mounting elements such as eye of the needle tails, surface mounting elements such as solder balls, or any other suitable mounting elements.

A method of fabricating an electrical connector 100 in accordance with the herein described embodiments can include supporting a plurality electrical signal contacts 704 in the connector housing 102, wherein respective pairs 113 of the plurality of electrical signal contacts 704 define differential signal pairs 717. The method can further include supporting first and second ground plates 606*a* and 606*b*, respectively, in the connector housing 102, such that the electrical connector includes one hundred seventy mating ends 95 that are spaced along two columns that each extend along the row direction R collectively from the mating ends 712 of the plurality of electrical signal contacts 704 and the ground mating ends 614 of the first and second ground plates 606*a* and 606*b*, the one hundred seventy mating ends 95 defining a 0.75 mm column pitch. The method further includes positioning the plurality of electrical signal contacts 704 and the ground plates 606 in the connector housing 102 such that the signal mounting tails 711 and the ground mounting tails 611*a* and 611*b* define a footprint that differs from a footprint defined by vias 206 of a printed circuit board 202 that are arranged in accordance with MicroTCA specification Rev. 1.0, such that the electrical signal contacts 704 are configured to transfer data between the mounting tails and the mating ends at a minimum of approximately 12.5 Gigabits/second at an acceptable level of near-end crosstalk. The acceptable level of near-end cross talk can be, for instance, less than approximately four percent (4%), for instance less than approximately three percent (3%). The method can further include configuring the electrical signal contacts 704 to transfer data at higher speeds, such as a minimum of approximately 20 Gigabits/second at the acceptable level of near-end crosstalk, and a minimum of approximately 25 Gigabits/second at the acceptable level of near-end crosstalk.

An electrical connector, for instance an electrical connector constructed in accordance with the above-described method, can include a connector housing and a plurality electrical signal contacts supported in the connector housing. The electrical signal contacts can define signal mounting tails and mating ends. Respective pairs of the plurality of electrical signal contacts define differential signal pairs. The electrical connector further includes first and second ground plates supported in the connector housing. Each of the plurality of first and second ground plates including ground mounting tails and ground mating ends. The electrical signal contacts and the first and second ground plates can collectively define one hundred seventy mating ends that are spaced along two columns that each extend along a row direction collectively from the mating ends of the plurality of electrical signal contacts to the ground mating ends. The one hundred seventy mating ends can define a 0.75 mm column pitch. The electrical signal contacts and the ground plates can be positioned in the connector housing such that the signal and ground mounting tails define a footprint that differs from a footprint defined by vias of a printed circuit board that are arranged in accordance with MicroTCA specification Rev. 1.0, such that the electrical signal contacts are configured to transfer data between the mounting tails and the mating ends at a minimum of approximately 12.5 Gigabits/second at an acceptable level of near-end crosstalk.

The acceptable level of near-end cross talk can be less than three percent on one victim differential signal pair with five aggressor differential signal pairs at a 20-80 percent 25 picosecond maximum rise time. The acceptable level of near-end cross talk can be less than four percent on one victim differential signal pair with eight aggressor differential signal pairs at a 20-80 percent 25 picosecond maximum rise time. The electrical signal contacts can be configured to transfer data between the mounting tails and the mating ends a minimum of approximately 20 Gigabits/second at the level of near-end crosstalk. The electrical signal contacts can be configured to transfer data between the mounting tails and the mating ends a minimum of approximately 25 Gigabits/second at the level of near-end crosstalk.

Figure 11:
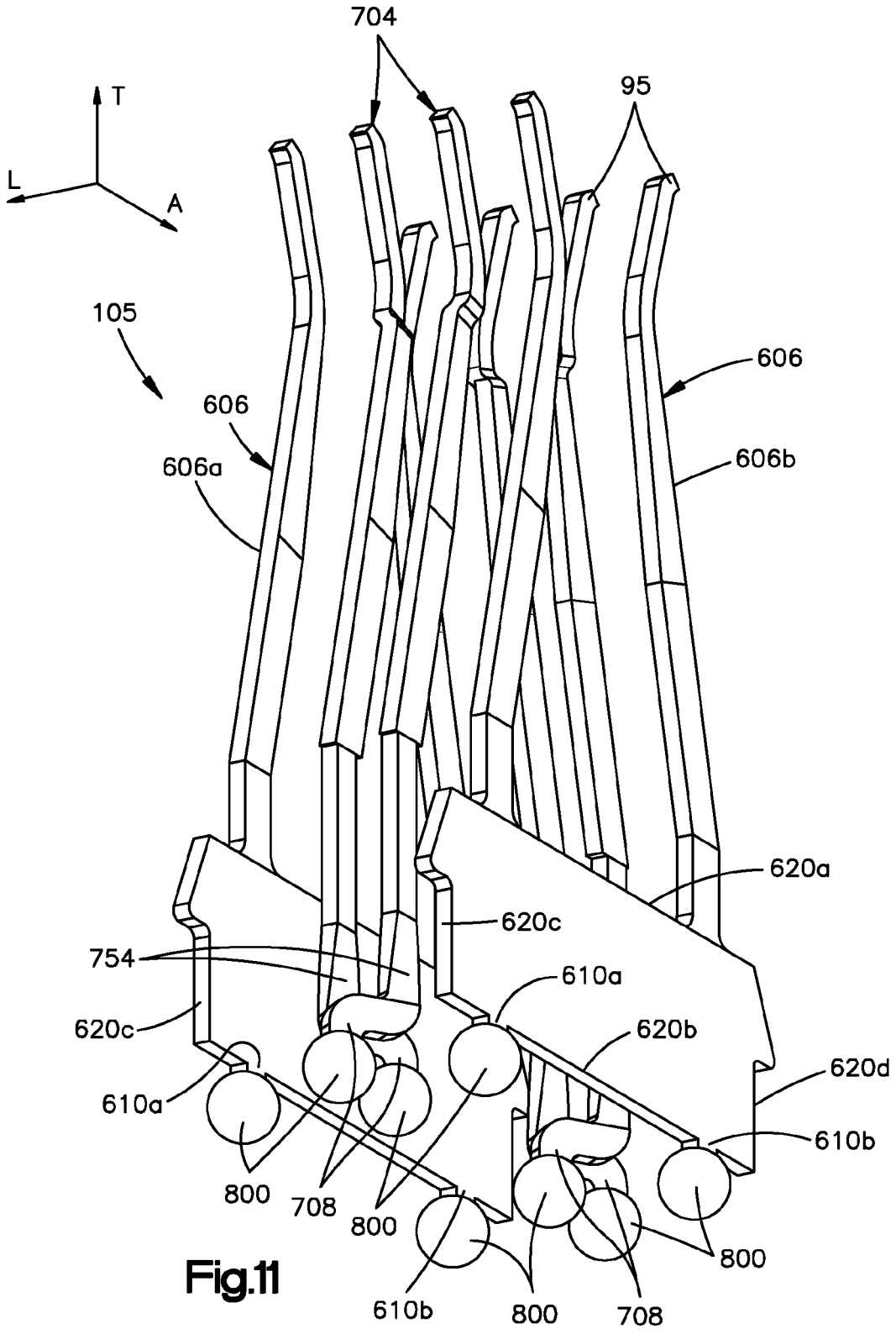
FIG. 11 is a perspective view of respective portions of the electrical signal contacts and ground plates illustrated in FIGS. 10A-10C, with the mounting ends of the electrical signal contacts and ground plates supporting solder balls.

The embodiments described in connection with the illustrated embodiments have been presented by way of illustration, and the present application is therefore not intended to be limited to the disclosed embodiments. For example, one or both of the electrical connectors 100 or the printed circuit board 202 footprints described herein may also be applicable to other types of card edge, back panel, or other connectors. Additionally, it should be appreciated that the various embodiments of the electrical contacts 105 herein illustrated and described are not limited to press-fit tail mounting elements, and that the electrical contacts 105 of any of the herein described embodiments can be alternatively constructed with any other suitable mounting elements as desired. For example, the mounting elements can alternatively be configured as surface mount mounting elements, including fusible elements such as solder balls 800 (see FIG. 11) that are configured to be solder reflowed to complementary electrical contact pads on the printed circuit board 202. Thus, it should be appreciated that the electrical connector 100 constructed in accordance with any of the embodiments described herein can include mounting elements that can be configured as press fit elements such as mounting tails, fusible elements such as solder balls 800 that can define a ball grid array (BGA) of solder balls 800, or any other suitable constructed mounting elements.

Furthermore, the structure and features of each the embodiments described above can be applied to the other embodiments described herein, unless otherwise indicated. In one example, the contact bodies 107 of the electrical signal contacts 104 of one or more of any of the other illustrated embodiments of the electrical connector 100, such as the embodiments illustrated in FIG. 3A-3D, 5A-5D, 7A-7C, 8A-8C, or 9A-9C can be twisted as described with respect to FIGS. 10A-10G such that the mounting ends 108 of the electrical signal contacts 104 are angularly offset relative to the respective mating ends 112 of the electrical signal contacts 104. It should further be appreciated that if the contact bodies 107 of the electrical signal contacts 104 of one or more of any of the other illustrated embodiments of the electrical connector 100 are twisted in accordance with the illustrated embodiment, corresponding alternative footprints to those illustrated in FIG. 7D, 8D, or 9D can be defined in which the electrical signal vias 208 are substantially aligned along the longitudinal direction L with respect to each other along the column direction C.

Accordingly, those skilled in the art will realize that the application is intended to encompass all modifications and alternative arrangements included within the spirit and scope of the application, for instance as set forth by the appended claims.

What is claimed:

1. A card edge electrical connector comprising:

a connector housing;

a plurality of electrical signal contacts supported by the connector housing, each electrical signal contact including a contact body that defines a mating end and a mounting end, wherein respective pairs of the plurality of electrical signal contacts define differential signal pairs, a plurality of ground plates supported by the connector housing, each of the plurality of ground plates including a first ground mating end that defines a first ground flow return path and a second ground mating end that defines a second ground flow return path, wherein the first and second ground flow return paths of at least one ground plate of the plurality of ground plates are substantially symmetrical with respect to one another, wherein the mating ends of the plurality of electrical signal contacts and the first and second ground mating ends of the plurality of ground plates collectively define one hundred seventy mating ends that are spaced along two rows that extend along a row direction, the one hundred seventy mating ends defining a 0.75 mm column pitch, and the connector housing supports each of the plurality of electrical signal contacts and the plurality of ground plates such that only two differential signal pairs are disposed between successive ground plates.

2. The card edge electrical connector of claim 1, wherein each of the plurality of ground plates has a plate body that defines opposed first and second sides that are spaced along a first direction, opposed first and second outer plate body surfaces that are spaced along a second direction that extends substantially perpendicular to the first direction, and opposed upper and lower ends that are spaced along a third direction that is substantially perpendicular to both the first and second directions.

3. The card edge electrical connector of claim 2, wherein each of the plurality of ground plates includes a tab that extends from the respective plate body of each ground plate, and each tab defines a mounting end.

4. The card edge electrical connector of claim 3, wherein the first and second outer plate body surfaces define a plate body thickness, and each tab defines opposed first and second side surfaces that are spaced along the first direction so as to define a tab width that is greater than the plate body thickness.

5. The card edge electrical connector of claim 3, wherein the tab of each of the plurality of ground plates extends out from the respective plate body of each ground plate at a location that is substantially equidistant between the first and second sides of the plate body along the first direction.

6. The card edge electrical connector of claim 3, wherein the tab of each of the plurality of ground plates extends out from the respective plate body of each ground plate at a location that is between the upper and lower ends.

7. The card edge electrical connector of claim 3, wherein the tab of each of the plurality of ground plates defines opposed upper and lower surfaces.

8. The card edge electrical connector of claim 7, wherein the upper and lower surfaces of the tab extend substantially perpendicular to the first and second outer plate body surfaces of each respective ground plate.

9. The card edge electrical connector of claim 3, wherein the mounting ends of the plurality of the electrical signal contacts define respective ones of a first plurality of press-fit tails, and the mounting end of the tabs of each of the ground plates defines a respective one of a second plurality of press-fit tails.

10. The card edge electrical connector of claim 9, wherein each of the first and second pluralities of press-fit tails are positioned to be inserted into complementary vias of a printed circuit board that are arranged in accordance with MicroTCA specification Rev. 1.0.

11. The card edge electrical connector of claim 10, wherein each of the second plurality of press-fit tails is disposed between respective first and second pairs of electrical signal contacts of the plurality of electrical signal contacts.

12. The card edge electrical connector of claim 11, wherein the plurality of electrical signal contacts are configured to transfer data between the mounting ends and the mating ends at a minimum of approximately 12.5 Gigabits/second at a level of near-end crosstalk that is less than three percent on one victim differential signal pair with five aggressor differential signal pairs at a 20-80 percent 25 picosecond maximum rise time.

13. The card edge electrical connector of claim 9, wherein, each of the plurality of ground plates further includes first and second mounting ends that extend from the lower end of the respective plate body such that the respective tabs are disposed between the first and second mounting ends, and the first and second mounting ends define a respective ones of a third plurality of press-fit tails.

14. The card edge electrical connector of claim 13, wherein the first mounting end is disposed closer to the first side than the second side, and the second mounting end is disposed closer to the second side than the first side.

15. The card edge electrical connector of claim 13, wherein the first and second pluralities of press-fit tails are configured to be inserted into complementary vias of a printed circuit board that are arranged in accordance with MicroTCA specification Rev. 1.0, and the third plurality of press-fit tails are positioned so as to not be insertable into the complementary vias of the printed circuit board that are arranged in accordance with MicroTCA specification Rev. 1.0.

16. The card edge electrical connector of claim 15, wherein select ones of the third plurality of press-fit tails includes first and second press-fit tails that are disposed on opposite sides of each of select ones of the first and second pluralities of press-fit tails, such that the mating ends of the respective electrical signal contacts and ground plates that defines the select ones of the first, second, and third pluralities of the press-fit tails are aligned along a column direction that is substantially perpendicular to the row direction.

17. The card edge electrical connector of claim 16, wherein the plurality of electrical signal contacts are configured to transfer data between the mounting ends and the mating ends at a minimum of approximately 12.5 Gigabits/second at a level of near-end crosstalk that is less than three percent on one victim differential signal pair with five aggressor differential signal pairs at a 20-80 percent 25 picosecond maximum rise time.

18. The card edge electrical connector of claim 2, wherein the plate body of each of the plurality of ground plates includes a first mounting end that extends from the lower end.

19. The card edge electrical connector of claim 18, wherein the first mounting end of each of the plurality of ground plates includes a press-fit tail.

20. The card edge electrical connector of claim 18, wherein the first mounting end of the each of the plurality of ground plates extends from the respective plate body of each ground plate at a location that is substantially equidistant between the first and second sides.

21. The card edge electrical connector of claim 18, wherein the lower end defines a void, and the first mounting end is aligned with the void along the second direction.

22. The card edge electrical connector of claim 21, wherein the first mounting end is spaced from the plate body along the second direction.

23. The card edge electrical connector of claim 18, wherein the lower end is substantially straight.

24. The card edge electrical connector of claim 18, wherein the first mounting end is substantially inline with the plate body.

25. The card edge electrical connector of claim 24, wherein the mounting ends of the plurality of the electrical signal contacts define respective ones of a first plurality of press-fit tails, and the first mounting ends of the plurality of ground plates defines respective ones of a second plurality of press-fit tails.

26. The card edge electrical connector of claim 25, wherein the first plurality of press-fit tails is configured to be inserted into complementary vias of a printed circuit board that are arranged in accordance with MicroTCA specification Rev. 1.0, and the second plurality of press-fit tails are positioned so as to not be insertable into the complementary vias of the printed circuit board that are arranged in accordance with MicroTCA specification Rev. 1.0.

27. The card edge electrical connector of claim 26, wherein select ones of the second plurality of press-fit tails includes first and second press-fit tails that are disposed on opposite sides of each of select ones of the first plurality of press-fit tails, such that the mating ends of the respective electrical signal contacts and ground plates that defines the select ones of the first and second pluralities of the press-fit tails are aligned along a column direction that is substantially perpendicular to the row direction.

28. The card edge electrical connector of claim 27, wherein the plurality of electrical signal contacts are configured to transfer data between the mounting ends and the mating ends at a minimum of approximately 20 Gigabits/second at a level of near-end crosstalk that is less than three percent on one victim differential signal pair with five aggressor differential signal pairs at a 20-80 percent 25 picosecond maximum rise time.

29. The card edge electrical connector of claim 24, wherein the first mounting end is coplanar with the plate body.

30. The card edge electrical connector of claim 18, wherein the plate body of each of the plurality of ground plates further includes a second mounting end that extends from the lower end and is substantially inline with the plate body.

31. The card edge electrical connector of claim 30, wherein the first and second mounting ends are coplanar with the plate body.

32. The card edge electrical connector of claim 30, wherein each of the first and second mounting ends of each of the plurality of ground plates include a respective press-fit tail.

33. The card edge electrical connector of claim 30, wherein the first mounting end extends from the plate body at a location closer to the first side than the second side, and the second mounting end extends from the plate body at a location closer to the second side than the first side.

34. The card edge electrical connector of claim 33, wherein the mounting ends of the plurality of the electrical signal contacts define respective ones of a first plurality of press-fit tails, and the first and second mounting ends of the ground plates define a second plurality of press-fit tails.

35. The card edge electrical connector of claim 34, wherein the first plurality of press-fit tails is configured to be inserted into complementary vias of a printed circuit board that are arranged in accordance with MicroTCA specification Rev. 1.0, and the second plurality of press-fit tails are positioned so as to not be insertable into the complementary vias of the printed circuit board that are arranged in accordance with MicroTCA specification Rev. 1.0.

36. The card edge electrical connector of claim 35, wherein select ones of the second plurality of press-fit tails includes first and second pairs of press-fit tails that are disposed on opposite sides of each of select ones of the first plurality of press-fit tails, such that the mating ends of the respective electrical signal contacts and ground plates that defines the select ones of the first and second pluralities of the press-fit tails are aligned along a column direction that is substantially perpendicular to the row direction.

37. The card edge electrical connector of claim 36, wherein the plurality of electrical signal contacts are configured to transfer data between the mounting ends and the mating ends at a minimum of approximately 25 Gigabits/second at a level of near-end crosstalk that is less than three percent on one victim differential signal pair with five aggressor differential signal pairs at a 20-80 percent 25 picosecond maximum rise time.

38. The card edge electrical connector of claim 36, wherein the plurality of electrical signal contacts are configured to transfer data between the mounting ends and the mating ends at a minimum of approximately 25 Gigabits/second at a level of near-end crosstalk that is less than four percent on one victim differential signal pair with eight aggressor differential signal pairs at a 20-80 percent 25 picosecond maximum rise time.

39. The card edge electrical connector of claim 30, wherein the contact body of each of the plurality of electrical signal contacts defines a twisted region that is twisted about a twist axis that extends through at least a portion of the contact body.

40. The card edge electrical connector of claim 39, wherein the twist axis extends substantially along the third direction.

41. The card edge electrical connector of claim 39, wherein the twisted region is located between the mating end and the mounting end.

42. The card edge electrical connector of claim 41, wherein the twisted region is located closer to the mounting end than the mating end.

43. The card edge electrical connector of claim 39, wherein the plurality of electrical signal contacts are configured to transfer data between the mounting ends and the mating ends at a minimum of approximately 25 Gigabits/second at a level of near-end crosstalk that is less than three percent on one victim differential signal pair with five aggressor differential signal pairs at a 20-80 percent 25 picosecond maximum rise time.

44. The card edge electrical connector of claim 39, wherein the plurality of electrical signal contacts are configured to transfer data between the mounting ends and the mating ends at a minimum of approximately 25 Gigabits/second at a level of near-end crosstalk that is less than four percent on one victim differential signal pair with eight aggressor differential signal pairs at a 20-80 percent 25 picosecond maximum rise time.

45. An electrical connector comprising:

a connector housing;

a first vertical electrical signal contact configured to be supported by the connector housing, the first vertical electrical signal contact including a first contact body that defines a first mounting end and a first mating end that is opposite the first mounting end, the first mounting end carrying a first mounting element configured to be placed in electrical connection with a printed circuit board, and the first vertical electrical signal contact defining first and second broadsides and first and second edges that extend between the first and second broadsides, a second vertical electrical signal contact configured to be supported by the connector housing, the second vertical electrical signal contact including a second contact body that defines a second mounting end and a second mating end that is opposite the second mounting end, the second mounting end carrying a second mounting element configured to be placed in electrical connection with the printed circuit board, and the second vertical electrical signal contact defining first and second broadsides and first and second edges that extend between the first and second broadsides, wherein the first mating end and the second mating end are spaced from each other along a first direction that is substantially perpendicular to the first and second broadsides of the first and second vertical electrical signal contacts, wherein each of the first and second contact bodies is twisted such that the broadsides at the first mounting end is angularly offset with respect to the broadsides at the first mating end, the broadsides at the second mounting end is angularly offset with respect to the broadsides at the second mating end, and the first mounting element is aligned with the second mounting element along a second direction that is substantially perpendicular to the first direction.

46. The electrical connector of claim 45, wherein the first and second mounting ends comprise press-fit tails.

47. The electrical connector of claim 45, wherein each of the first and second contact bodies is twisted about a respective twist axis that extends through at least a portion of the contact body.

48. The electrical connector of claim 45, wherein the first and second vertical electrical signal contacts define a differential signal pair.

49. The electrical connector of claim 45, wherein the first and second vertical electrical signal contacts define a first pair of electrical signal contacts, the electrical connector further including third and fourth vertical electrical signal contacts configured to be supported by the connector housing so as to define a second pair of electrical signal contacts.

50. The electrical connector of claim 49, wherein each of the third and fourth vertical electrical signal contacts includes a contact body that defines a mating end and a mounting end that is opposite the mating end and angularly offset with respect to the mating end.

51. The electrical connector of claim 50, further comprising a ground plate having a plate body that defines opposed upper and lower ends, the ground plate includes a pair of mating ends that extend from the upper end, and further includes a first mounting end that extends from the lower end.

52. The electrical connector of claim 51, wherein the first mounting end of the ground plate includes a press-fit tail.

53. The electrical connector of claim 51, wherein the first mounting end of the ground plate is disposed between the respective mounting ends of the first and second pairs of electrical signal contacts, respectively, when the first and second pairs of signal contacts and the ground plate are supported by the connector housing.

54. The electrical connector of claim 51, wherein the plate body includes opposed first and second sides, the ground plate further includes a second mounting end that extends out from the lower end, the first mounting end extends from the plate body at a location closer to the first side than the second side, and the second mounting end extends from the plate body at a location closer to the second side than the first side.

55. The electrical connector of claim 54, wherein each of the first and second mounting ends of the ground plate includes a press-fit tail.

* * * * *